US009304427B2

(12) United States Patent
Iwatsuki et al.

(10) Patent No.: US 9,304,427 B2
(45) Date of Patent: Apr. 5, 2016

(54) CARRIER FOR DEVELOPING AN ELECTROSTATIC LATENT IMAGE, DEVELOPER AND IMAGE FORMING APPARATUS

(71) Applicants: Hitoshi Iwatsuki, Shizuoka (JP); Shigenori Yaguchi, Shizuoka (JP); Toyoaki Tano, Shizuoka (JP); Mariko Takii, Kanagawa (JP); Koichi Sakata, Shizuoka (JP); Hiroyuki Kishida, Shizuoka (JP); Hiroshi Tohmatsu, Shizuoka (JP)

(72) Inventors: Hitoshi Iwatsuki, Shizuoka (JP); Shigenori Yaguchi, Shizuoka (JP); Toyoaki Tano, Shizuoka (JP); Mariko Takii, Kanagawa (JP); Koichi Sakata, Shizuoka (JP); Hiroyuki Kishida, Shizuoka (JP); Hiroshi Tohmatsu, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/927,744

(22) Filed: Jun. 26, 2013

(65) Prior Publication Data

US 2014/0072910 A1 Mar. 13, 2014

(30) Foreign Application Priority Data

Sep. 12, 2012 (JP) ..... 2012-200393

(51) Int. Cl.
*G03G 9/113* (2006.01)

(52) U.S. Cl.
CPC ..... *G03G 9/1139* (2013.01); *G03G 9/1131* (2013.01); *G03G 9/1136* (2013.01); *G03G 9/1137* (2013.01)

(58) Field of Classification Search
CPC .... G03G 9/113; G03G 9/1139; G03G 9/1136
USPC ..... 430/111.1, 111.35, 109.4
See application file for complete search history.

(56) References Cited

U.S. PATENT DOCUMENTS

| | | | | |
|---|---|---|---|---|
| 4,590,141 | A * | 5/1986 | Aoki et al. | 430/111.1 |
| 5,341,197 | A | 8/1994 | Folkins et al. | |
| 5,731,120 | A * | 3/1998 | Tanigami et al. | 430/111.35 |
| 6,406,826 | B1 | 6/2002 | Suzuki et al. | |
| 7,527,908 | B2 | 5/2009 | Iwatsuki et al. | |
| 8,475,989 | B2 | 7/2013 | Takahashi et al. | |
| 2007/0019995 | A1 | 1/2007 | Teraoka et al. | |
| 2008/0096121 | A1 | 4/2008 | Iwatsuki et al. | |
| 2008/0213684 | A1 | 9/2008 | Nagayama et al. | |

(Continued)

FOREIGN PATENT DOCUMENTS

| | | |
|---|---|---|
| JP | 07-072733 | 3/1995 |
| JP | 07-092813 | 4/1995 |

(Continued)

OTHER PUBLICATIONS

English language machine translation of JP 2008-233280 (Oct. 2008).*

(Continued)

*Primary Examiner* — Christopher Rodee
(74) *Attorney, Agent, or Firm* — Oblon, McClelland, Maier & Neustadt, L.L.P.

(57) ABSTRACT

A carrier for developing an electrostatic latent image of the present invention includes a core material and a coating layer which coats the core material, wherein the coating layer includes a resin and fine particles, wherein the coating layer has an average layer thickness difference of 0.02 μm to 3.0 μm, and wherein the carrier for developing an electrostatic latent image has an arithmetic mean surface roughness Ra1 of 0.5 μm to 0.9 μm.

19 Claims, 15 Drawing Sheets

(56) References Cited

U.S. PATENT DOCUMENTS

| | | | | |
|---|---|---|---|---|
| 2009/0291384 | A1* | 11/2009 | Takahashi | 430/110.4 |
| 2010/0233613 | A1 | 9/2010 | Masuda et al. | |
| 2010/0239975 | A1* | 9/2010 | Yamaguchi et al. | 430/111.35 |
| 2011/0065037 | A1 | 3/2011 | Iwatsuki et al. | |
| 2011/0086307 | A1 | 4/2011 | Nakajima et al. | |
| 2011/0171573 | A1 | 7/2011 | Sakata et al. | |
| 2011/0217649 | A1 | 9/2011 | Masuda et al. | |
| 2011/0229817 | A1* | 9/2011 | Yamada et al. | 430/111.35 |
| 2012/0057898 | A1 | 3/2012 | Sakata et al. | |
| 2012/0064451 | A1 | 3/2012 | Kishida et al. | |
| 2013/0016999 | A1 | 1/2013 | Tohmatsu et al. | |
| 2013/0065171 | A1 | 3/2013 | Yaguchi et al. | |
| 2013/0101930 | A1 | 4/2013 | Yamaguchi et al. | |

FOREIGN PATENT DOCUMENTS

| | | | |
|---|---|---|---|
| JP | 07-128983 | | 5/1995 |
| JP | 11-065247 | | 3/1999 |
| JP | 11-231652 | | 8/1999 |
| JP | 2001-188388 | | 7/2001 |
| JP | 3356948 | | 10/2002 |
| JP | 2005-157002 | | 6/2005 |
| JP | 2007-025693 | | 2/2007 |
| JP | 2008-102394 | | 5/2008 |
| JP | 2008233280 | A * | 10/2008 |
| JP | 2012118429 | A * | 6/2012 |

OTHER PUBLICATIONS

English language machine translation of JP 2012-118429 (Jun. 2012).*

U.S. Appl. No. 13/932,368, filed Jul. 1, 2013, Sawada, et al.

U.S. Appl. No. 13/790,347, filed Mar. 8, 2013, Yaguchi, et al.

* cited by examiner

CARRIER FOR DEVELOPING AN ELECTROSTATIC LATENT IMAGE, DEVELOPER AND IMAGE FORMING APPARATUS

BACKGROUND OF THE INVENTION

1. Field of the Invention

The present invention relates to a carrier for developing an electrostatic latent image used for an electrophotographic method and an electrostatic recording method, and a developer and an image forming apparatus which use the carrier for developing an electrostatic latent image.

2. Description of the Related Art

In recent years, technologies of copiers or printers using an electrophotographic system has been rapidly expanding from monochrome to full color, and there is a tendency that a full-color market is expanding. In color image formation by full-color electrophotography, an electrostatic latent image is formed on an electrostatic latent image bearing member; a toner image is formed by developing this electrostatic latent image with charged color toners of three (3) colors of yellow, magenta and cyan or with color toners of the above 3 colors with an addition of black; and then this toner image is transferred and fixed on a recording medium.

In the image formation by such a full-color electrophotographic system, in order to obtain a vivid full-color image having superior color reproducibility, it is necessary to maintain a toner amount on the electrostatic latent image bearing member closely to the electrostatic latent image. This is because fluctuation of the toner amount on the electrostatic latent image bearing member changes an image density or a color tone of an image on a recording medium.

As a cause of fluctuation of the toner amount on the electrostatic latent image bearing member, although there is a factor of fluctuation in a toner charge amount, a so-called hysteresis (ghost phenomenon) is reported that, in a hybrid development system in particular, a difference in the toner amount on a toner bearing member appears as a density difference on an image in subsequent development (see Japanese Patent Application Laid-Open (JP-A) No. 2007-25693).

As a method for resolving the hysteresis in the hybrid development system, it is effective to remove once a residual toner on the toner bearing member after development of the electrostatic latent image on the electrostatic latent image bearing member and to supply a new toner on a surface of the toner bearing member so as to eliminate a difference in the toner amount on the toner bearing member as described above. For example, a method for resolving the hysteresis by scraping a residual toner on the toner bearing member after development and before toner resupply by a scraper or a toner recovery roller (see Japanese Patent (JP-B) No. 3356948, JP-A No. 2005-157002, JP-A No. 11-231652). Also, there is proposed a method for resolving the hysteresis by collecting the residual toner on the toner bearing member by means of a potential difference in a magnetic roller during intervals of copying or between paper and by stabilizing the toner amount on the toner bearing member (see JP-A No. 07-72733). Also, as a countermeasure of the hysteresis using a magnetic brush, there is proposed a method for resolving the hysteresis by widely setting a half-width area of a magnetic flux density of the magnetic roller for collecting the toner on the developing roller and stabilizing the supply (see JP-A No. 07-128983). Further, there is proposed a method for resolving the hysteresis by maintaining the constant toner amount on the toner bearing member without being affected by a history of an immediately preceding image. That is, a non-spherical carrier is used as a carrier for a two-component developer; charge is injected to the carrier at a tip of the magnetic brush; thereby, substantial spacing between the developer bearing member and the toner bearing member is narrowed, and a toner amount supplied at once to the toner bearing member is increased; and the toner is supplied up to a toner saturated amount on the toner bearing member (see JP-A No. 07-92813).

The above-described hysteresis has been considered as a problem specific to the hybrid development system, but it is reported that use of the developer over a long period of time in a two-component developing system causes a hysteresis with decreased developing capacity and decreased image density (see JP-A No. 11-65247).

The hysteresis in the two-component developing system is caused by unsuccessful denuding of the two-component developer. The developer is denuded as follows. That is, an odd number of magnets are disposed in a developing sleeve; a pair of magnets of the same polarity is disposed at a location below an axis of rotation of the developing sleeve to create a peeling region where a magnetic force is almost zero; the developer after development is allowed to fall freely using the gravity in the region.

However, a counter charge is generated in the carrier when the toner is consumed in an immediately preceding image, which causes an image force between the carrier and the developer bearing member, and as a result, the developer is not successfully released in the peeling region. Thus, the developer with a decreased toner concentration due to the toner consumption is conveyed again to a developing region, resulting in degraded developing capacity. That is, the concentration is normal for one round of the sleeve, but the concentration decreases for the second round or after.

As a method for resolving the hysteresis in the two-component developing system, for example, there is proposed a method to dispose a pumping roller including a magnet inside near the peeling region on the developing sleeve and to peel the developer after development by means of the magnetic force (see JP-A No. 11-65247). The peeled developer is lifted by another pumping roller and then conveyed to a developer stirring chamber including a screw, where the toner concentration is readjusted and the toner is charged.

However, since there is an effect of the hysteresis in long-term continuous use despite the above proposals, there are problems that a stable toner amount cannot be supplied to the electrostatic latent image bearing member and that a vivid image having superior color reproducibility cannot be obtained. Also, depending on the above proposals, there is a problem specific to the two-component developing system that a change in carrier resistance due to accumulation of the spent toner is large and that a decrease in charging property of the carrier is large. Further, in order to solve the above problems, it is necessary to maintain various properties of the carrier that it does not cause apparatus contamination due to background smear, toner scattering and so on. Accordingly, it is strongly desired at present that these problems are solved simultaneously.

SUMMARY OF THE INVENTION

The present invention aims at solving the above problems in the conventional technologies and at achieving the following objection. That is, the present invention aims at providing a carrier for developing an electrostatic latent image which develops a stable toner amount over a long period of time without being affected by a hysteresis, provides a vivid image having superior color reproducibility and also satisfies simultaneously various properties such as little decrease in charging property and little change in carrier resistance over a long period of time due to a spent toner and no apparatus contamination caused due to background smear and toner scattering.

The hysteresis as the problem of the present invention has a different occurrence mechanism from the above-described hysteresis.

Although a detail is not clear, the occurrence mechanism of the hysteresis (ghost phenomenon) of the present invention is considered as follows. The toner is adhered on the developer bearing member according to a previous image history, and a toner development amount of the next image varies depending on a potential of the toner adhered on the developer bearing member. That is, it is considered to be caused by the variation of the toner development amount of the next image due to the prior image history.

More specifically, in a non-image area, contrary to an image area, a potential is formed that the toner moves in a direction from the electrostatic latent image bearing member to the developing sleeve, causing the toner to adhere on the developer bearing member (toner adhesion occurs on the developer bearing member). When the image area is being developed in the next development with the toner adhered on the developer bearing member like this, the toner adhered on the developer bearing member is charged, and a development potential is raised by an amount of the potential of the toner on the developer bearing member, resulting in an increase in the toner development amount. Also, the toner adhered on the developer bearing member is consumed during development. The adhered toner amount is not constant; rather, it varies depending on the history of the immediately preceding image. That is, in a case where there is a non-image area or a space between sheets just prior to an image area, raise of a development potential described above occurs in the development of the subsequent image area, and a subsequent image density increases. On the other hand, when the immediately preceding image is an image having a large image area, the toner adhered on the developer bearing member is consumed when the immediately preceding image is developed, and an effect of the above-described raise of the development potential is not large, and the subsequent image density is not high.

As described above, the hysteresis as the problem of the present invention is a phenomenon that the toner adhesion amount on the developer bearing member varies due to an effect of the immediately preceding image, resulting in a density variation in the subsequent image due to an effect of the variation.

As a result of intensive studies to achieve the object, the present inventors have found the following. That is, when an uneven shape of the carrier and an unevenness of a coating layer are within predetermined ranges, the carrier is not likely to roll on the developer bearing member at a non-image area. This stabilizes the toner adhesion amount on the developer bearing member. Further, when the carrier unevenness has a predetermined value, it is possible to create a low resistance portion close to a core material resistance partially in the carrier after coating, and the toner adhered on the developer bearing member is less likely to be consumed at a non-image area during printing. Moreover, they have found that it is possible to obtain a carrier for developing an electrostatic latent image which can supply a stable toner amount over a long period of time without being affected by a hysteresis, can provide image uniformity, can fully satisfy the various properties of the carrier, and can prevent a spent toner over a long period of time, and has superior charge stability and small resistance change.

That is, it was found that, with a configuration of the present invention, a carrier for developing an electrostatic latent image develops a stable toner amount over a long period of time without being affected by a toner consumption history of an immediately preceding image, provides a vivid image having superior color reproducibility and also satisfies simultaneously various properties such as little decrease in charging property and little change in carrier resistance over a long period of time due to a spent toner and no apparatus contamination caused due to background smear and toner scattering.

The present invention is based on the findings of the present inventors, and means for solving the problems are as follows. That is, A carrier for developing an electrostatic latent image of the present invention includes: a core material, and a coating layer which coats the core material, wherein the coating layer includes: a binder resin and fine particles, wherein the coating layer has an average layer thickness difference of 0.02 μm to 3.0 μm, and wherein the carrier for developing an electrostatic latent image has an arithmetic mean surface roughness Ra1 of 0.50 μm to 0.90 μm.

The present invention may solve the conventional problems and achieve the objectives above, and it can provide a carrier for developing an electrostatic latent image which develops a stable toner amount over a long period of time without being affected by a hysteresis, provides a vivid image having superior color reproducibility and also satisfies simultaneously various properties such as little decrease in charging property and little change in carrier resistance over a long period of time due to a spent toner and no apparatus contamination caused due to background smear and toner scattering.

DETAILED DESCRIPTION OF THE INVENTION (Carrier for Developing Electrostatic Latent Image)

A carrier for developing an electrostatic latent image of the present invention includes a core material and a coating layer which coats the core material, and it further includes other components according to necessity.

The present invention aims at increasing toner retention of the carrier by strengthening non-electrostatic bonding by an interaction working between unevenness of the carrier and unevenness of an external additive of a toner.

Specifically, the present invention aims at increasing toner retention of the carrier by increasing contact points between the carrier and the toner due to unevenness of a carrier surface derived from the core material of the carrier and by arranging fine unevenness on a surface of the coating layer due to a carrier filler (fine particles) included in the coating layer so that the carrier contacts an external additive of the toner.

In the present invention, by increasing toner retention of the carrier, when a bias is applied in a non-image area in a direction from an electrostatic latent image bearing member to a developer bearing member (developing sleeve), it is considered that adhesion of the toner to a developer bearing member is suppressed and that ghost phenomenon caused by image history is suppressed.

Figure 1A:
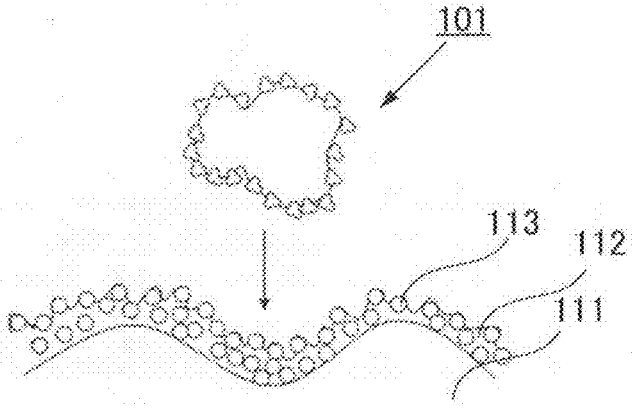
FIG. 1A is a schematic diagram illustrating a state that a toner is close to a carrier surface.
Figure 1B:
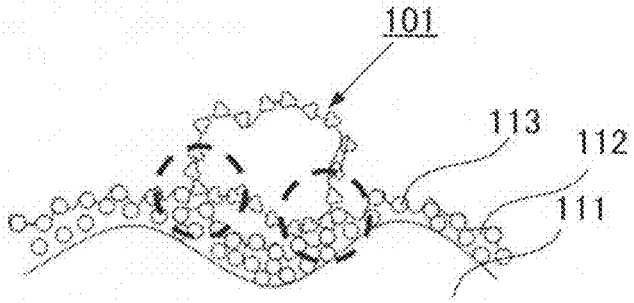
FIG. 1B is a schematic diagram illustrating a state that a toner is held on a carrier surface.

Hereinafter, improvement of the toner retention by the carrier is explained using diagrams. FIG. 1A is a schematic diagram illustrating a state that a toner is close to a carrier surface. FIG. 1B is a schematic diagram illustrating a state that a toner is held on a carrier surface.

Among two (2) dashed circles in FIG. 1B, in an area indicated by the right dashed circle, a toner 101 and a carrier are in contact at a plurality of locations due to unevenness derived from a core material 111 of the carrier. Also, in an area indicated by the left dashed circle, the carrier and an external additive of the toner 101 are in contact due to fine unevenness formed by a resin 112 and fine particles 113 included in a coating layer of the carrier. In this way, the carrier and the toner having many contact points strengthen non-electrostatic bonding due to an interaction working between unevenness of the carrier and unevenness of the toner, resulting in increased toner retention of the carrier.

—Arithmetic Mean Surface Roughness Ra1 of Carrier—

The carrier of the present invention has an arithmetic mean surface roughness Ra1 of 0.50 μm to 0.90 μm, and it is preferably 0.60 μm to 0.85 μm.

Here, the surface roughness Ra1 represents unevenness on a carrier surface, and it contributes to a toner adhesion amount on a developer bearing member.

When the surface roughness Ra1 is less than 0.50 μm, the carrier easily rolls on the developer bearing member. Since the developer does not follow the rotational speed of the developer bearing member, there are cases where the developer slips on the developer bearing member. Thereby, there is a speed difference between the developer bearing member and the developer, and there are cases where a toner adhesion amount at a non-image increases on the developer bearing member. Also, because a resistance portion, i.e. a portion where the resin layer is thin and the core material is almost exposed, is small, the toner adhered on the developer bearing member at a non-image is consumed during printing. As a result, there are cases where a toner amount on the developer bearing member varies greatly.

On the other hand, when the surface roughness Hal exceeds 0.90 μm, unevenness of the carrier itself is too large. As a result, the wear of the carrier concentrates at convex portions, and there are cases where the wear of the coating layer is significant.

Also, in a relationship with the toner, the surface roughness Ra1 exceeding 0.90 μm, the carrier becomes hazardous to the toner due to large unevenness of the carrier itself. This promotes the external additive of the toner embedded in the toner base particles and the external additive of the toner rolling into concave portions of the toner base particles, and as a result, it is likely that functions of the external additive of the toner are lost.

Figure 2:
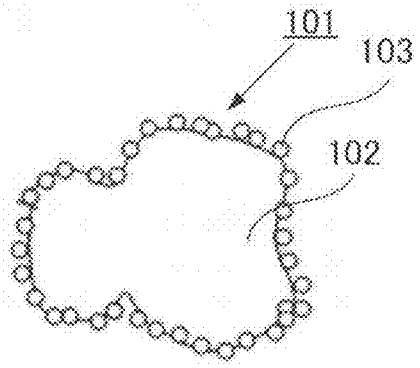
FIG. 2 is a schematic diagram illustrating an ordinary toner.
Figure 3:
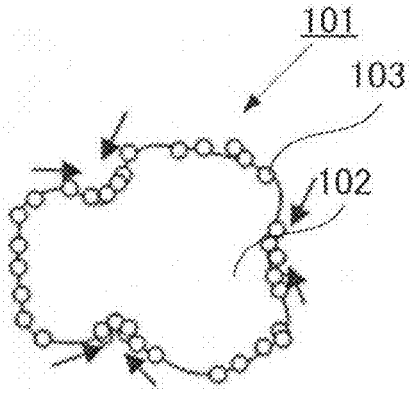
FIG. 3 is a schematic diagram illustrating an external additive of a toner rolling in a concave portion of toner base particles.
Figure 4:
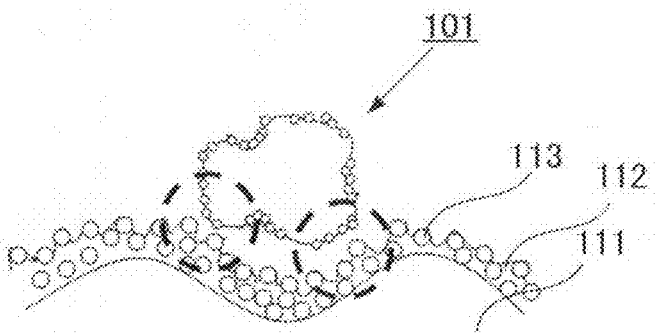
FIG. 4 is a schematic diagram illustrating the toner illustrated in FIG. 3 in contact with a carrier.

Here, FIG. 2 a schematic diagram illustrating an ordinary toner. FIG. 3 is a schematic diagram illustrating an external additive of a toner rolling in a concave portion of toner base particles. FIG. 4 is a schematic diagram illustrating the toner illustrated in FIG. 3 in contact with a carrier.

An ordinary toner 101 illustrated in FIG. 2 has an external additive 103 uniformly distributed on a surface of toner base particles 102. On the other hand, a toner 101 illustrated in FIG. 3 has an external additive 103 rolling in a concave portion of toner base particles 102, and as a result, the external additive 103 is not uniformly distributed on a surface of the toner base particles 102. The toner illustrated in FIG. 3 may be easily obtained by contacting the toner with a carrier having a large unevenness (carrier having a surface roughness Ra1 exceeding 0.9 μm). The toner illustrated in FIG. 3 has a non-uniform distribution of the external additive 103 on the surface of the toner base particles 102, and thus, as illustrated in FIG. 4, a favorable contact state between and external additive of the toner and the carrier is not likely to be obtained in an area indicated by a dashed circle where the carrier and the toner 101 come close. Also, a favorable contact state between the toner and the carrier is not easily obtained when the external additive is embedded in the toner. When a spherical external additive is used, rolling or embedding of the toner occurs more likely, and a favorable contact state cannot be obtained.

A value of the arithmetic mean surface roughness Rat may be obtained by the following measurement method. Using OPTELICS C130, manufactured by LASERTEC, an image is read with a magnification of an objective lens of 50 times and a resolution of 0.20 μm. Then, an observation area of 10 μm×10 μm is defined with an apex of the carrier as a center, and a value obtained by measurement of 100 carrier particles.

<Core Material>

The core material is not particularly restricted as long as it is a magnetic body, and it may be appropriately selected according to purpose. Examples thereof include; ferromagnetic metals such as iron and cobalt; iron oxides such as magnetite, hematite and ferrite; and resin particles that a magnetic body such as various alloys and compounds are dispersed in a resin. Among these, in consideration of environment, Mn ferrite, Mn—Mg ferrite, Mn—Mg—Sr ferrite and Mn—Mg—Ca ferrite are preferable.

—Arithmetic Mean Surface Roughness Ra2 of Core Material—

An arithmetic mean surface roughness Ra2 of the core material defines a surface roughness of the core material.

The arithmetic mean surface roughness Ra2 of the core material is not particularly restricted, and it may be appropriately selected according to purpose. Nonetheless, it is preferably 0.50 μm to 1.50 μm, and more preferably 0.60 μm to 1.30 μm. When the arithmetic mean surface roughness Ra2 is less than 0.50 μm, there are cases where it becomes difficult to obtain a desired value of the Ra1 in producing the carrier. When it exceeds 1.50 μm, there are cases where the value of Ra1 becomes excessively large in producing the carrier. On the other hand, the arithmetic mean surface roughness Ra2 within the more preferable range is advantageous since a toner adhesion amount on a developer bearing member may be controlled more during carrier production.

Here, the value of the arithmetic mean surface roughness Ra2 may be obtained by the same method as the measurement method of the arithmetic mean surface roughness Ra1.

A ratio Ra1/Ra2 of the arithmetic mean surface roughness Ra1 of the carrier and the arithmetic mean surface roughness Ra2 of the core material is not particularly restricted, and it may be appropriately selected according to purpose. Nonetheless, it is preferably 0.60 to 1.00, and more preferably 0.70 to 0.90. When the ratio Ra1/Ra2 is less than 0.60, unevenness of the core material is filled in producing the carrier, and there are cases where a toner adhesion amount on the developer bearing member increases. The ratio Ra1/Ra2 being close to 1.00 indicates that a degree of unevenness of the core material and a degree of unevenness of the carrier are close. In this case, with the unevenness of the carrier derived from the core material, it is difficult for the carrier to retain the toner by contacting the toner and the carrier at a plurality of points, and thus there are cases where the toner adhesion amount on the developer bearing member increases. Also, there are cases where an effect of durability is insufficient when a filler responsible for durability in the coating layer is not sufficiently added or a particle diameter thereof is small even though it is added. On the other hand, the Ra1/Ra2 within the more preferable range is advantageous in view of achieving control of the toner adhesion amount on the developer bearing member and durability.

Figure 5:
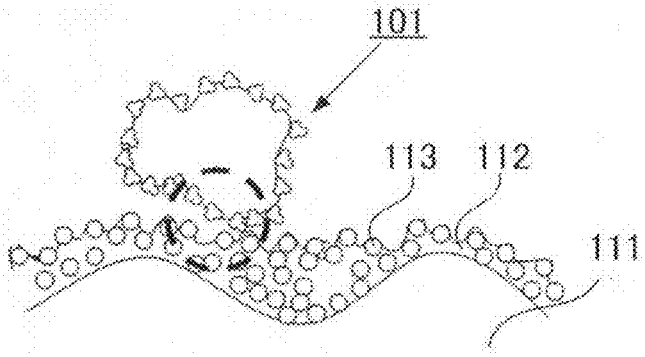
FIG. 5 is a schematic diagram illustrating a contact state of a carrier and an external additive of a toner in case of a small Ra1/Ra2 (less than 0.60).

Here, FIG. 5 is a schematic diagram illustrating a contact state between the carrier and the external additive of the toner with the small Ra1/Ra2 (less than 0.60). As illustrated in FIG. 5, when the Ra1/Ra2 is small (less than 0.60), unevenness of the core material is filled by the coating layer in manufacturing the carrier (in forming the coating layer), and a contact between the carrier and the external additive of the toner decreases. Thus, there are cases where the toner adhesion amount on the developer bearing member increases.

Figure 6:
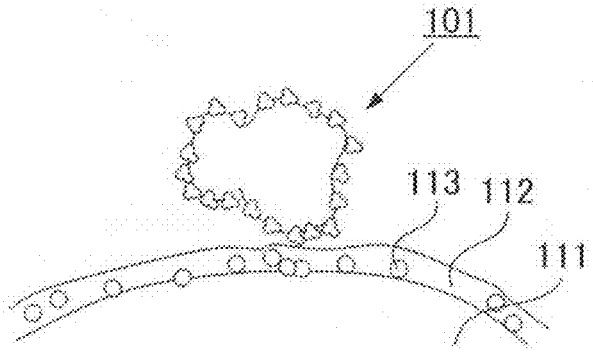
FIG. 6 is a schematic diagram illustrating a contact state of a carrier and an external additive of a toner in case of Ra1/Ra2 close to 1.00 (case with fewer fine particles).
Figure 7:
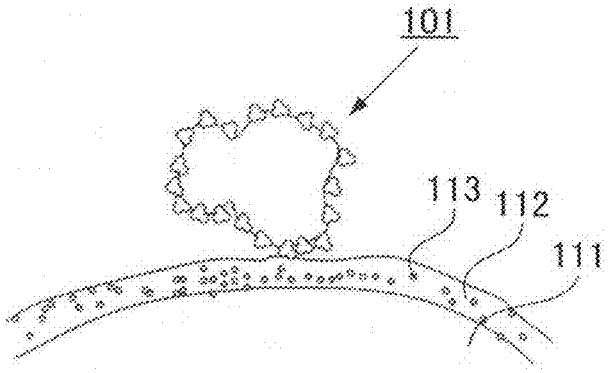
FIG. 7 is a schematic diagram illustrating a contact state of a carrier and an external additive of a toner in case of Ra1/Ra2 close to 1.00 (case with small fine particles).

Also, FIG. 6 and FIG. 7 are schematic diagrams illustrating contact state between a carrier and an external additive of a toner in case of the Ra1/Ra2 close to 1.00. FIG. 6 is a case with a fewer fine particles, and FIG. 7 is a case with smaller fine particles. As illustrated in FIG. 6 and FIG. 7, when the ratio Ra1/Ra2 is close to 1.00, it is difficult for the carrier with the unevenness of the carrier derived from the core material to retain the toner by contacting the toner and the carrier at a plurality of points, there are cases where the toner adhesion amount on the developer bearing member increases.

<Coating Layer>

The coating layer includes a resin and fine particles, and it further includes other components according to necessity.

The coating layer may be formed, for example, by coating a coating layer forming solution including the resin and the fine particles on the core material.

A thickness of the coating layer may be controlled with a content of the resin with respect to the core material. A content of the resin in the carrier with respect to the core material is not particularly restricted, and it may be appropriately selected according to purpose. Nonetheless, it is preferably 0.5% by mass to 3.0% by mass since the thickness of the coating layer can form a local low-resistance state.

An average thickness h of the coating layer is not particularly restricted, and it may be appropriately selected according to purpose. Nonetheless, it is preferably 0.2 μm to 2 μm, and more preferably 0.2 μm to 0.5 μm. When the average thickness is less than 0.2 μm, the core material is easily exposed on a surface of the coating layer in stirring the developer in a developing apparatus, which may result in increased change in the resistance value. When it exceeds 2 μm, the convex portion of the core material is not exposed, and creating a local low-resistance state may be difficult. The average thickness within the preferable range is advantageous since the carrier having a local low-resistance state may be produced.

The thickness of the coating layer may be controlled with a content of the resin with respect to the core material.

The average thickness h of the coating layer may be obtained, for example, by observing a carrier cross-section using a transmission electron microscope (TEM), by measuring a resin portion of the coating layer coating the carrier surface and by taking an average thereof. Specifically, a distance from a surface of the core material to a surface of the coating layer is measured at arbitrary 50 points at the carrier cross-section, and an average of the measured values is obtained.

—Average Layer Thickness Difference—

An average layer-thickness difference the coating layer is 0.02 μm to 3.0 μm, and it is preferably 0.15 μm to 0.40 μm.

Here, the average layer thickness difference of the coating layer represents unevenness caused by the fine particles included in the coating layer, and it contributes to suppression of the toner transferring on the developer bearing member using toner retention by contacting with the external additive of the toner, adjustment of the carrier resistance, abrasion resistance and scraping of a spent toner.

When the average layer thickness difference is less than 0.02 μm, the carrier surface has almost no unevenness by the fine particles, and an adhesive force by a small contact between the carrier and the external additive of the toner is unlikely to occur. Thus, the toner is easily transferred on the developer bearing member, and it may causes a ghost phenomenon. Also, a so-called filler effect is not sufficient, and there are cases where abrasion resistance of the coating layer degrades. Further, since the carrier surface has almost no unevenness, scraping of a spent toner is insufficient, and there are cases where charge stability also becomes a challenge.

When the average layer thickness difference exceeds 3.0 μm, the resin cannot sufficiently bind the fine particles. Thus, there are cases where departure of the fine particles and abrasion of the resin thereby become a challenge. Also, there are cases where a ghost phenomenon degrades because the toner transferring to the developer bearing member due to decreased toner retention of the carrier.

The average layer thickness difference may be obtained, for example, by observing a carrier cross-section using a transmission electron microscope (TEM) and by measuring a resin portion of the coating layer coating the carrier surface. Specifically, a distance from a surface of the core material to a surface of the coating layer is measured at arbitrary 50 points at the carrier cross-section, and the average layer thickness difference is defined as a difference between an average value of the largest five (5) measured values and an average value of the smallest five (5) measured values.

<<Resin>>

The resin is not particularly restricted, and it may be appropriately selected according to purpose. Examples thereof include an acrylic resin, an amino resin, a polyvinyl resin, a polystyrene resin, a halogenated olefin resin, polyester, polycarbonate, polyethylene, polyvinyl fluoride, polyvinylidene fluoride, polytrifluoroethylene, polyhexafluoropropylene, a copolymer of vinylidene fluoride and vinyl fluoride, a fluoroterpolymer such as terpolymer of tetrafluoroethylene, vinylidene fluoride and non-fluorinated monomer, and a silicone resin. These may be used alone or in combination of two or more. Among these, the silicone resin is preferable.

Also, as the resin, a resin including a cured material of a mixture including a silane coupling agent and the silicone resin may also be favorably used.

The silicone resin is not particularly restricted and may be appropriately selected according to purpose. The silicone resin may be commercial products. Examples of the commercial products include SR2410 (manufactured by Dow Corning Toray Co., Ltd.). These may be used alone or in combination of two or more.

The resin is not particularly restricted, and it may be appropriately selected according to purpose. Nonetheless, it is preferably a resin including a crosslinked product obtained by hydrolyzing a copolymer including a portion A represented by General Formula (A) below and a portion B represented by General Formula (B) below and by condensing a generated silanol group.

General Formula (A)

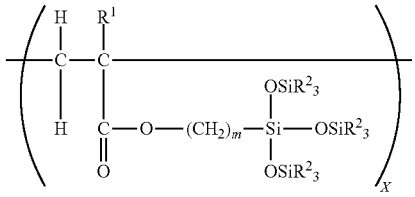

Here, in General Formula (A), $R^1$ represents a hydrogen atom or a methyl group; $R^2$ represents an alkyl group having 1 to 4 carbon atoms; m represents an integer of 1 to 8; X represents a molar ratio in the copolymer, 10% by mole to 90% by mole.

General Formula (B)

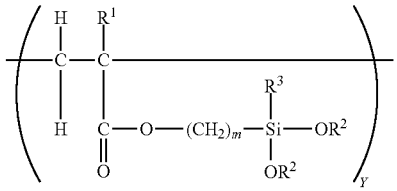

Here, in General Formula (B), $R^1$ represents a hydrogen atom or a methyl group; $R^2$ represents an alkyl group having 1 to 4 carbon atoms; $R^3$ represents an alkyl group having 1 to 8 carbon atoms or an alkoxy group having 1 to 4 carbon atoms; m represents an integer of 1 to 8; Y represents a molar ratio in the copolymer, 10% by mole to 90% by mole.

The silane coupling agent can stably disperse the fine particles.

The silane coupling agent is not particularly restricted, and it may be appropriately selected according to purpose. Examples thereof include γ-(2-aminoethyl)aminopropyltrimethoxysilane, γ-(2-aminoethyl)aminopropylmethyldimethoxysilane, γ-Methacryloxypropyltrimethoxysilane, N-β-(N-vinylbenzylaminoethyl)-γ-aminopropyltrimethoxysilane hydrochloride, γ-glycidoxypropyltrimethoxysilane, γ-mercaptopropyltrimethoxysilane, methyltrimethoxysilane, methyltriethoxysilane, vinyltriacetoxysilane, γ-chloropropyltrimethoxysilane, hexamethyldisilazane, γ-anilinopropyltrimethoxysilane, vinyltrimethoxysilane, octadecyldimethyl[3-(trimethoxysilyl)propyl]ammonium chloride, γ-chloropropylmethyldimethoxysilane, methyltrichlorosilane, dimethyldichlorosilane, trimethylchlorosilane, allyltriethoxysilane, 3-aminopropylmethyldiethoxysilane, 3-aminopropyltrimethoxysilane, dimethyldiethoxysilane, 1,3-divinyltetramethyldisilazane, and methacryloxyalkylethyldimethyl(3-trimethoxysilylpropyl) ammonium chloride. These may be used alone or in combination of two or more.

As the silane coupling agent, those appropriately prepared may be used, or commercial products may be used. Examples of the commercial products include AY43-059, SR6020, SZ6023, SH6020, SH6026, SZ6032, SZ6050, AY43-310M, SZ6030, SH6040, AY43-026, AY43-031, SH6062, Z-6911, SZ6300, SZ6075, SZ6079, SZ6083, SZ6070, SZ6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-

083, AY43-101, AY43-013, AY43-158E, Z-6920 and Z-6940 (all manufactured by Dow Corning Toray Co., Ltd.).

A content of the silane coupling agent is not particularly restricted, and it may be appropriately selected according to purpose. Nonetheless, it is preferably 0.1% by mass to 10% by mass with respect to the resin. When the content is less than 0.1% by mass, adhesiveness between the core material or the fine particles with the resin decreases, and there are cases where the coating layer falls off the during a long-term use. When it exceeds 10% by mass, there are cases where toner filming occurs during a long-term use.

The coating layer may be formed, for example, using a coating layer composition including the silicone resin including a silanol group and/or a hydrolysable functional group, a polymerization catalyst, a resin other than the silicone resin including a silanol group and/or a hydrolysable functional group according to necessity, and a solvent.

Specifically, it may be formed by condensing the silanol group while coating the core material with the coating layer composition, or it may be formed by condensing the silanol group after coating the core material with the coating layer composition.

A method for condensing the silanol group while coating the core material with the coating layer composition is not particularly restricted, and examples thereof include a method of coating the core material with the coating layer composition while applying heat, light and so on.

Also, a method for condensing a silanol group after coating the core material with the coating layer composition is not particularly restricted, and it may be appropriately selected according to purpose. Examples thereof include a method of heating after coating the core material with the coating layer composition.

<<Fine Particles>>

The fine particles are not particularly restricted, and they may be appropriately selected according to purpose. Nonetheless, they preferably include alumina, silica, titanium, barium, tin or carbon, or any combination thereof.

As the fine particles, electrically conductive particles and non-electrically conductive particles may both be used, and it is possible to use the electrically conductive particles and the non-electrically conductive particles in combination.

Here, the electrically conductive particles refer to fine particles having a powder resistivity of 100 Ω·cm or less, and the non-electrically conductive particles refer to fine particles having a powder resistivity exceeding 100 Ω·cm.

The powder resistivity may be measured as follows, for example. First, 5 g of a sample is placed in a cylindrical polyvinyl chloride pipe having an internal diameter of 1 inch, and a top and a bottom thereof are sandwiched by electrodes. A pressure of 10 kg/cm$^2$ is applied to these electrodes by a press machine. Then, at this pressurized state, an LCR meter (4216A, manufactured by Yokogawa-Hewlett-Packard) is connected. A resistance over an overall length L (cm) immediately after connection r (Ω) is measured by a reading caliper, and a powder resistivity (Ω·cm) is calculated. The calculation formula is the following.

$$\text{Powder Resistivity } (\Omega\cdot\text{cm})=[(2.54/2)2\times\pi]/(L-11.35)$$

r: Resistance immediately after connection

L: Overall length in case the sample is filled 11.35: Overall length in case the sample is not filled The electrically conductive particles are not particularly restricted, and they may be appropriately selected according to purpose. Examples thereof include: electrically conductive particles formed with a base such as aluminum oxide, titanium dioxide, zinc oxide, silicon dioxide, barium sulfate and zirconium oxide and a layer such as tin dioxide and indium oxide; and electrically conductive particles formed using carbon black. Among these, electrically conductive particles formed with a base of aluminum oxide, titanium dioxide or barium sulfate and a layer of tin dioxide or indium oxide are preferable.

The non-electrically conductive particles are not particularly restricted, and they may be appropriately selected according to purpose. Examples thereof include aluminum oxide, titanium dioxide, zinc oxide, silicon dioxide, barium sulfate and zirconium oxide.

A powder resistivity of the fine particles is not particularly restricted, and it may be appropriately selected according to purpose. Nonetheless, it is preferably −3 Log(Ω·cm) to 3 Log(Ω·cm). When the powder resistivity is less than −3 Log (Ω·cm), the resistance of the fine particles is too low. Thus, there are cases where they are not sufficiently charged when they are subjected to frictional charge with the toner. When it exceeds 3 Log(Ω·cm), carrier resistance adjustment capability is insufficient, and thus there are cases where edge effect and image resolution degrade.

A volume-average particle diameter D of the fine particles is preferably 50 nm to 500 nm, and more preferably 100 nm to 400 nm. With the particle diameter within the above range present, the fine particles easily protrude from a surface of the resin coating layer. Thus, a local low-resistance area is easily created. Further, a spent matter on the carrier surface may be easily scraped, and it provides superior abrasion resistance.

The volume-average particle diameter D of the fine particles may be measured, for example, using an ultracentrifugal automatic particle size distribution measurement apparatus CAPA-700 (manufactured by Horiba Ltd.). Specifically, the measurement is carried out as follows.

In a juicer mixer, 300 mL of a toluene solution containing 30 mL of aminosilane (SH6020, manufactured by Dow Corning Toray Co., Ltd.) is placed. To this, 6.0 g of a sample is added, and then it is dispersed for 3 minutes with a rotational speed of the mixer set to low. In 500 mL of a toluene solution prepared in advance in a 1,000-mL beaker, an appropriate amount of a dispersion is added and diluted. An obtained diluted solution is continuously stirred by a homogenizer. A volume-average particle diameter is measured using an ultracentrifugal automatic particle size distribution measurement apparatus CAPA-700 (manufactured by Horiba Ltd.).

—Measurement Conditions—

Rotational speed: 2,000 rpm

Maximum particle size: 2.0 μm

Minimum particle size: 0.1 μm

Particle-size interval: 0.1 μm

Dispersion medium viscosity: 0.59 mPa·s

Dispersion medium density: 0.87 g/cm$^3$

Particle density: Specific gravity value measured using a dry automatic densitometer ACUPIC 1330 (manufactured by Shimadzu Corporation)

A content of the fine particles in the coating layer is not particularly restricted, and it may be appropriately selected according to purpose. Nonetheless, it is preferably 50 parts by mass to 500 parts by mass, and more preferably 100 parts by mass to 300 parts by mass with respect to 100 parts by mass of the resin.

When the content is less than 50 parts by mass, the effect of preventing chipping or peeling of the coating layer may degrade. When it exceeds 500 parts by mass, a fraction of the resin protruding on the carrier surface becomes relatively small, and there are cases where the toner is likely to be spent on the carrier surface. On the other hand, with the content in the preferable range, it is possible to suppress chipping or peeling of the coating layer when the carrier is used in a developing apparatus over a long period of time.

A ratio (D/h) of the volume-average particle diameter D (μam) of the fine particles to the average thickness h (μm) of the coating layer is not particularly restricted, and it may be appropriately selected according to purpose. Nonetheless, it is preferably 0.01 to 1.00, and more preferably 0.10 to 1.00.

When the ratio D/h is less than 0.01, there is observed almost no unevenness due to the fine particles, and the surface of the coating layer is smooth. This causes reduction of chargeability due to fixation of the toner, which may decrease image quality. When it exceeds 1.00, convex portions due to the fine particles in the coating layer are scraped after running at a low-image area. This may cause decrease in resistance and decrease in image quality. On the other hand, the ratio D/h in the more preferable range is advantageous since durability is favorable and carrier adhesion can be suppressed.

A content of the fine particles in the coating layer is not particularly restricted, and it may be appropriately selected according to purpose. Nonetheless, it is preferably 10% by mass to 90% by mass, more preferably 40% by mass to 85% by mass, and particularly preferably 50% by mass to 80% by mass.

When the content is less than 10% by mass, a fraction of the fine particles on the carrier surface is small, and there are cases where an effect of relieving the contact involving a strong impact on the resin is reduced. When it exceeds 90% by mass, a fraction of the resin on the carrier surface is small, and there are cases where chargeability decreases or retention capability of the fine particles by the resin is insufficient.

Here, the content of the fine particles is expressed by the following formula.

Content of fine particles (% by mass)=[fine particles/(total amount of solid content of fine particles+resin)]

<Method for Producing Carrier for Developing Electrostatic Latent Image>

A method for producing the carrier for developing an electrostatic latent image is not particularly restricted, and it may be appropriately selected according to purpose. Nonetheless, a production method by applying a coating layer forming solution including the resin and the fine particles on a surface of the core material using a fluidized-bed coating apparatus is preferable. Here, when the coating layer forming solution is applied, condensation of the resin included in the coating layer may be promoted, or condensation of the resin included in the coating layer may be promoted after the coating layer forming solution is applied. A condensation method of the resin is not particularly restricted, and it may be appropriately selected according to purpose. Examples thereof include a method of condensing the resin by imparting heat, light and so on the coating layer forming solution.

<Volume Resistivity of Carrier for Developing an Electrostatic Latent Image>

A volume resistivity of the carrier is preferably $1\times10^{9}$ Ω·cm to $1\times10^{17}$ Ω·cm, and more preferably $1\times10^{9}$ Ω·cm to $1\times10^{12}$ Ω·cm. When the volume resistivity is less than $1\times10^{9}$ Ω·cm, a toner amount which adheres on the developer bearing member at a non-image (e.g. toner amount which adheres on a developing sleeve due to a bias in a direction to the developing sleeve) increases, and there are cases where image uniformity cannot be obtained. When the volume resistivity exceeds $1\times10^{17}$ Ω·cm, the toner adhered on the developer bearing member is consumed during printing, and there are cases where image uniformity cannot be obtained. Here, in a case where a measured value is below a measurable limit of a high resistance meter, a volume resistivity cannot be obtained in practice, and it is dealt as a break down.

The volume resistivity may be measured by the following method.

First, a carrier is filled in a cell composed of electrodes having a surface area of 2 cm×4 cm and a fluorine resin container containing the electrodes having a distance between the electrodes of 2 mm. Using a tapping machine PTM-1 (manufactured by Sankyo Pio-Tech Co., Ltd.), a tapping operation is carried out at a tapping speed of 30 times/min for 1 minute. Next, a DC voltage of 1,000 V is applied between the electrodes, and a DC resistance is measured using a high resistance meter (4329A+LJK5HVLVWDQFH OHWHU, manufactured by Yokogawa-Hewlett-Packard). Thereby, an electrical resistivity R Ω·cm is obtained, and Log R is calculated.

<Weight-Average Particle Diameter Dw of Carrier for Developing Electrostatic Latent Image>

A weight-average particle diameter Dw of the carrier for developing an electrostatic latent image refers to a particle diameter at 50% cumulative value in a particle size distribution of the core material obtained by laser diffraction-scattering method.

The weight-average particle diameter Dw of the carrier is not particularly restricted, and it may be appropriately selected according to purpose. Nonetheless, it is preferably 20 μm to 65 μm. When the weight-average particle diameter is within the range, an improvement effect on carrier adhesion, image quality and so on is remarkable. When the weight-average particle diameter is less than 20 μm, uniformity of the particles decreases. Solid carrier adhesion is likely to occur with the fine particles of less than 20 μm due to centrifugal force during development or injection of a developing bias. There are cases where problems such as carrier adhesion occur since a technology to use them thoroughly on the machine side is not established. On the other hand, when it exceeds 65 μm, there are cases where a fine image cannot be obtained due to poor reproducibility of image details.

The weight-average particle diameter Dw is calculated based on a particle diameter distribution of particles measured in number basis (relationship between number-based frequency and particle diameter).

The weight-average particle diameter Dw in this case is represented by Formula (1) below.

$$Dw=[1/\Sigma(nD^2)]\times[\Sigma(nD^4)] \quad (1)$$

(In Formula (1), D represents a representative particle diameter (μm) existing in each channel; n represents a total number of particles existing in each channel.)

Here, the channel refers to a length for dividing a particle-diameter range in a particle diameter distribution diagram into measurement width units, and in the present invention, an equal length of 2 (particle diameter distribution width) is adopted.

Also, as a representative particle diameter of the particles present in each channel, a lower-limit value of a particle diameter stored in each channel is adopted.

Also, a number-average particle diameter Dp in the present invention is calculated based on a particle diameter distribution of particles measured in number basis.

The number-average particle diameter Dp in this case is represented by Formula (2) below.

$$Dp=(1/N)\times(\Sigma nD) \quad (2)$$

Here, in Formula (2), N represents a total number of measured particles; n represents a total number of particles existing in each channel; D represents a lower limit of a particle diameter of particles present in each channel (2 μm).

In the present invention, MICROTRAC particle size analyzer (Model HRA9320-X100, manufactured by Honewell) is used as a particle size analyzer for measuring a particle diameter distribution. Measurement conditions thereof are as follows.

—Measurement Conditions—

[1] Particle diameter range: 100 nm to 8 μm

[2] Channel length (channel width): 2 μm

[3] Number of channels: 46

[4] Refractive index: 2.42

<Magnetization of Carrier for Developing Electrostatic Latent Image>

A magnetization (magnetic moment) of the carrier for developing an electrostatic latent image is not particularly restricted, and it may be appropriately selected according to purpose. Nonetheless, it is preferably 40 $Am^2/kg$ to 90 $Am^2/kg$ in a magnetic field of 1 kOe.

Figure 8:
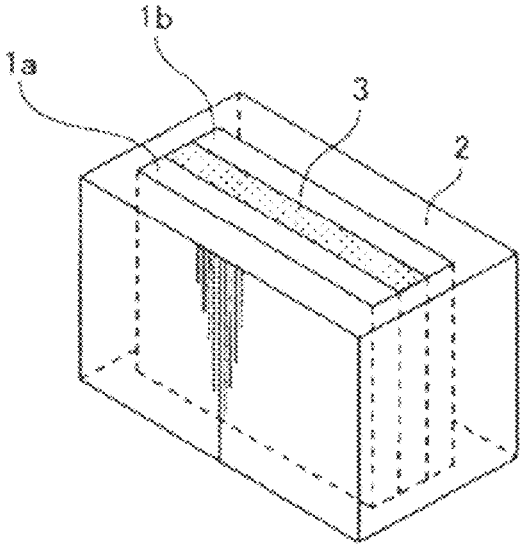
FIG. 8 is a perspective diagram illustrating one example of a resistance measurement cell used for measuring an electrical resistivity of a carrier for developing an electrostatic latent image of the present invention.

Here, for measuring the magnetization, for example, a high-sensitivity vibration-sample magnetometer (VSM-P7-15, manufactured by Toei Industry Co., Ltd.) may be used. As a specific measurement method, about 0.15 g of the carrier is weighed, which is filled in a cell having an internal diameter of 2.4 mm and a height of 8.5 mm (see FIG. 8), and a measurement is carried out in a magnetic field of 1,000 Oersted (Oe). The cell illustrated in FIG. 8 is a cell composed of an electrode 1*a* and an electrode 1*b*, each having a surface area of 2.5 cm×4 cm; and a fluorine resin container 2 containing the electrodes with a distance between the electrodes of 0.2 cm, and it is filled with a carrier 3.

(Developer)

A developer of the present invention includes: the carrier for developing an electrostatic latent image of the present invention; and a toner.

<Toner>

The toner includes toner base particles and an external additive, and it further includes other components according to necessity.

The external additive preferably includes a non-spherical external additive.

The toner including the non-spherical external additive realizes high fluidity and suppresses embedding or rolling of the external additive in case a load is applied to the toner by being stirred in the developing apparatus, for example, and thereby, it is superior in maintaining toner retention of the carrier over time.

Figure 9A:
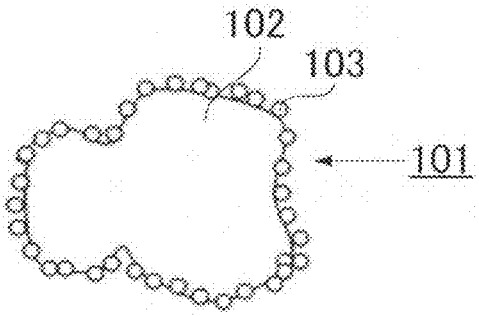
FIG. 9A is a schematic diagram of a toner including a spherical external additive.
Figure 10A:
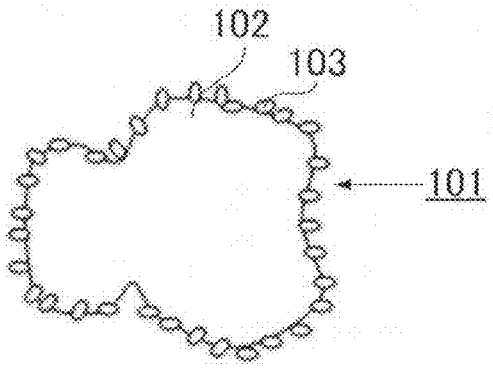
FIG. 10A is a schematic diagram of a toner including a non-spherical (spindle-shaped) external additive.

Here, one example of the rolling motion of the external additive is explained using diagrams. FIG. 9A, FIG. 10A and FIG. 11A are schematic diagrams of toners including an external additive. An external additive 103 of a toner 101 illustrated in FIG. 9A has a spherical shape. An external additive 103 of a toner 101 illustrated in FIG. 10 has a non-spherical shape (spindle-shaped). An external additive 103 of a toner 101 illustrated in FIG. 11A is non-spherical coalescent particles.

Figure 9B:
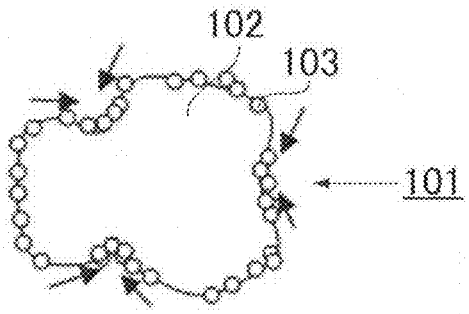
FIG. 9B is a schematic diagram of a toner including a spherical external additive, illustrating a rolling state of the external additive.

The toner 101 illustrated in FIG. 9A has the external additive 103 of a spherical shape. Thus, when a load is applied to the toner 101, the external additive 103 rolls in a direction of an arrow on a surface of toner base particles 102 and gathers at concave portions of the toner base particles 102. As a result, the external additive 103 becomes non-uniform (see FIG. 9B).

Figure 10B:
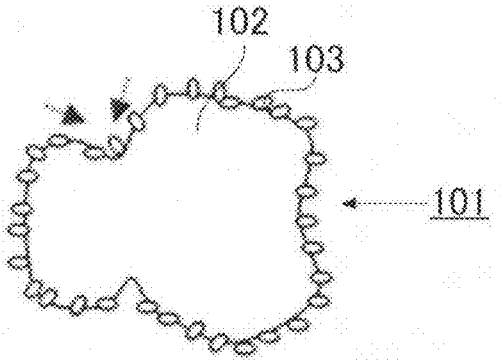
FIG. 10B is a schematic diagram of a toner including a non-spherical (spindle-shaped) external additive, illustrating a state of the external additive not easily rolling.
Figure 11A:
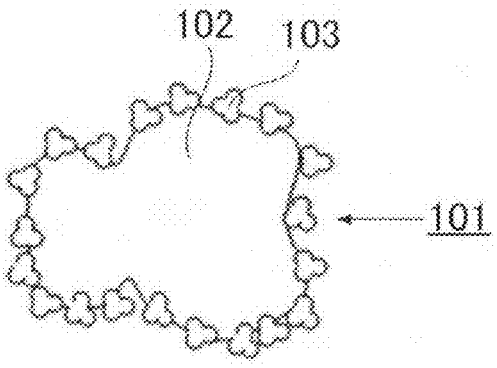
FIG. 11A is a schematic diagram of a toner including a non-spherical external additive (coalescent particles).
Figure 11B:
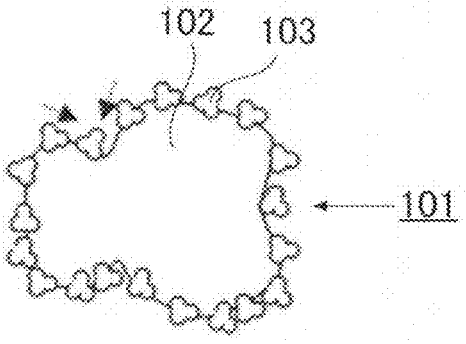
FIG. 11B is a schematic diagram of a toner including a non-spherical external additive (coalescent particles), illustrating a state of the external additive not easily rolling.

The toners 101 illustrated in FIG. 10A and FIG. 11A have the external additives 103 of a non-spherical shape, and it is unlikely that the external additive 103 rolls even when a load is applied to the toners 101 (see FIG. 10B and FIG. 11B).

Figure 12:
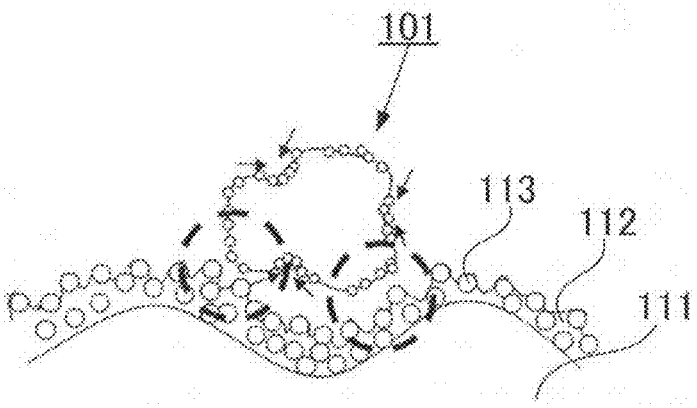
FIG. 12 is a schematic diagram illustrating a state in which a contact between a toner and a carrier is decreased due to a rolling motion of an external additive.

When embedding or rolling of the external additive occurs, as illustrated in FIG. 12, the external additive cannot contact sufficiently with fine unevenness of the coating layer of the carrier (the coating layer including a resin 112 and fine particles 113) (see a portion of a dashed circle in FIG. 12).

Figure 13:
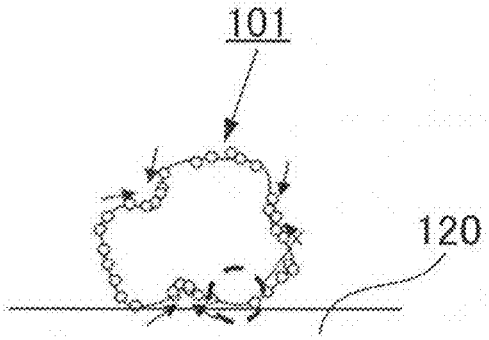
FIG. 13 is a schematic diagram illustrating a state in which a distance between toner base particles and a developer bearing member is shortened.

Also, occurrence of embedding or rolling of the external additive shortens a distance between the toner base particles and the developer bearing member (see FIG. 13), and there are cases of increased adhesion between the toner and the developer bearing member.

Figure 14:
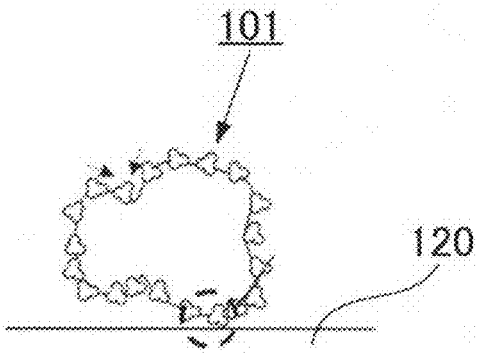
FIG. 14 is a schematic diagram illustrating a state in which a distance between toner base particles and a developer bearing member is maintained.

On the other hand, when embedding or rolling of the external additive is suppressed, the distance between the toner base particles and the developer bearing member may be maintained (see FIG. 14), it is possible to maintain a low non-electrostatic adhesion between the toner and the developer bearing member.

That is, by suppressing embedding or rolling of the external additive in the toner to maintain a large retention (adhesion) between the toner and the carrier and a low adhesion with the developer bearing member, it is possible to suppress adhesion of the toner on the developer bearing member and suppress ghost phenomenon caused by image history in a non-image area when a bias is applied in a direction from the electrostatic latent image bearing member (hereinafter, it may also be referred to as a "photoconductor") to the developer bearing member (e.g. developing sleeve).

Further, the above effect becomes remarkable, provided that the non-spherical external additive is coalescent particles and that the coalescent particles have a degree of coalescence G of 1.5 to 4.0.

Usually, when a toner having a small particle diameter is used in an electrophotographic image forming apparatus, transfer efficiency decreases because a non-electrostatic adhesion between the toner and an electrophotographic photoconductor or between the toner and an intermediate transfer member increases. Especially, when the toner having a small particle diameter is used in a high-speed apparatus, the non-electrostatic adhesion with the intermediate transfer member increases due to reduced particle diameter of the toner, and in addition, duration of the toner receiving a transfer electric field at a nip portion for transfer, especially a nip portion for secondary transfer is shortened due to the increased speed. Thus, it has been known that the transfer efficiency decreases significantly at the secondary transfer.

However, by using the toner including the non-spherical external additive, the non-electrostatic adhesion of the toner decreases, and sufficient transfer efficiency may be obtained without inhibiting fixability even for the high-speed machine with a short transfer time. Further, the external additive does not roll into concave portions, and functions of the external additive are maintained even in the high-speed apparatus with large mechanical stresses over time. Thus, it is possible to maintain sufficient transfer efficiency for a long period of time.

<<External Additive>>

The external additive is not particularly restricted, and it may be appropriately selected according to purpose. Nonetheless, it is preferable to include a non-spherical external additive.

The non-spherical external additive is not particularly restricted, and it may be appropriately selected according to purpose. Examples thereof include a spindle-shaped external additive and coalescent particles.

—Coalescent Particles—

The coalescent particles are non-spherical particles (secondary particles) obtained by coalescence among primary particles.

Here, the external additive preferably includes at least the coalescent particles (secondary particles), and other than the coalescent particles (secondary particles), other external additives or primary particles of the coalescent particles may also be included.

—Primary Particles—

The primary particles are not particularly restricted, and they may be appropriately selected according to purpose. Examples thereof include: inorganic particles such as silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide and silicon nitride; and organic fine particles. These may be used alone or in combination of two or more. Among these, silica is preferable since it can prevent the external additive from embedding into and departing from the toner base particles.

An average particle diameter (Da) of the primary particles is not particularly restricted, and it may be appropriately selected according to purpose. Nonetheless, it is preferably 20 nm to 150 nm, and more preferably 35 nm to 150 nm. When the average particle diameter (Da) is less than 20 nm, it is not possible to fulfill a function of spacer effect, and there are cases where embedding of the external additive into the toner base particles due to external stresses cannot be suppressed. When it exceeds 150 nm, departure from the toner is likely to occur, and photoconductor filming may be easily caused.

Figure 15:
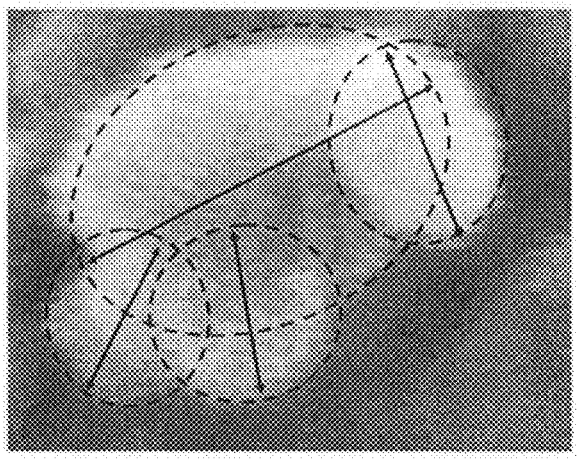
FIG. 15 is a photograph illustrating one example of an external additive in a toner of a developer of the present invention.

The average particle diameter (Da) of the primary particles is measured based on particle diameters of the primary particles in the coalescent particles (length of all the arrows illustrated in FIG. 15). The measurement is carried out as follows. That is, after the coalescent particles are dispersed in an appropriate solvent (tetrahydrofuran (THF) and so on), the sample dried and solidified by removing the solvent on a substrate is subjected to an observation under a field-emission scanning electron microscope (FE-SEM, acceleration voltage: 5 kV to 8 kV, observation magnification: 8,000 times to 10,000 times), and the particle diameters of the primary particles in a field of view are measured. The particle diameters of the primary particles are measured by calculating an average value of the maximum length (length of all the arrows illustrated in FIG. 15) of each particle in agglomeration (number of particles measured: 100 to 200).

—Secondary Particles—

The secondary particles refer to, as described above, coalescent particles.

The secondary particles are not particularly restricted as long as they are, for example, particles that the primary particles are chemically bonded by a treatment agent described later for secondary agglomeration, and it may be appropriately selected according to purpose. Nonetheless, sol-gel silica is preferable.

An average particle diameter (Db) of the secondary particles is not particularly restricted, and it may be appropriately selected according to purpose. Nonetheless, it is preferably 80 nm to 200 nm, more preferably 100 nm to 180 nm, and particularly preferably 100 nm to 160 nm. When the average particle diameter (Db) is less than 80 nm, it is difficult to fulfill a function of spacer effect, and there are cases where it is difficult to suppress embedding due to external stresses. When it exceeds 200 nm, departure from the toner is likely to occur, and photoconductor filming may be easily caused.

The average particle diameter (Db) of the secondary particles is measured as follows. That is, after the secondary particles are dispersed in an appropriate solvent (tetrahydrofuran (THF) and so on), the sample dried and solidified by removing the solvent on a substrate is subjected to an observation under a field-emission scanning electron microscope (FE-SEM, acceleration voltage: 5 kV to 8 kV, observation magnification: 8,000 times to 10,000 times), and the particle diameters of the coalescent particles in a field of view are measured. The particles diameters of the secondary particles are measured by measuring the maximum lengths of the agglomerated particles (length of the arrow in FIG. 16) (number of particles measured: 100 to 200).

—Degree of Coalescence of Coalescent Particles—

The degree of coalescence (G) of the coalescent particles is expressed as a ratio of an average particle diameter of the coalescent particles (secondary particles) to an average particle diameter of primary particles included in the coalescent particles (average particle diameter of secondary particles/average particle diameter of primary particles), and the average particle diameters are calculated by the measurement according to the above-described method.

The degree of coalescence (G) of the coalescent particles (average particle diameter of secondary particles/average particle diameter of primary particles) is not particularly restricted, and it may be appropriately selected according to purpose. Nonetheless, it is preferably 1.5 to 4.0, more preferably 3.0 to 4.0, and particularly preferably 3.4 to 3.9. When the degree of coalescence (G) is less than 1.5, the external additive rolls and is embedded in the concave portions on a surface of the toner base particles, resulting in poor transfer property. When it exceeds 4.0, the external additive is easily peeled off from the toner, causing carrier contamination or scratches on the photoconductor. Thus, it is slightly weak to degradation over time.

—Shape of Coalescent Particles—

Figure 16:
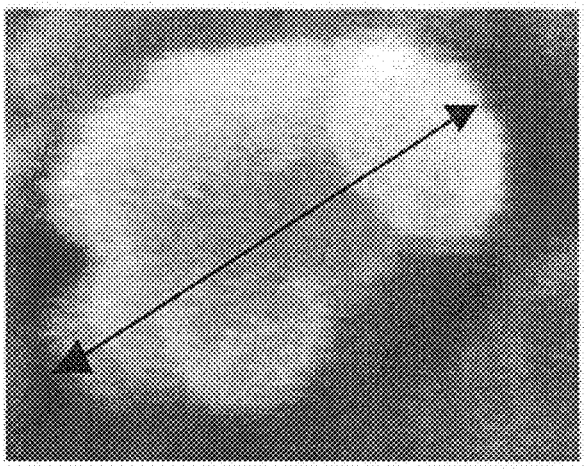
FIG. 16 is a photograph illustrating one example of an external additive in a toner of a developer of the present invention.

A shape of the coalescent particles is not particularly restricted as long as they coalesce and have a non-spherical shape, and it may be appropriately selected according to purpose. Examples thereof include, as illustrated in FIG. 15 to FIG. 16, a non-spherical shape that two or more of the particles undergo coalescence. Use of the coalescent particles realizes high fluidity of the toner, and suppresses embedding or rolling of the external additive even when a load is applied to the toner by being stirred in the developing device, and thereby, it is possible to maintain a high transfer rate over time. Also, since agglomeration force (coalescence force) among the coalescent particles is maintained under certain stirring conditions, the toner has high durability.

A method for confirming coalescence of particles in the coalescent particles is not particularly restricted, and it may be appropriately selected according to purpose. Nonetheless, a method of observing and confirming under a field-emission scanning electron microscope (FE-SEM) is preferable.

—Method for Manufacturing Coalescent Particles—

A method for manufacturing the coalescent particles is not particularly restricted, and it may be appropriately selected according to purpose. Nonetheless, examples thereof include a sol-gel method and a dry method.

—Sol-Gel Method—

The sol-gel method is not particularly restricted, and it may be appropriately selected according to purpose. Nonetheless, in a preferable production method, the primary particles and a treatment agent explained later are allowed to chemically bond by mixing or firing them for secondary agglomeration to form the secondary particles (coalescent particles). Here, in synthesizing by the sol-gel method, the coalescent particles may be prepared in a one-step reaction with the presence of the treatment agent.

—Treatment Agent—

The treatment agent is not particularly restricted, and it may be appropriately selected according to purpose. Examples thereof include a silane-based agent and an epoxy-based treatment agent. These may be used alone or in combination of two or more. The silane-based agent is preferable when silica is used as the primary particles since an Si—O—Si bond that the silane-based agent forms is thermally more stable than an Si—O—C bond that the epoxy-based treatment agent forms. Also, a processing aid may be used (water, 1-% by mass aqueous solution of acetic acid and so on) according to necessity.

—Silane-Based Agent—

The silane-based agent is not particularly restricted, and it may be appropriately selected according to purpose. Examples thereof include an alkoxysilane compound, a silane coupling agent, a chlorosilane compound, a silazane compound, N,N'-bis(trimethylsilyl)urea, N,O-bis(trimethylsilyl)acetamide and dimethyl trimethylsilyl amine.

Examples of the alkoxysilane compound include tetramethoxysilane, tetraethoxysilane, methyltrimethoxysilane, methyltriethoxysilane, dimethyldimethoxysilane, dimethykliethoxysilane, methyldimethoxysilane, methyldiethoxysilane, diphenyklimethoxysilane, isobutyltrimethoxysilane and decyltrimethoxysilane.

Examples of the silane coupling agent include γ-aminopropyltriethoxysilane, γ-glycidoxypropyltrimethoxysilane, γ-glycidoxypropylmethyldiethoxysilane, γ-methacryloxypropyltrimethoxysilane, γ-mercaptopropyltrimethoxysilane, vinyltriethoxysilane and methylvinyldimethoxysilane.

Examples of the chlorosilane compound include vinyltrichlorosilane, dimethyldichlorosilane, methylvinyldichlorosilane, methyl phenyl dichlorosilane and phenyltrichlorosilane.

Examples of the silazane compound include a mixture of hexamethyldisilazane and cyclic silazane.

The silane-based agent forms secondary agglomeration by chemically bonding the primary particles (e.g. silica primary particles) as described below.

When the silica primary particles are processed using the alkoxysilane compound, the silane coupling agent and so on as the silane-based agent, a silanol group bonding to the silica primary particles reacts with an alkoxy group bonding to the silane-based agent as indicated by Formula (A) below. A new Si—O—Si bond is formed by dealcoholization, and secondary agglomeration occurs.

When the silica primary particles are processed using the chlorosilane compound as the silane-based agent, a chloro group of the chlorosilane compound reacts with a silanol group bonding to the silica primary particles forms a new Si—O—Si bond by dehydrochlorination reaction, and secondary agglomeration occurs. Also, in the case where the silica primary particles are processed using the chlorosilane compound as the silane-based agent, when water coexists in the system, the chlorosilane compound is first hydrolyzed in water to generate a silanol group, then a new Si—O—Si bond is formed by dehydration reaction of the silanol group and a silanol group bonding to the silica primary particles, and secondary agglomeration occurs.

When the silica primary particles are processed using the silazane compound as the silane-based agent, a new Si—O—Si bond is formed by deammoniation of an amino group and a silanol group bonding to the silica primary particles, and secondary agglomeration occurs.

—Si—OH+RO—Si—→—Si—O—Si—+ROH Formula (A)

Here, in the Formula (A), R represents an alkyl group.

—Epoxy-Based Treatment Agent—

The epoxy-based treatment agent is not particularly restricted, and it may be appropriately selected according to purpose. Examples thereof include a bisphenol A epoxy resin, a bisphenol F epoxy resin, a phenol novolak epoxy resin, a cresol novolak epoxy resin, a bisphenol A novolak epoxy resin, a biphenol epoxy resin, a glycidyl amine epoxy resin and an alicyclic epoxy resin.

The epoxy-based treatment agent forms secondary agglomeration by chemically bonding the silica primary particles as illustrated in Formula (B) below. When the silica primary particles are processed using the epoxy-based treatment agent, a new Si—O—C bond is formed by addition of an epoxy oxygen atom and a carbon atom bonded to the epoxy group of the epoxy-based treatment agent to a silanol group bonding to the silica primary particles, and secondary agglomeration occurs.

Formula (B)

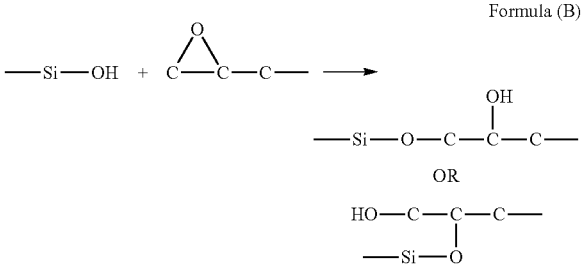

A mixing mass ratio of the treatment agent and the primary particles (primary particles treatment agent) is not particularly restricted, and it may be appropriately selected according to purpose. Nonetheless, it is preferably 100:0.01 to 100:50. Here, as the amount of the treatment agent increases, the degree of coalescence tends to increase.

A method for mixing the treatment agent and the primary particles is not particularly restricted, and it may be appropriately selected according to purpose. Examples thereof include a method of mixing in heretofore known mixers (spray dryer and so on). Here, in the mixing, the treatment agent is mixed and prepared after the primary particles are prepared. Alternatively, the treatment agent may co-exist in preparation of the primary particles for a one-step reaction.

A firing temperature of the treatment agent and the primary particles is not particularly restricted, and it may be appropriately selected according to purpose. Nonetheless, it is preferably 100° C. to 2,500° C. Here, as the firing temperature increases, the degree of coalescence tends to increase.

A firing time of the treatment agent and the primary particles is not particularly restricted, and it may be appropriately selected according to purpose. Nonetheless, it is preferably 0.5 hours to 30 hours.

—Dry Method—

The dry method is not particularly restricted, and it may be appropriately selected according to purpose. For example, it may be carried out using an apparatus illustrated in FIG. 17.

Figure 17:
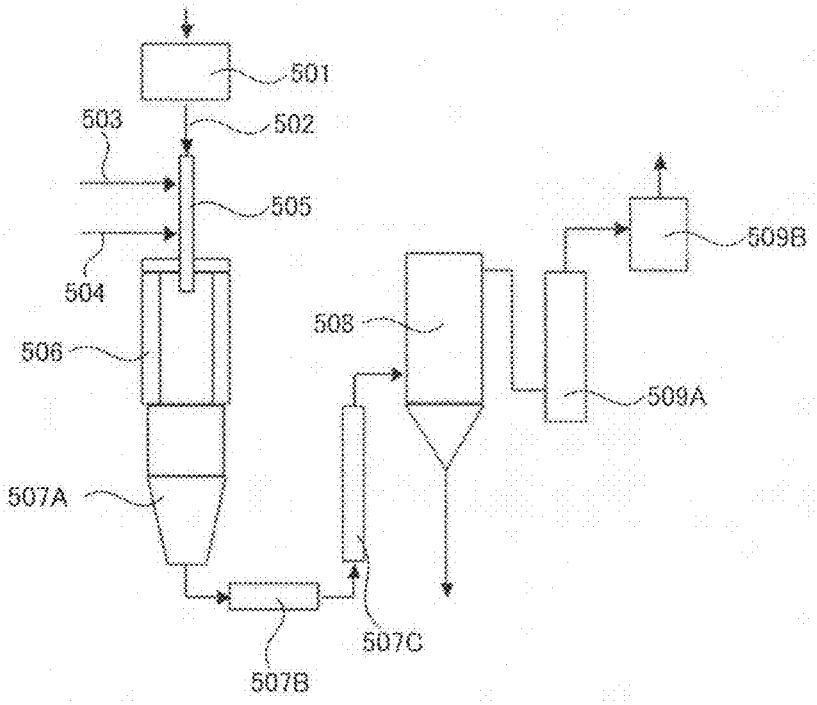
FIG. 17 is a schematic diagram illustrating one example of an apparatus for manufacturing coalescent particles by dry method.

An apparatus illustrated in FIG. 17 include: an evaporator 501 for vaporizing and supplying a silicon compound as a raw material; a supply tube 502 for supplying a silicon compound gas as a raw material; a supply tube 503 for supplying a flammable gas; a supply tube 504 for supplying a combustion-supporting gas; a burner 505 connected to these supply tubes 502, 503, 504; a reactor 506 (a flame hydrolysis reaction takes place); cooling tubes 507A, 507B, 507C connected at a downstream side of the reactor 506; a recovery apparatus 508 for collecting produced silica powder; an exhaust-gas treatment equipment 509A arranged at a downstream side of the recovery apparatus 508; and an exhauster 509B.

For example, the supply tube 504 is opened to supply an oxygen gas to the burner. Then, an ignition burner is ignited, and a hydrogen gas is supplied to the burner by opening the supply tube 503 to thereby form a flame. To this, silicon tetrachloride gasified in the evaporator 501 is supplied for flame hydrolysis reaction, and generated silica powder is collected by a bag filter in the recovery apparatus 508. An exhaust gas after collection of the powder was treated in the exhaust-gas treatment equipment 509A and exhausted through the exhauster 509B.

A content of the non-spherical external additive in the external additive is not particularly restricted, and it may be appropriately selected according to purpose. Nonetheless, it is preferably 10% by mass to 90% by mass, more preferably 25% by mass to 60% by mass, and particularly preferably 35% by mass to 55% by mass.

A content of the external additive in the toner is not particularly restricted, and it may be appropriately selected according to purpose. Nonetheless, with respect to 100 parts by mass of the toner base particles, it is preferably 0.5 parts by mass to 8.0 parts by mass, more preferably 2.0 parts by mass to 7.0 parts by mass, and particularly preferably 3.5 parts by mass to 5.5 parts by mass.

<<Toner Base Particles>>

The toner base particles include, for example, a binder resin and a colorant, and it further includes other components according to necessity.

<<<Binder Resin>>>

The binder resin is not particularly restricted, and it may be appropriately selected according to purpose. Examples thereof include a polyester resin, a silicone resin, a styrene-acrylic resin, a styrene resin, an acrylic resin, an epoxy resin, a diene resin, a phenolic resin, a terpene resin, a coumarin resin, an amide-imide resin, a butyral resin, a urethane resin and an ethylene-vinyl acetate resin. These may be used alone or in combination of two or more. Among these, a resin as a combination of the polyester resin, the polyester resin and the other binder resins described above is preferable since it has superior low-temperature fixing property, provides a smooth image surface and has sufficient flexibility even with a reduced molecular weight.

—Polyester Resin—

The polyester resin is not particularly restricted, and it may be appropriately selected according to purpose. Nonetheless, examples thereof include a non-crystalline polyester resin (non-modified polyester resin), a crystalline polyester resin and a modified polyester resin.

—Non-Crystalline Polyester Resin—

The non-crystalline polyester resin is obtained using a polyhydric alcohol component and a polycarboxylic acid component such as polycarboxylic acid, polycarboxylic acid anhydride and polycarboxylic acid ester.

Here, the non-crystalline polyester resin in the present invention refers to a resin obtained, as described above, using the polyhydric alcohol component and the polycarboxylic acid component such as polycarboxylic acid, polycarboxylic acid anhydride and polycarboxylic acid ester, and a modified polyester resin, for example, a graft-modified polymer described hereinafter, a prepolymer described hereinafter and a resin obtained by crosslinking and/or elongation reaction of the prepolymer do not belong to the non-crystalline polyester resin.

Examples of the polyhydric alcohol component include an alkylene (having 2 to 3 carbon atoms) oxide (average number of moles added of 1 to 10) adduct of bisphenol A such as polyoxypropylene(2.2)-2,2-bis(4-hydroxyphenyl)propane and polyoxyethylene(2.2)-2,2-bis(4-hydroxyphenyl)propane; ethylene glycol, propylene glycol, neopentyl glycol, glycerin, pentaerythritol, trimethylolpropane, a hydrogenated bisphenol A, sorbitol and an alkylene (having 2 to 3 carbon atoms) oxide (average number of moles added of 1 to 10) adduct thereof. These may be used alone or in combination of two or more.

Examples of the polycarboxylic acid component include: a dicarboxylic acid such as adipic acid, phthalic acid, isophthalic acid, terephthalic acid, fumaric acid and maleic acid; a succinic acid substituted by an alkyl group having 1 to 20 carbon atoms or an alkenyl group having 2 to 20 carbon atoms such as dodecenylsuccinic acid and octyl succinic acid; trimellitic acid and pyromellitic acid; anhydrides of these acids and alkyl (having 1 to 8 carbon atoms) esters. These may be used alone or in combination of two or more.

It is preferable that the non-crystalline polyester resin is at least partially miscible with a prepolymer described below and a resin obtained by crosslinking and/or elongation reaction of this prepolymer. When these are miscible, low-temperature fixing property and high temperature-resistant offset property may be improved. Therefore, it is preferable that the polyhydric alcohol component and the polycarboxylic acid component which constitute the non-crystalline polyester resin and a polyhydric alcohol component and a polycarboxylic acid component which constitute a prepolymer described hereinafter have similar compositions.

A molecular weight of the non-crystalline polyester resin is not particularly restricted, and it may be appropriately selected according to purpose. Nonetheless, when the molecular weight is too small, there are cases where the toner has degraded heat-resistant storage stability and durability against stresses such as stirring in a developing device. When the molecular weight is too large, a viscoelasticity of the toner during melting increases, which may result in degraded low-temperature fixing property. Thus, in GPC measurement, a weight-average molecular weight (Mw) of 2,500 to 10,000, a number average molecular weight (Mn) of 1,000 to 4,000, and a ratio Mw/Mn of 1.0 to 4.0 are preferable.

Further, the weight-average molecular weight (Mw) of 3,000 to 6,000, the number average molecular weight (Mn) of 1,500 to 3,000, and the ratio Mw/Mn of 1.0 to 3.5 are preferable.

An acid value of the non-crystalline polyester resin is not particularly restricted, and it may be appropriately selected according to purpose. Nonetheless, it is preferably 1 mgKOH/g to 50 mgKOH/g, and more preferably 5 mgKOH/g to 30 mgKOH/g. With the acid value of 1 mgKOH/g or greater, the toner easily becomes negatively charged, further, an affinity between paper and the toner improves during fixing on the paper, and as a result, low-temperature fixing property may be improved. When the acid value exceeds 50 mgKOH/g, there are cases where charge stability, especially charge stability against environmental changes, degrades.

A hydroxyl value of the non-crystalline polyester resin is not particularly restricted, and it may be appropriately selected according to purpose. Nonetheless, it is preferably 5 mgKOH/g or greater.

A glass transition temperature (Tg) of the non-crystalline polyester resin is not particularly restricted, and it may be appropriately selected according to purpose. Nonetheless, when the Tg is too low, there are cases where the toner has degraded heat-resistant storage stability and durability against stresses such as stirring in a developing device. When the Tg is too high, a viscoelasticity of the toner during melting increases, which may result in degraded low-temperature fixing property. Thus, it is preferably 40° C. to 70° C., and more preferably 45° C. to 60° C.

A content of the non-crystalline polyester resin is not particularly restricted, and it may be appropriately selected according to purpose. Nonetheless, it is preferably 50 parts by mass to 95 parts by mass, and more preferably 60 parts by mass to 90 parts by mass with respect to 100 parts by mass of the toner. When the content is less than 50 parts by mass, dispersibility of the pigment and the releasing agent in the toner degrades, which is likely to cause fogging and disturbance in an image. When the content exceeds 95 parts by mass, low-temperature fixing property may be inferior due to a low content of the crystalline polyester. The content within the more preferable range is advantageous in view of superior image quality, stability and low-temperature fixing property.

A molecular structure of the non-crystalline polyester resin may be confirmed by, other than an NMR (Nuclear Magnetic Resonance) measurement with a solution or a solid, an x-ray diffraction, a GC/MS (Gas Chromatograph Mass Spectrometer), an LC/MS Liquid Chromatograph Mass Spectrometer) or an IR (Infrared Spectroscopy) measurement. Conveniently, in the infrared absorption spectrum, a spectrum which does not have an absorption based on δCH (out-of-plane bending vibration) of an olefin at 965±10 $cm^{-1}$ and 990±10 $cm^{-1}$ is detected as the non-crystalline polyester resin.

—Crystalline Polyester Resin—

The crystalline polyester resin exhibits a hot-melt property that its viscosity rapidly decreases near a fixing starting temperature due to its high crystallinity. By using the crystalline polyester resin having such a property in the toner, the toner exhibits favorable heat-resistant storage stability due to crystallinity right before a melt starting temperature. At the melt starting temperature, a rapid viscosity decrease (sharp melt property) occurs, and the toner fixes thereby. Accordingly, the obtained toner has both favorable heat-resistant storage stability and low-temperature fixing property. Also, it shows a favorable result of a release width (difference between a lower-limit fixing temperature and a hot-offset occurrence temperature).

The crystalline polyester resin is obtained using: a polyhydric alcohol component; and a polycarboxylic acid component such as polycarboxylic acid, polycarboxylic acid anhydride and polycarboxylic acid ester.

Here, the crystalline polyester resin of the present invention refers to a resin, as described above, obtained using the polyhydric alcohol component and the polycarboxylic acid component such as polycarboxylic acid, polycarboxylic acid anhydride and polycarboxylic acid ester, and a modified polyester resin, for example, a graft-modified polymer described hereinafter, a prepolymer described hereinafter and a resin obtained by crosslinking and/or elongation reaction of the prepolymer do not belong to the crystalline polyester resin.

—Polyhydric Alcohol Component—

The polyhydric alcohol component is not particularly restricted, and it may be appropriately selected according to purpose. Examples thereof include diols and trihydric or higher alcohols.

Examples of the diols include saturated aliphatic diols. Examples of the saturated aliphatic diols include linear saturated aliphatic diols and branched saturated aliphatic diols. Among these, the linear saturated aliphatic diols are preferable, and linear saturated aliphatic diols having 4 to 12 carbon atoms are more preferable. When the saturated aliphatic diols are branched, crystallinity of the crystalline polyester resin decreases, which may result in a decreased melting point. Also, when the number of carbon atoms in a main-chain portion is less than 4, a melting temperature increases during condensation polymerization with an aromatic dicarboxylic acid, which may make low-temperature fixing difficult. On the other hand, when the number of carbon atoms exceeds 12, obtaining such a material is practically difficult. The number of carbon atoms is more preferably 12 or less.

Examples of the saturated aliphatic diols include ethylene glycol, 1,3-propanediol, 1,4-butanediol, 1,5-pentanediol, 1,6-hexanediol, 1,7-heptanediol, 1,8-octanethol, 1,9-nonanediol, 1,10-decanediol, 1,11-undecanediol, 1,12-dodecanediol, 1,13-tridecanediol, 1,14-tetradecanediol, 1,18-octadecanediol and 1,14-eicosanedecanediol. Among these, 1,4-butanediol, 1,6-hexanediol, 1,8-octanediol, 1,10-decanediol and 1,12-dodecanediol are preferable in view of high crystallinity of the crystalline polyester resin and superior sharp melt property.

Examples of the trihydric or higher alcohols include glycerin, trimethylolethane, trimethylolpropane and pentaerythritol.

These may be used alone or in combination of two or more.

—Polycarboxylic Acid Component—

The polycarboxylic acid component is not particularly restricted, and it may be appropriately selected according to purpose. Examples thereof include divalent carboxylic acids and trivalent or higher carboxylic acids.

Examples of the divalent carboxylic acid include: saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid; aromatic dicarboxylic acids of dibasic acids such as phthalic acid, isophthalic acid, terephthalic acid, naphthalene-2,6-dicarboxylic acid, malonic acid and mesaconic acid; and anhydrides thereof and lower alkyl esters thereof.

Examples of the trivalent or higher carboxylic acid include 1,2,4-benzene tricarboxylic acid, 1,2,5-benzene tricarboxylic acid, 1,2,4-naphthalene tricarboxylic acid, anhydrides thereof and lower alkyl esters thereof.

Also, as the polycarboxylic acid component, other than the saturated aliphatic dicarboxylic acid or the aromatic dicarboxylic acid, a dicarboxylic acid component having a sulfonic acid group may be included. Further, other than the saturated aliphatic dicarboxylic acid or the aromatic dicarboxylic acid, a dicarboxylic acid component having a double bond may be included.

These may be used alone or in combination of two or more.

The crystalline polyester resin preferably includes a structural unit derived from the saturated aliphatic dicarboxylic acid and a structural unit derived from the saturated aliphatic diols since it has high crystallinity and superior sharp melt property, which provides superior low-temperature fixing property.

A melting point of the crystalline polyester resin is not particularly restricted, and it may be appropriately selected according to purpose. Nonetheless, it is preferably 60° C. or greater and less than 80° C. When the melting point is less than 60° C., the crystalline polyester resin is likely to melt at a low temperature, which may degrade heat-resistant storage stability of the toner. When the melting point is 80° C. or greater, heating during fixing cannot sufficiently melt the crystalline polyester resin, which may result in degraded low-temperature fixing property.

The melting point may be measured from a endothermic peak value of a DSC chart in a differential scanning calorimeter (DSC) measurement.

A molecular weight of the crystalline polyester resin is not particularly restricted, and it may be appropriately selected according to purpose. Nonetheless, since those having a sharp molecular weight distribution and a low molecular weight has superior low-temperature fixing property and those with a large amount of a component having a low molecular weight has degraded heat-resistant storage stability it is preferable in a GPC measurement that a soluble portion of ortho-dichlorobenzene in the crystalline polyester resin has a weight-average molecular weight (Mw) of 3,000 to 30,000, a number average molecular weight (Mn) of 1,000 to 10,000, and a ratio Mw/Mn of 1.0 to 10.

Further, it is preferable that the weight-average molecular weight (Mw) is 5,000 to 15,000, the number average molecular weight (Mn) is 2,000 to 10,000, and the ratio Mw/Mn is 1.0 to 5.0.

An acid value of the crystalline polyester resin is not particularly restricted, and it may be appropriately selected according to purpose. Nonetheless, in view of affinity between paper and the resin, in order to achieve desired low-temperature fixing property, it is preferably 5 mgKOH/g or greater, and more preferably 10 mgKOH/g or greater. On the other hand, in order to improve high temperature-resistant offset property, it is preferably 45 mgKOH/g or less.

A hydroxyl value of the crystalline polyester resin is not particularly restricted, and it may be appropriately selected according to purpose. Nonetheless, to achieve desired low-temperature fixing property and favorable charge properties, it is preferably 0 mgKOH/g to 50 mgKOH/g, and more preferably 5 mgKOH/g to 50 mgKOH/g.

A molecular structure of the crystalline polyester resin may be confirmed by, other than an NMR (Nuclear Magnetic Resonance) measurement with a solution or a solid, an X-ray diffraction, a GC/MS (Gas Chromatograph Mass Spectrometer), an LC/MS Liquid Chromatograph Mass Spectrometer) or an IR (Infrared Spectroscopy) measurement. Conveniently, in the infrared absorption spectrum, a spectrum which has an absorption based on δCH (out-of-plane bending vibration) of an olefin at 965±10 $cm^{-1}$ and 990±10 $cm^{-1}$ is detected as the crystalline polyester resin.

A content of the crystalline polyester resin is not particularly restricted, and it may be appropriately selected according to purpose. Nonetheless, it is preferably 2 parts by mass to 20 parts by mass, and more preferably 5 parts by mass to 15 parts by mass with respect to 100 parts by mass of the toner. When the content is less than 2 parts by mass, the crystalline polyester resin does not provide sufficient sharp melt property, resulting in inferior low-temperature fixing property. When it exceeds 20 parts by mass, there are cases where heat-resistant storage stability degrades and image fogging tends to occur. The content within the more preferable range is advantageous in view of superior image quality, stability and low-temperature fixing property.

—Modified Polyester Resin—

The modified polyester resin is not particularly restricted, and it may be appropriately selected according to purpose. Examples thereof include a urea-modified polyester resin.

The modified polyester resin may be obtained, for example, by a reaction of a polymer having a portion reactive with a compound having an active hydrogen group with a compound having an active hydrogen group.

—Polymer Having Portion Reactive with Compound Having Active Hydrogen Group (Prepolymer)—

The polymer having a portion reactive with a compound having an active hydrogen group (hereinafter, it may also be referred to as "prepolymer") is not particularly restricted, and it may be appropriately selected according to purpose. Examples thereof include a polyol resin, a polyacrylic resin, a polyester resin, an epoxy resin, and derivatives thereof. These may be used alone or in combination of two or more.

Among these, the polyester resin is preferable in view of high fluidity and transparency during melting.

Examples of the portion reactive with a compound having an active hydrogen group included in the prepolymer include an isocyanate group, an epoxy group, a carboxyl group and a functional group denoted as —COCl. These may be used alone or in combination of two or more.

Among these, the isocyanate group is preferable.

The prepolymer is not particularly restricted, and it may be appropriately selected according to purpose. Nonetheless, a polyester prepolymer having an isocyanate group is preferable since it allows easy adjustment of a molecular weight of a polymeric component and ensures favorable releasing property and fixability even when there is no oil-less low-temperature fixing property in a dry toner, especially, release oil application mechanism to a heating medium for fixing.

—Compound Having Active Hydrogen Group—

The compound having an active hydrogen group acts as an elongation agent, a cross-linking agent and so on when the polymer having a portion reactive with a compound having an active hydrogen group undergoes an elongation reaction, crosslinking reaction and so on in an aqueous medium.

The active hydrogen group is not particularly restricted, and it may be appropriately selected according to purpose. Examples thereof include a hydroxyl group (an alcoholic hydroxyl group and a phenolic hydroxyl group), an amino group, a carboxyl group and a mercapto group. These may be used alone or in combination of two or more.

The compound having an active hydrogen group is not particularly restricted, and it may be appropriately selected according to purpose. Nonetheless, when the polymer having a portion reactive with a compound having an active hydrogen group is a polyester resin including an isocyanate group, amines are preferable since it may increase the molecular weight by an elongation reaction, crosslinking reaction and so on with the polyester resin.

The amines are not particularly restricted, and they may be appropriately selected according to purpose. Examples thereof include a diamine, a trivalent or higher amine, an amino alcohol, an amino mercaptan, an amino acid, and these compounds with an amino group blocked. These may be used alone or in combination of two or more.

Among these, the diamine and a mixture of the diamine with a small amount of the trivalent or higher amine are preferable.

The diamine is not particularly restricted, and it may be appropriately selected according to purpose. Examples thereof include an aromatic diamine, an alicyclic diamine and an aliphatic diamine. The aromatic diamine is not particularly restricted, and it may be appropriately selected according to purpose. Examples thereof include phenylene diamine, diethyltoluene diamine and 4,4'-diaminodiphenylmethane. The alicyclic diamine is not particularly restricted, and it may be appropriately selected according to purpose. Examples thereof include 4,4'-diamino-3,3'-dimethyldicyclohexylmethane, diaminocyclohexane and isophoron diamine. The aliphatic diamine is not particularly restricted, and it may be appropriately selected according to purpose. Examples thereof include ethylene diamine, tetramethylene diamine and hexamethylene diamine.

The trivalent or higher amine is not particularly restricted, and it may be appropriately selected according to purpose. Examples thereof include diethylene triamine and triethylene tetramine.

The amino alcohol is not particularly restricted, and it may be appropriately selected according to purpose. Examples thereof include ethanolamine and hydroxyethylaniline.

The amino mercaptan is not particularly restricted, and it may be appropriately selected according to purpose. Examples thereof include aminoethyl mercaptan and aminopropylmercaptan.

The amino acid is not particularly restricted, and it may be appropriately selected according to purpose. Examples thereof include aminopropionic acid and aminocaproic acid.

The compounds with an amino group blocked are not particularly restricted, and they may be appropriately selected according to purpose. Examples thereof include a ketimine compound and an oxazoline compound obtained by blocking the amino group with ketones such as acetone, methyl ethyl ketone and methyl isobutyl ketone.

—Polyester Resin Including Isocyanate Group—

The polyester resin including an isocyanate group (hereinafter, it may also be referred to as a "polyester prepolymer including an isocyanate group") is not particularly restricted, and it may be appropriately selected according to purpose. Examples thereof include a reaction product of a polyisocyanate and a polyester resin having an active hydrogen group obtained by polycondensation of a polyol and a polycarboxylic acid.

—Polyol—

The polyol is not particularly restricted, and it may be appropriately 11) selected according to purpose. Examples thereof include a diol, a pentaerythritol and a mixture of the diol and the pentaerythritol. These may be used alone or in combination of two or more.

Among these, the diol and a mixture of the diol with a small amount of the pentaerythritol are preferable.

The diol is not particularly restricted, and it may be appropriately selected according to purpose. Examples thereof include an alkylene glycol, a diol having an oxyalkylene group, an alicyclic diol, a diol that an alkylene oxide is added to an alicyclic diol, a bisphenol and an alkylene oxide adduct of a bisphenol.

Examples of the alkylene glycol include ethylene glycol, 1,2-propylene glycol, 1,3-propylene glycol, 1,4-butanediol and 1,6-hexanediol.

Examples of the diol having an oxyalkylene group include diethylene glycol, triethylene glycol, dipropylene glycol, polyethylene glycol, polypropylene glycol and polytetramethylene glycol.

Examples of the alicyclic diol include 1,4-cyclohexane dimethanol and hydrogenated bisphenol A.

Examples of the diol that an alkylene oxide is added to an alicyclic diol include a diol that an alkylene oxide such as ethylene oxide, propylene oxide and butylene oxide are added to the alicyclic diol.

Examples of the bisphenols include bisphenol A, bisphenol F and bisphenol S.

Examples of the alkylene oxide adduct of a bisphenol include a diol that an alkylene oxide such as ethylene oxide, propylene oxide and butylene oxide are added to the bisphenol.

Here, the number of carbon atoms in the alkylene glycol is not particularly restricted, and it may be appropriately selected according to purpose. Nonetheless, 2 to 12 is preferable.

Among these, the alkylene glycol having 2 to 12 carbon atoms and the alkylene oxide adduct of a bisphenol are preferable, and the alkylene oxide adduct of a bisphenol and a mixture of the alkylene oxide adduct of a bisphenol and the alkylene glycol having 2 to 12 carbon atoms are more preferable.

The pentaerythritol is not particularly restricted, and it may be appropriately selected according to purpose. Examples thereof include trivalent or higher aliphatic alcohols, trivalent or higher polyphenols, and alkylene oxide adducts of trivalent or higher polyphenol.

The trivalent or higher aliphatic alcohol is not particularly restricted, and it may be appropriately selected according to purpose. Examples thereof include glycerin, trimethylolethane, trimethylolpropane, pentaerythritol and sorbitol.

The trivalent or higher polyphenols are not particularly restricted, and they may be appropriately selected according to purpose. Examples thereof include trisphenol PA, phenol novolak and cresol novolak.

Examples of the alkylene oxide adduct of trivalent or higher polyphenols include an adduct of trivalent or higher polyphenols with an alkylene oxide such as ethylene oxide, propylene oxide and butylene oxide.

When a mixture of the diol and the pentaerythritol is used, a mass ratio of the pentaerythritol to the diol is not particularly restricted, and it may be appropriately selected according to purpose. Nonetheless, it is preferably 0.01% by mass to 10% by mass, and more preferably 0.01% by mass to 1% by mass.

—Polycarboxylic Acid—

The polycarboxylic acid is not particularly restricted, and it may be appropriately selected according to purpose. Examples thereof include dicarboxylic acid, trivalent or higher carboxylic acid, and a mixture of the dicarboxylic acid and the trivalent or higher carboxylic acid. These may be used alone or in combination of two or more.

Among these, the dicarboxylic acid and a mixture of the dicarboxylic acid with a small amount of the trivalent or higher polycarboxylic acid are preferable.

The dicarboxylic acid is not particularly restricted, and it may be appropriately selected according to purpose. Examples thereof include a divalent alkanoic acid, a divalent alkene acid and an aromatic dicarboxylic acid.

The divalent alkanoic acid is not particularly restricted, and it may be appropriately selected according to purpose. Examples thereof include succinic acid, adipic acid and sebacic acid.

The divalent alkene acid is not particularly restricted, and it may be appropriately selected according to purpose. Nonetheless, a divalent alkene acid having 4 to 20 carbon atoms is preferable. The divalent alkene acid having 4 to 20 carbon atoms is not particularly restricted, and it may be appropriately selected according to purpose. Examples thereof include maleic acid and fumaric acid.

The aromatic dicarboxylic acid is not particularly restricted, and it may be appropriately selected according to purpose. Nonetheless, an aromatic dicarboxylic acid having 8 to 20 carbon atoms is preferable. The aromatic dicarboxylic acid having 8 to 20 carbon atoms is not particularly restricted, and it may be appropriately selected according to purpose. Examples thereof include phthalic acid, isophthalic acid, terephthalic acid and naphthalenedicarboxylic acid.

The trivalent or higher carboxylic acid is not particularly restricted, and it may be appropriately selected according to purpose. Examples thereof include trivalent or higher aromatic carboxylic acid.

The trivalent or higher aromatic carboxylic acid is not particularly restricted, and it may be appropriately selected according to purpose. Nonetheless, a trivalent or higher aromatic carboxylic acid having 9 to 20 carbon atoms is preferable. The trivalent or higher aromatic carboxylic acid having 9 to 20 carbon atoms is not particularly restricted, and it may be appropriately selected according to purpose. Examples thereof include trimellitic acid and pyromellitic acid.

As the polycarboxylic acid, acid anhydrides or lower alkyl esters of the dicarboxylic acid, the trivalent or higher carboxylic acid or a mixture of the dicarboxylic acid and the trivalent or higher carboxylic acid may be used.

The lower alkyl esters are not particularly restricted, and they may be appropriately selected according to purpose. Examples thereof include methyl esters, ethyl esters and isopropyl esters.

When a mixture of the dicarboxylic acid and the trivalent or higher carboxylic acid is used, a mass ratio of the trivalent or higher carboxylic acid to the dicarboxylic acid is not particularly restricted, and it may be appropriately selected according to purpose. Nonetheless, it is preferably 0.01% by mass to 10% by mass, and more preferably 0.01% by mass to 1% by mass.

When the polyol and the polycarboxylic acid undergo polycondensation, an equivalent ratio of a hydroxyl group in the polyol to a carboxyl group in the polycarboxylic acid is not particularly restricted, and it may be appropriately selected according to purpose. Nonetheless, it is preferably 1 to 2, more preferably 1 to 1.5, and particularly preferably 1.02 to 1.3.

A content of a structural unit derived from the polyol in the polyester prepolymer having an isocyanate group is not particularly restricted, and it may be appropriately selected according to purpose. Nonetheless, it is preferably 0.5% by mass to 40% by mass, more preferably 1% by mass to 30% by mass, and particularly preferably 2% by mass to 20% by mass.

When the content is less than 0.5% by mass, high temperature-resistant offset property degrades, and there are cases where both heat-resistant storage stability and low-temperature fixing property of the toner cannot be obtained. When it exceeds 40% by mass, low-temperature fixing property may degrade.

—Polyisocyanate—

The polyisocyanate is not particularly restricted, and it may be appropriately selected according to purpose. Examples thereof include an aliphatic diisocyanate, an alicyclic diisocyanate, an aromatic polyisocyanate, an aromatic aliphatic diisocyanate, an isocyanurate, and those blocked by phenol derivatives, oximes and caprolactams.

The aliphatic diisocyanate is not particularly restricted, and it may be appropriately selected according to purpose. Examples thereof include tetramethylene diisocyanate, hexamethylene diisocyanate, 2,6-diisocyanatocaproic acid methyl ester, octamethylene diisocyanate, decamethylene diisocyanate, dodecamethylene diisocyanate, tetradecamethylene diisocyanate, trimethylhexane diisocyanate and tetramethylhexane diisocyanate.

The alicyclic diisocyanate is not particularly restricted, and it may be appropriately selected according to purpose. Examples thereof include isophorone diisocyanate and cyclohexyl diisocyanate.

The aromatic polyisocyanate is not particularly restricted, and it may be appropriately selected according to purpose. Examples thereof include tolylene diisocyanate, diisocyanatodiphenylmethane, 1,5-1,5-naphthylene diisocyanate, 4,4'-diisocyanatodiphenyl, 4,4'-diisocyanato-3,3'-dimethyldiphenyl, 4,4'-diisocyanato-3-methyldiphenylmethane and 4,4'-diisocyanato-diphenyl ether.

The aromatic aliphatic diisocyanate is not particularly restricted, and it may be appropriately selected according to purpose. Examples thereof include α,α,α',α'-tetramethylxylylene diisocyanate.

The isocyanurate is not particularly restricted, and it may be appropriately selected according to purpose. Examples thereof include trigisocyanatoalkyl)isocyanurate and tris(isocyanatocycloalkyl)isocyanurate.

These may be used alone or in combination of two or more.

When the polyisocyanate and the polyester resin having a hydroxyl group are reacted, an equivalent ratio of the isocyanate group of the polyisocyanate to the hydroxyl group of the polyester resin is not particularly restricted, and it may be appropriately selected according to purpose. Nonetheless, it is preferably 1 to 5, more preferably 1.2 to 4, and particularly preferably 1.5 to 3. When the equivalent ratio is less than 1, offset resistance may degrade. When it exceeds 5, low-temperature fixing property may degrade.

A content of a structural unit derived from the polyisocyanate in the polyester prepolymer having an isocyanate group is not particularly restricted, and it may be appropriately selected according to purpose. Nonetheless, it is preferably 0.5% by mass to 40% by mass, more preferably 1% by mass to 30% by mass, and particularly preferably 2% by mass to 20% by mass. When the content is less than 0.5% by mass, high temperature-resistant offset property may degrade. When it exceeds 40% by mass, low-temperature fixing property may degrade.

An average number of the isocyanate group included in one molecule of the polyester prepolymer having an isocyanate group is not particularly restricted, and it may be appropriately selected according to purpose. Nonetheless, it is preferably 1 or greater, more preferably 1.2 to 5, and particularly preferably 1.5 to 4. When the average number is less than 1, a molecular weight of the urea-modified polyester resin decreases, which may result in degraded high temperature-resistant offset property.

A mass ratio of the polyester prepolymer having an isocyanate group to a polyester resin including a propylene oxide adduct of bisphenols in the polyhydric alcohol component by 50% by mole or greater and having a specific hydroxyl value and acid value is not particularly restricted, and it may be appropriately selected according to purpose. Nonetheless, it is preferably less than 5/greater than 95 to greater than 25/less than 75, and it is more preferably 10/90 to 25/75. When the mass ratio is less than 5/95, high temperature-resistant offset property may degrade. When it exceeds 25/75, low-temperature fixing property and image gloss may degrade.

<<<Colorant>>>

The colorant is not particularly restricted, and it may be appropriately selected from heretofore known dyes and pigment according to purpose. Examples thereof include carbon black, nigrosine dye, iron black, naphthol yellow S, Hansa Yellow (10G, 5G, G), cadmium yellow, yellow iron oxide, yellow ocher, chrome yellow, titanium yellow, polyazo yellow, Oil Yellow, Hansa Yellow (GR, A, RN, R), Pigment Red, Pigment Yellow L, Benzidine Yellow (G, GR), Permanent Yellow (NCG), Vulcan Fast Yellow (5G, R), tartrazine lake, Quinoline Yellow Lake, Anthrazane Yellow BGL, Isoindolinone Yellow, colcothar, red lead, lead vermilion, cadmium red, Cadmium Mercury Red, antimony vermilion, Permanent Red 4R, Para Red, fiser red, para-chloro-ortho-aniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, bordeaux 5B, Toluidine Maroon, Permanent Bordeaux F2K, Hello Bordeaux BL, bordeaux 10B, BON Maroon Light, BON Maroon Medium, Eosin Lake, Rhodamine Lake B, Rhodamine Lake Y, Alizarin Lake, Thioindigo Red B, Thioindigo Maroon, Oil Red, quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, Dioxane Violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide and Lithopone. These may be used alone or in combination of two or more.

A content of the colorant with respect to the toner is not particularly restricted, and it may be appropriately selected according to purpose. Nonetheless, it is preferably 1% by mass to 15% by mass, and more preferably 3% by mass to 10% by mass. When the content is less than 1% by mass, the toner has degraded coloring ability. When it exceeds 15% by mass, there are cases of poor dispersion of the pigment in the toner, degraded coloring ability and degraded electrical characteristics of the toner.

The colorant may also be used as a masterbatch combined with a resin. The resin is not particularly restricted, and it may be appropriately selected according to purpose. Examples thereof include a polyester resin, a polymer of styrene or substituent thereof (e.g. poly-p-chlorostyrene, polyvinyltoluene), a styrene copolymer (e.g. styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-α-methyl chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer, a styrene-maleic acid ester copolymer), polymethyl methacrylate, polybutyl methacrylate, a polyvinyl chloride resin, a polyvinyl acetate resin, a polyethylene resin, a polypropylene resin, an epoxy resin, an epoxy polyol resin, a polyurethane resin, a polyamide resin, a polyvinyl butyral resin, a polyacrylic acid, rosin, a modified rosin, a terpene resin, an aliphatic hydrocarbon resin, an alicyclichydrocarbon resin, an aromatic petroleum resin, chlorinated paraffin and paraffin wax. These may be used alone or in combination of two or more.

A method for producing the masterbatch is not particularly restricted, and it may be appropriately selected according to purpose. Examples thereof include a producing method by mixing or kneading the resin, the colorant and an organic solvent for the masterbatch with an application of high shear force. Here, the organic solvent is added to enhance interaction between the colorant and the binder resin. Also, other production methods of the masterbatch are not particularly restricted, and they may be appropriately selected according to purpose. Nonetheless, a so-called flushing method is favorably used since a wet cake of the colorant may be used as it is, without necessity of drying. This flushing method is a method of mixing or kneading an aqueous paste of the colorant including water with the resin for masterbatch and an organic solvent to remove the water and the organic medium by transferring the colorant to the resin for masterbatch. For the mixing or kneading, for example, a high shear dispersing apparatus such as three-roll mill is favorably used.

<<<Other Components>>>

The other components are not particularly restricted, and they may be appropriately selected according to purpose. Examples thereof include a releasing agent, a layered inorganic mineral, a magnetic material, a cleanability improving agent, a fluidity improving agent and a charge controlling agent.

—Releasing Agent—

The releasing agent is not particularly restricted, and it may be appropriately selected according to purpose. Examples thereof include: waxes such as vegetable waxes (carnauba wax, cotton wax, Japan wax, rice wax and so on), animal waxes (bees wax, lanolin and so on), mineral waxes (ozokerite, ceresin and so on), and petroleum waxes (paraffin, microcrystalline wax, petrolatum and so on); waxes other than natural waxes such as synthetic hydrocarbon waxes (Fischer-Tropsch wax, polyethylene wax and so on), and synthetic waxes (esters, ketones, ethers and so on); fatty acids amides such as 1,2-hydroxy stearic amide, stearic amide, phthalic anhydride imide, and chlorinated hydrocarbons; and crystalline polymers having a long-chain alkyl group in a side chain thereof including homopolymers or copolymers of polyacrylate such as poly(n-stearyl methacrylate) and poly(n-lauryl methacrylate) as low-molecular weight crystalline polymer (n-stearyl acrylate-ethyl methacrylate copolymer and so on). Among these, waxes having a melting point of 50° C. to 120° C. are preferable since they act effectively as a releasing agent between a fixing roller and a toner interface and as a result hot offset resistance can be improved without application of a releasing agent such as oil on the fixing roller.

A melting point of the releasing agent is not particularly restricted, and it may be appropriately selected according to purpose. Nonetheless, it is preferably 50° C. to 120° C., and more preferably 60° C. to 90° C. When the melting point is less than 50° C., storage stability may be adversely affected. When the melting point exceeds 120° C., it is likely to cause cold offset during fixing at a low temperature. Here, the melting point of the releasing agent may be obtained by measuring a maximum endothermic peak using a differential scanning calorimeter (a TG-DSC system, TAS-100, manufactured by Rigaku Corporation).

A melt viscosity of the releasing agent is not particularly restricted, and it may be appropriately selected according to purpose. Nonetheless, as a measured value at a temperature higher by 20° C. than a melting point of the releasing agent, it is preferably 5 cps to 1,000 cps, and more preferably 10 cps to 100 cps. When the melt viscosity is less than 5 cps, there are cases where releasing property degrades. When it exceeds 1,000 cps, there are cases where effects of improving hot-offset resistance, low-temperature fixing property are not achieved.

A content of the releasing agent in the toner is not particularly restricted, and it may be appropriately selected according to purpose. Nonetheless, it is preferably 40% by mass or less, and more preferably 3% by mass to 30% by mass. When the content exceeds 40% by mass, the toner may have degraded fluidity.

The releasing agent preferably exists in a state dispersed in the toner base particles. For this, it is preferable that the releasing agent and the binder resin are incompatible. A method for finely dispersing the releasing agent in the toner base particles is not particularly restricted, and it may be appropriately selected according to purpose. Examples thereof include a dispersing method by kneading with an application of a shear force in producing the toner.

A dispersion state of the releasing agent may be confirmed by observing a thin slice of the toner particles by a transmission electron microscope (TEM). A dispersion diameter of the releasing agent is preferably small. However, if it is too small, there are cases where bleeding during fixing is insufficient. Thus, the releasing agent is present in a dispersed state if the releasing agent is confirmed at a magnification of 10,000 times. If the releasing agent cannot be confirmed at 10,000 times, bleeding during fixing is insufficient even though it is finely dispersed.

—Layered Inorganic Mineral—

The layered inorganic mineral is not particularly restricted as long as it is an inorganic mineral having laminated layers with a thickness of several nm, and it may be appropriately selected according to purpose. Examples thereof include montmorillonite, bentonite, hectorite, attapulgite, sepiolite and mixtures thereof. These may be used alone or in combination of two or more. Among these, a modified layered inorganic mineral is preferable since it allows deformation of the toner during granulation, plays a charge-control function, and provides superior low-temperature fixing property. A modified layered inorganic mineral that a layered inorganic mineral having a montmorillonite basic crystal structure is modified by an organic cation is more preferable, and organic-modified montmorillonite and bentonite are particularly preferable since it allows easy viscosity control without affecting toner properties.

The modified layered inorganic compound is preferably the layered inorganic mineral at least partially modified with an organic ion. At least partial modification of the layered inorganic mineral with an organic ion provides an appropriate hydrophobicity, provides a non-Newtonian viscosity to an oil phase including a toner composition and/or toner composition precursor and allows deformation of the toner.

A content of the modified layered inorganic mineral in the toner base particles is not particularly restricted, and it may be appropriately selected according to purpose. Nonetheless, it is preferably 0.05% by mass to 5% by mass.

—Magnetic Material—

The magnetic material is not particularly restricted, and it may be appropriately selected according to purpose. Examples thereof include iron powder, magnetite and ferrite. Among these, white ones are preferable in view of color tone.

—Cleanability Improving Agent—

The cleanability improving agent is not particularly restricted as long as it is an agent added to the toner for removing a developer remaining on a photoconductor or a primary transfer medium after transfer, and it may be appropriately selected according to purpose. Examples thereof include: fatty acid metal salt such as zinc stearate, calcium stearate and stearic acid; and polymer particles manufactured by soap-free emulsion polymerization such as polymethyl methacrylate fine particles and polystyrene fine particles. A volume-average particle diameter of the polymer particles is not particularly restricted, and it may be appropriately selected according to purpose. Nonetheless, a relatively particle size distribution thereof is preferably narrow, and the volume-average particle diameter thereof is more preferably 0.01 μm to 1 μm.

—Fluidity Improving Agent—

The fluidity improving agent is defined as an agent for surface treatment to increase hydrophobicity in order to prevent degradation of fluidity properties and charge properties even under high-humidity condition. Examples thereof include a silane coupling agent, a silylating agent, a silane coupling agent having a fluorinated alkyl group, an organic titanate coupling agent, an aluminum-based coupling agent, a silicone oil, a modified silicone oil, and so on. Here, the fluidity improving agent may be subjected to surface treatment by silica, titanium oxide and so on, and in this case, it is preferably used as hydrophobicity silica, hydrophobicity titanium oxide and so on.

—Charge Controlling Agent—

The charge controlling agent is not particularly restricted, and it may be appropriately selected according to purpose. Examples thereof include nigrosine dyes, triphenylmethane dyes, chromium-containing metal complex dyes, molybdic acid chelate pigments, rhodamine dyes, alkoxy amines, quaternary ammonium salts (including fluorine-modified quaternary ammonium salts), alkyl amides, elemental phosphorus or phosphorus compounds, elemental tungsten or tungsten compounds, fluorine surfactants, metal salts of salicylic acid, metal salts of salicylic acid derivatives, copper phthalocyanine, perylene, quinacridone, azo pigments and polymeric compounds having a functional group such as sulfonic acid group, carboxyl group and quaternary ammonium salt.

Examples of commercial products of the charge controlling agent include: BONTRON 03 of nigrosine dyes, BONTRON P-51 of quaternary ammonium salt, BONTRON S-34 of metal-containing azo dye, E-82 of oxynaphthoic acid metal complex, E-84 of salicylic acid metal complex, E-89 of phenol condensate (all manufactured by Orient Chemical Industries Co., Ltd.); TP-302, TP-415 of quaternary ammonium salt molybdenum complexes (all manufactured by Hodogaya Chemical Co., Ltd.); Copy charge PSY VP2038 of quaternary ammonium salt, Copy blue PR of triphenylmethane derivative, Copy charge NEG VP2036, Copy charge NX VP434 of quaternary ammonium salts (all manufactured by Hoechst); and LRA-901, LR-147 as a boron complex (all manufactured by Carlit Japan Co., Ltd.).

A content of the charge controlling agent is not particularly restricted, and it may be appropriately selected according to purpose. Nonetheless, with respect to 100 parts by mass of the binder resin, it is preferably 0.1 parts by mass to 10 parts by mass, and more preferably 0.2 parts by mass to 5 parts by mass. When the content exceeds 10 parts by mass, charging property of the toner becomes excessive. This weakens an effect of the main charge controlling agent and increases electrostatically attractive force with a developing roller, which may result in reduced fluidity of the developer and reduced image density. The charge controlling agent may be dissolved or dispersed along with the masterbatch and the resin after melt-kneading; it may be added directly to the organic solvent when in dissolving or dispersing; or it may be fixed on a surface of the toner after toner particles are prepared.

The toner base particles include the modified polyester resin, the non-modified polyester resin and the colorant, and the toner base particles are obtained by adding the polymer having a portion reactive with a compound having an active hydrogen group as a precursor of the modified polyester resin, the compound having an active hydrogen group, the non-modified polyester resin and the colorant in an organic solvent for emulsification or dispersion to obtain an emulsion or a dispersion and then by subjecting the compound having an active hydrogen group and the polymer having a portion reactive with a compound having an active hydrogen group to an elongation or crosslinking reaction in the emulsion or dispersion.

<<Method for Producing Toner>>

A method for producing the toner is not particularly restricted, and it may be appropriately selected according to purpose. Examples thereof include a production method by pulverization method and a production method by polymerization method. Among these, the production method by polymerization method is preferable in view of smaller particle diameter of the toner.

<<Pulverization Method>>

The pulverization method is not particularly restricted, and it may be appropriately selected according to purpose. Examples thereof include a method for producing toner base particles by melting or kneading a toner material followed by pulverization and classification. Here, for the purpose of adjusting an average circularity of the toner to 0.97 to 1.0, a mechanical impact may be applied to control a shape of the obtained toner base particles obtained. In this case, the mechanical impact may be applied to the toner base particles using devices such as hybridizer, mechanofusion and so on. Also, by treating the thus produced toner base particles with an external additive, the toner of the present invention is obtained.

<<Polymerization Method>>

The polymerization method is not particularly restricted, and it may be appropriately selected according to purpose. Examples thereof include a suspension-polymerization method, a dissolution-suspension-polymerization method and an emulsion-polymerization-agglomeration method. Among these, the emulsion-polymerization-agglomeration method is preferable, and the dissolution-suspension method is more preferable.

—Dissolution-Suspension Method—

The dissolution-suspension method is not particularly restricted, and it may be appropriately selected according to purpose. Nonetheless, a production method by aqueous granulation is preferable, and a production method including an oil phase preparation step, an aqueous-phase preparation step, an emulsifying or dispersing step, a desolvation step, a washing or drying step and an external additive processing step is more preferable.

Specific examples of the dissolution-suspension method are not particularly restricted, and they may be appropriately selected according to purpose. Nonetheless, in a preferable method, a solution or a dispersion of a toner material obtained by dissolving or dispersing at least the binder resin and the colorant in an organic solvent is added in an aqueous phase, which is subjected to emulsification or dispersion to obtain an emulsion or a dispersion, and then toner base particles obtained by removing the organic solvent from the emulsion or the dispersion are mixed with an external additive to produce the toner.

Among the dissolution-suspension method, an ester elongation method is preferable, and as a specific example of the ester elongation method, in a preferable method, a solution or a dispersion of a toner material obtained by dissolving or dispersing at least the compound having an active hydrogen group, the polymer having a portion reactive with a compound having an active hydrogen group, the binder resin and the colorant in an organic solvent is added in an aqueous phase, which is subjected to emulsification or dispersion to obtain an emulsion or a dispersion, then in the emulsion or the dispersion, the compound having an active hydrogen group and the polymer having a portion reactive with a compound having an active hydrogen group are subjected to elongation or crosslinking reaction, and toner base particles obtained by removing the organic solvent from the emulsion or the dispersion are mixed with an external additive, to produce the toner.

—Oil Phase Preparation Step—

The oil phase preparation step is a step for preparing an oil phase (a solution or a dispersion of a toner material) by dissolving or dispersing a toner material including the binder resin and the colorant in an organic solvent. Also, components other than the polymer having a portion reactive with a compound having an active hydrogen group in the toner material may be added and mixed in the aqueous medium during preparation of an aqueous phase described hereinafter, or it may be added to the aqueous medium along with the solution or the dispersion when the solution or the dispersion of the toner material is added to the aqueous medium.

The organic solvent is not particularly restricted, and it may be appropriately selected according to purpose. Nonetheless, the organic solvent having a boiling point of less than 150° C. is preferable for easy removal. The organic solvent having a boiling point of less than 150° C. is not particularly restricted, and it may be appropriately selected according to purpose. Examples thereof include toluene, xylene, benzene, carbon tetrachloride, methylene chloride, 1,2-dichloroethane, 1,1,2-trichloroethane, trichlorethylene, chloroform, monochlorobenzene, dichloroethylidene, methyl acetate, ethyl acetate, methyl ethyl ketone and methyl isobutyl ketone. These may be used alone or in combination of two or more. Among these, ethyl acetate, toluene, xylene, benzene, methylene chloride, 1,2-dichloroethane, chloroform and carbon tetrachloride are preferable, and ethyl acetate is preferable. An amount of the organic solvent used is not particularly restricted, and it may be appropriately selected according to purpose. Nonetheless, with respect to 100 parts by mass of the toner material, it is preferably 40 parts by mass to 300 parts by mass, more preferably 60 parts by mass to 140 parts by mass, and particularly preferably 80 parts by mass to 120 parts by mass.

—Aqueous-Phase Preparation Step—

The aqueous-phase preparation step is a step for preparing an aqueous phase (aqueous medium). The aqueous phase is not particularly restricted, and it may be appropriately selected according to purpose. Examples thereof include water, a solvent miscible with water, and a mixture thereof. These may be used alone or in combination of two or more. Among these, water is preferable. Examples of the solvent miscible with water include alcohols (e.g. methanol, isopropanol, ethylene glycol), dimethylformamide, tetrahydrofuran, cellosolves (e.g. methylcellosolve (registered trademark)) and lower ketones (e.g. acetone, methyl ethyl ketone).

—Emulsifying or Dispersing Step—

The emulsifying or dispersing step is a step for obtaining an emulsion or dispersion by dispersing the oil phase in the aqueous phase. The toner material is not necessarily mixed in the aqueous phase in forming particles; it may be added after the particles are formed. For example, particles without a colorant are formed first, and then a colorant may be added by a heretofore known dyeing method. An amount of the aqueous phase used with respect to 100 parts by mass of the toner material is not particularly restricted, and it may be appropriately selected according to purpose. Nonetheless, it is 50 parts by mass to 2,000 parts by mass, and more preferably 100 parts by mass to 1,000 parts by mass. When the amount used is less than 50 parts by mass, there are cases where the toner particles having a predetermined particle diameter are not obtained due to poor dispersion state of the toner material. The amount exceeding 2,000 parts by mass may not be economical. Also, a dispersant can be used according to necessity. Use of the dispersant is preferable in view of sharp particle size distribution and stable dispersion.

A dispersant used in the emulsifying or dispersing step is not particularly restricted, and it may be appropriately selected according to purpose. Examples thereof include an anionic surfactant, a cationic surfactant, a non-ionic surfactant, an amphoteric surfactant, an anionic surfactant having a fluoroalkyl group, a cationic surfactant having a fluoroalkyl group, inorganic compound (e.g. tricalcium phosphate, calcium carbonate, titanium oxide, colloidal silica and hydroxyapatite), and a particulate polymer (e.g. MMA polymer particles of 1 μm, MMA polymer particles of 3 μm, styrene particles of 0.5 μm, styrene particles of 2 μm, styrene-acrylonitrile particulate polymer of 1 μm). Among these, the surfactants having a fluoroalkyl group are preferable since it is effective only with a small amount.

A content of the dispersant is not particularly restricted, and it may be appropriately selected according to purpose. Nonetheless, in a case of resin fine particles dispersion, it is preferably 0.01% by mass to 1% by mass, more preferably 0.02% by mass to 0.5% by mass, and particularly preferably 0.1% by mass to 0.2% by mass. When the content is less than 0.01% by mass, agglomeration may occur when a pH of the emulsion or dispersion is not sufficiently basic. A content of the dispersant is not particularly restricted, and it may be appropriately selected according to purpose. Nonetheless, in a case of colorant dispersion or releasing agent dispersion, it is preferably 0.01% by mass to 10% by mass, more preferably 0.1% by mass to 5% by mass, and particularly preferably 0.5% by mass to 0.2% by mass. When the content is less than 0.01% by mass, certain particles are released during agglomeration due to different stability among the particles. When it exceeds 10% by mass, there are cases where a particle size distribution of the particles becomes broad or the particle size is difficult to control.

Examples of commercial products of the dispersant include SURFLON S-111, S-112, S-113, S-121 (all manufactured by Asahi Glass Co., Ltd.), FLUORAD FC-93, FC-95, FC-98, FC-129, FC-135 (all manufactured by Sumitomo 3M Ltd.), UNIDYNE DS-101, DS-102, DS-202 (all manufactured by Daikin Industries, Ltd.), MEGAFACE F-110, F-120, F-113, F-150, F-191, F-812, F-824, F-833 (all manufactured by DIC Corporation), EFTOP EF-102, 103, 104, 105, 112, 123A, 123B, 132, 306A, 501, 201, 204 (all manufactured by Tochem Products Inc.), FTERGENT F-100, F-300, F150 (all manufactured by Neos Company Ltd.), SGP, SGP-3G (all manufactured by Soken Chemical & Engineering Co., Ltd.), PB-200H (manufactured by Kao Corporation), TECHPOLYMER SB (manufactured by Sekisui Plastics Co., Ltd.) and MICROPEARL (manufactured by Sekisui Chemical Co., Ltd.).

When the dispersant is used, the dispersant may remain on a surface of the toner particles, but it is preferably washed and removed after the reaction in view of charge of the toner. Further, in view of sharp particle size distribution and low viscosity of the toner material, it is preferable to use a solvent which dissolves the modified polyester resin after the reaction of the polyester prepolymer. The solvent preferably has a volatility that a boiling point thereof is less than 100° C. in view of easy removal, and examples thereof include water-miscible solvents such as toluene, xylene, benzene, carbon tetrachloride, methylene chloride, 1,2-dichloroethane, 1,1,2-trichloroethane, trichlorethylene, chloroform, monochlorobenzene, dichloroethylidene, methyl acetate, ethyl acetate, methyl ethyl ketone, methyl isobutyl ketone, tetrahydrofuran and methanol. These may be used alone or in combination of two or more. Among these, aromatic solvents such as toluene and xylene and halogenated hydrocarbons such as methylene chloride, 1,2-dichloroethane, chloroform and carbon tetrachloride are preferable.

A dispersing machine used in the emulsifying or dispersing step is not particularly restricted, and it may be appropriately selected according to purpose. Examples thereof include a low-speed shearing disperser, a high-speed shearing disperser, a frictional disperser, a high-pressure jet disperser and an ultrasonic disperser. Among these, the high-speed shearing disperser is preferable since it allows controlling a particle diameter of the dispersion (oil droplets) to 2 μm to 20 μm.

When the high-speed shearing disperser is used, conditions such as rotational speed, dispersion time and dispersion temperature are not particularly restricted, and they may be appropriately selected according to purpose.

The rotational speed is not particularly restricted, and it may be appropriately selected according to purpose. Nonetheless, it is preferably 1,000 rpm to 30,000 rpm, and more preferably 5,000 rpm to 20,000 rpm. The dispersion time is not particularly restricted, and it may be appropriately selected according to purpose. Nonetheless, for a batch operation, it is preferably 0.1 minutes to 5 minutes.

The dispersion temperature is not particularly restricted, and it may be appropriately selected according to purpose. Nonetheless, under an increased pressure, it is preferably 0° C. to 150° C., and more preferably 40° C. to 98° C. Here, in general, dispersion is easier when the dispersion temperature is higher.

—Desolvation Step—

The desolvation step is a step for removing the organic solvent from the emulsion or dispersion (dispersion such as emulsified slurry). A method for removing the organic solvent is not particularly restricted, and it may be appropriately selected according to purpose. Examples thereof include a method of heating the whole system gradually to remove the organic solvent in the liquid droplets completely by evaporation and a method of spraying the dispersion in a dry atmosphere (a gas of heated air, nitrogen, carbon dioxide, combustion gas and so on) (a spray dryer, a belt dryer, a rotary kiln and so on) to remove the oil droplets in the oil droplets. A desired quality may be obtained sufficiently in a processing of short time with these methods. The toner base particles are formed when the organic solvent is removed.

—Washing or Drying Step—

The washing or drying step is a step for washing or drying the toner base particles. The toner base particles may further be classified. The classification may be carried out by removing a portion of fine particles in a liquid using a cyclone, a decanter or a centrifuge, or a classification operation may be carried out after drying. Here, the resulting fine particles or coarse particles not needed may be used for particle formation again. In that case, the fine particles or the coarse particles may be wet.

—External Additive Processing Step—

The external additive processing step is a step for mixing and processing the toner base particles after drying and the external additive. The toner is obtained by mixing the toner base particles and the external additive. An apparatus used for the mixing is not particularly restricted, and it may be appropriately selected according to purpose. Nonetheless, a HENSCHEL mixer (manufactured by Mitsui Mining Co., Ltd.) is preferable. Here, an application of a mechanical impact can suppress departure of particles such as external additive from a surface of the toner base particles. A method for applying the mechanical impact is not particularly restricted, and it may be appropriately selected according to purpose. Examples thereof include: a method of applying an impact on the mixture using a blade rotating at high speed; and a method of having the mixture collide against a collision plate by placing the mixture in a high-speed flow current for acceleration. An apparatus used for the method is not particularly restricted, and it may be appropriately selected according to purpose. Examples thereof include ANGMILL (manufactured by Hosokawa Micron Co., Ltd.), a remodeled apparatus of I-TYPE MILL with a reduced grinding air pressure (manufactured by Nippon Pneumatic Mfg. Co., Ltd.), HYBRIDIZATION SYSTEM (manufactured by Nara Kikai Seisakusho Co., Ltd.), KRYPTRON SERIES (manufactured by Kawasaki Heavy Industries, Ltd.) and an automatic mortar.

<<Toner Properties>>

A ratio (Dv/Dn) of a volume-average particle diameter (Dv) to a number-average particle diameter (Dn) in the toner is not particularly restricted, and it may be appropriately selected according to purpose. Nonetheless, it is preferably 1.30 or less, and more preferably 1.00 to 1.30. When the ratio (Dv/Dn) is less than 1.00, the toner fuses on a surface of a carrier after a long-term stirring in a developing apparatus, resulting in reduction of charging performance or degradation of cleanability. When the ratio (Dv/Dn) exceeds 1.30, it becomes difficult to obtain a high-resolution, high-quality image. Variation of the particle diameter of the toner may increase when the toner in the developer is balanced.

An average circularity of the toner is not particularly restricted, and it may be appropriately selected according to purpose. Nonetheless, it is preferably 0.95 to 0.98. When the average circularity is less than 0.95, image uniformity during developing degrades. Toner transfer efficiency from an electrostatic latent image bearing member to an intermediate transfer member or from an intermediate transfer member to a recording medium decreases, and uniform transfer may not be achieved. The production method by dissolution-suspension method is to prepare a toner by emulsification process in an aqueous medium, and it is effective in reducing a particle diameter of a color toner in particular or in adjusting a shape thereof so as to have the average circularity within the above range.

The average circularity may be measured, for example, using a flow particle image analyzer (FPIA-2000, manufactured by Sysmex Corporation). First, 100 mL to 150 mL of water from which solid impurities have been removed in advance is placed in a predetermined container. To this, 0.1 mL to 0.5 mL of a surfactant is added as a dispersant, and further, around 0.1 g to 9.5 g of a measurement sample is added. A suspension in which the sample is dispersed is subjected to a dispersion treatment in an ultrasonic disperser for about 1 minute to 3 minutes to adjust a dispersion concentration to 3,000 particles/μL, to 10,000 particles/μL. Then, a shape and distribution of the toner is measured.

<Method for Producing Developer>

A method for producing the developer is not particularly restricted, and it may be appropriately selected according to purpose. Examples thereof include a method including: mixing the carrier for developing an electrostatic latent image and the toner; and stirring it using a TURBULA mixer.

(Replenishment Developer)

The replenishment developer includes the above-described carrier for developing an electrostatic latent image of the present invention and the toner. Also, the replenishment developer may be used in an image forming apparatus which forms an image by discharging an excess developer in a developing apparatus. Also, a stable image quality may be obtained over an extremely long period of time in a developing apparatus using the replenishment developer. That is, the image forming apparatus using the replenishment developer replaces the degraded carrier in the developing apparatus with the non-degraded carrier in the replenishment developer and maintains a stable charging amount over a long period of time. Thus, a stable image may be obtained. This method is effective especially for high image-area printing. Regarding degradation in high image-area printing, decrease in carrier charging ability due to the toner spent on the carrier is the main degradation of the carrier. However, by using this method, a carrier replenishment amount increased during high image-area printing, and the degraded carrier is frequently replaced.

A content of the carrier in the replenishment developer is not particularly restricted, and it may be appropriately selected according to purpose. Nonetheless, it is preferably 3% by mass or greater and less than 30% by mass.

It is preferable that a mixing ratio of the replenishment developer is 2 parts by mass to 50 parts by mass, preferably 5 parts by mass to 12 parts by mass, of the toner with respect to 1 part by mass of the carrier. When the toner is less than 2 parts by mass, an amount of the replenished carrier is excessive. The carrier is supplied in excess, and a carrier concentration in the developing apparatus is too high. As a result, a charge amount of the toner is likely to increase. Also, the increased charge amount of the toner decreases developing performance, resulting in decreased image density. Also, when it exceeds 50 parts by mass, the ratio of the carrier in the replenishment developer decreases. As a result, replacement of the carrier in the image forming apparatus is reduced, and an effect over the carrier degradation cannot be expected.

(Developing Apparatus)

The developing apparatus is equipped with the developer of the present invention, and it appropriately includes other structures according to necessity. It is preferable that the developer is filled in a container easily deformed in shape and that that a developer replenishing apparatus which sucks the replenishment developer by a suction pump and supplies it to the developing apparatus is included.

Figure 18:
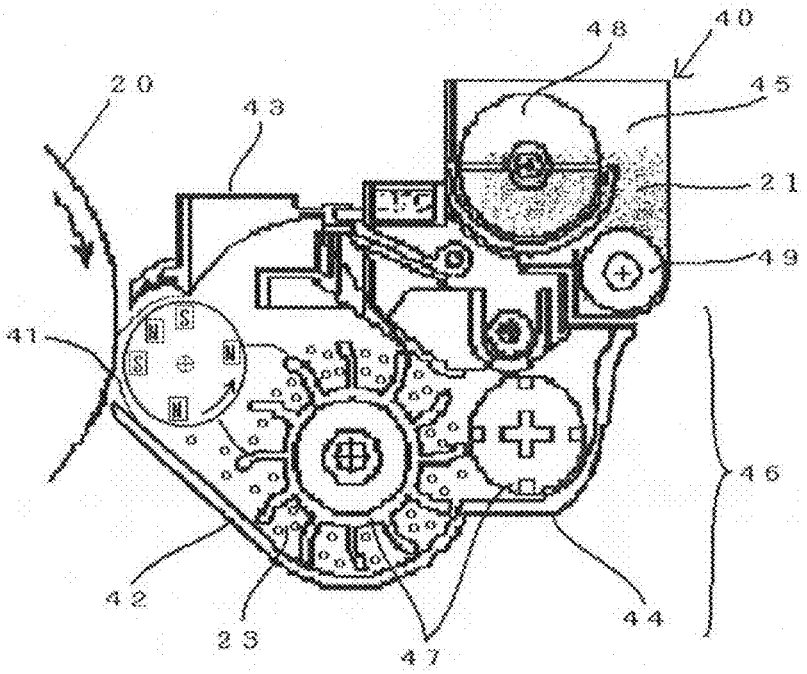
FIG. 18 is a diagram illustrating an example of a developing apparatus of the present invention.

FIG. 18 is a diagram illustrating one example of a developing apparatus of the present invention. A developing apparatus 40 arranged facing a photoconductor 20 as a latent image bearing member is composed of a developing sleeve 41 as a developer bearing member, a developer containing member 42, a doctor blade 43 as a regulating member, a support case 44 and so on.

A toner hopper 45 is joined as a toner container for containing a toner 21 to the support case 44 having an opening on a side of the photoconductor 20. In a developer container 46 which is adjacent to toner hopper 45 and contains a developer composed of the toner 21 and a carrier 23, a developer stirring mechanism 47 is arranged for stirring the toner 21 and the carrier 23 and imparting frictional/peeling charges to the toner 21. In the toner hopper 45, a toner agitator 48 and a toner supply mechanism 49 rotated by a drive means (not shown) are arranged as toner supplying means. The toner agitator 48 and the toner supply mechanism 49 send the toner 21 in the toner hopper 45 to the developer container 46 with stirring. The developing sleeve 41 is arranged in a space between the photoconductor 20 and the toner hopper 45. The developing sleeve 41, which is rotationally driven in a direction of an arrow in the figure by a drive means (not shown), includes internally a magnet (not shown) as a magnetic field generating means for forming a magnetic brush of the carrier 23 arranged at a relative position invariant to the developing apparatus 40. The doctor blade 43 is integrally attached to a side of the developer containing member 42 facing the side attached to the support case 44. The doctor blade 43 is, in this example, arranged while maintaining a certain distance between a tip thereof and an outer peripheral surface of the developing sleeve 41.

(Image Forming Apparatus and Image Forming Method)

An image forming apparatus of the present invention includes: an electrostatic latent image forming unit which forms an electrostatic latent image on an electrostatic latent image bearing member; a developing unit which develops the electrostatic latent image formed on the electrostatic latent image bearing member using a developer including a toner and the above-described carrier for developing an electrostatic latent image of the present invention to form a toner image and which contains the developer; a transfer unit which transfers the toner image formed on the electrostatic latent image bearing member to a recording medium; and a fixing unit which fixes the toner image transferred on the recording medium. The developing unit is not particularly restricted, and it may be appropriately selected according to purpose. Nonetheless, a unit which carries out development using a developer forming a magnetic brush to form a toner image is preferable. Examples of the developing unit include the developing apparatus.

An image forming method of the present invention includes: an electrostatic latent image forming step which forms an electrostatic latent image on an electrostatic latent image bearing member; a developing step which develops the electrostatic latent image formed on the electrostatic latent image bearing member using a developer including the carrier for developing an electrostatic latent image of the present invention and the toner to form a toner image; a transfer step which transfers the toner image formed on the electrostatic latent image bearing member to a recording medium; and a fixing step which fixes the toner image transferred on the recording medium. The developing step is not particularly restricted, and it may be appropriately selected according to purpose. Nonetheless, a step of developing using a developer forming a magnetic brush to form a toner image is preferable. An embodiment of the image forming apparatus of the present invention is explained using FIG. 19.

Figure 19:
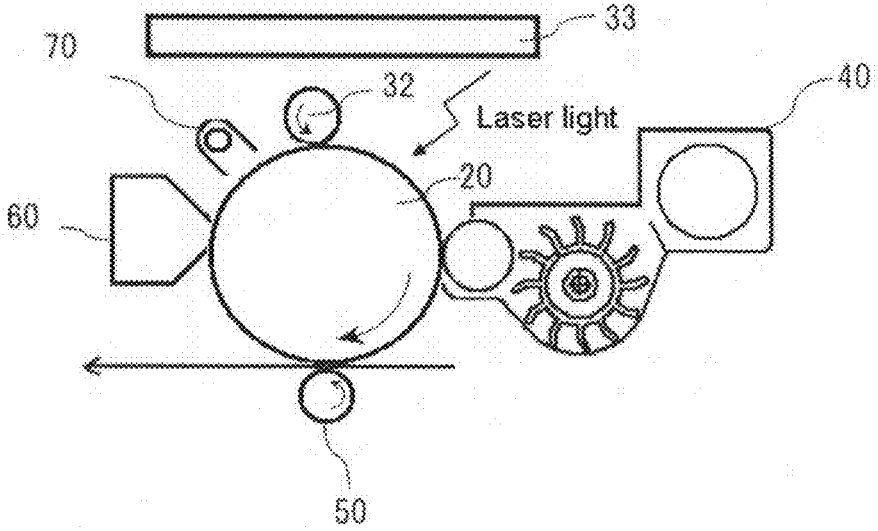
FIG. 19 is a diagram illustrating an example of an image forming apparatus of the present invention.

As illustrated in FIG. 19, first, an electrostatic latent image bearing member 20 is rotationally driven at a predetermined peripheral speed, and by a charging apparatus 32, a peripheral surface of the electrostatic latent image bearing member 20 is uniformly charged to a predetermined positive or negative potential. Next, by an exposure apparatus 33, the peripheral surface of the electrostatic latent image bearing member 20 is exposed, and electrostatic latent image is sequentially formed. Further, the electrostatic latent image formed on the peripheral surface of the electrostatic latent image bearing member 20 is developed by the developing apparatus 40 using a developer including the carrier for developing an electrostatic latent image of the present invention and a toner, and a toner image is formed. Next, the toner image formed on the peripheral surface of the electrostatic latent image bearing member 20 is synchronized with a rotation of the electrostatic latent image bearing member 20 and is sequentially transferred to transfer paper fed between the electrostatic latent image bearing member 20 and a transfer apparatus 50 from a paper-feeding unit. Further, the transfer paper on which the toner image has been transferred is separated from the peripheral surface of the electrostatic latent image bearing member 20, introduced to a fixing apparatus for fixing, and printed out to the outside of the image forming apparatus as a photocopy (copy). Meanwhile, the surface of the electrostatic latent image bearing member 20 after the toner image has been transferred is cleaned by removing a residual toner by a cleaning apparatus 60 and then neutralized by a neutralization apparatus 70 and is repeatedly used for image formation.

The image forming apparatus of the present invention preferably supplies the replenishment developer of the present invention to the developing apparatus and carries out development while discharging an excess developer in the developing apparatus. Also, it is preferable that the replenishment developer is filled in a container easily deformed in shape and that a developer replenishing apparatus which sucks the replenishment developer by a suction pump and supplies it to the developing apparatus is included.

Figure 20:
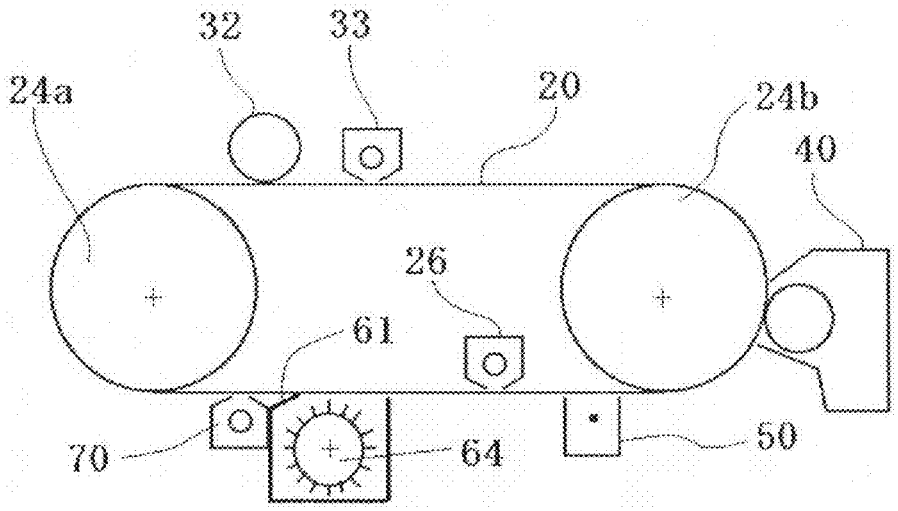
FIG. 20 is a diagram illustrating another example of an image forming apparatus of the present invention.

FIG. 20 is a diagram illustrating another example of the image forming apparatus of the present invention. A photoconductor 20 includes a photoconductive layer disposed on an electrically conductive substrate, which is driven by drive rollers 24*a*, 24*b*, and charging by a charging apparatus 32, image exposure by an exposure apparatus 33, development by a developing apparatus 40, transfer using a transfer apparatus 50 including a corona charger, pre-cleaning exposure by a pre-cleaning exposure light source 26, cleaning by a brush-shaped cleaning unit 64 and a cleaning blade 61 and neutralization by a neutralization apparatus 70 are repeatedly carried out. The pre-cleaning exposure is carried out on the photoconductor 20 from a side of the substrate (in this case, the substrate is of course transparent).

(Process Cartridge)

A process cartridge relating to the present invention includes: an electrostatic latent image bearing member; and a developing unit which develops an electrostatic latent image formed on the electrostatic latent image bearing member using a developer including the toner and the carrier for developing an electrostatic latent image of the present invention described above, and it is supported by an image forming apparatus.

Figure 21:
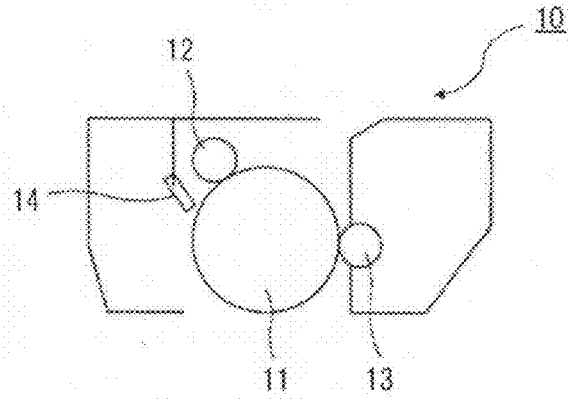
FIG. 21 is a diagram illustrating an example of a process cartridge of the present invention.

An embodiment of the process cartridge in the present invention is explained using FIG. 21.

As illustrated in FIG. 21, a process cartridge 10 includes: an electrostatic latent image bearing member 11; a charging apparatus 12 which charges the electrostatic latent image bearing member; a developing apparatus 13 which develops an electrostatic latent image formed on the electrostatic latent image bearing member using the developer of the present invention to form a toner image; and a cleaning apparatus 14 which removes a toner remaining on the electrostatic latent image bearing member after the toner image formed on the electrostatic latent image bearing member is transferred on a recording medium, and it may be detachably attached to a main body of an image forming apparatus such as copier and printer.

The process cartridge preferably has an excess developer discharged and a new developer replenished, and it is preferable that the process cartridge integrally supports an electrostatic latent image bearing member which bears the electrostatic latent image; and a developing apparatus which visualizes the electrostatic latent image on the electrostatic latent image bearing member, that the replenishment developer is supplied to the developing apparatus and that the developer is discharged from the developing apparatus. Also, it is preferable that the developing apparatus in the process cartridge includes a developer in the developing apparatus.

EXAMPLES

Hereinafter, the present invention is further described in detail with reference to Examples, which however shall not be construed as limiting the scope of the present invention. Here, arithmetic mean surface roughness values Ra1 and Ra2, an average layer-thickness difference of a coating layer, powder resistivity of fine particles, a weight-average particle diameter of a core material, an average particle diameter of fine particles, an average particle diameter of a toner and so on measured in Examples and Comparative Examples are values obtained by measurement according to the measurement methods described above.

Production Example 1-1

Production of Core Material 1

A mixed powder was obtained by weighing and mixing powders of $MnCO_3$, $Mg(OH)_2$, $Fe_2O_3$ and $SrCO_3$.

The mixed powder was calcined at 850° C. for 1 hour in an air atmosphere by a furnace, and an obtained calcined product was cooled and crashed. Thereby, powder having an average particle diameter of 3 μm or less was obtained.

A dispersant (1% by mass) and water were added to the powder to form slurry, and this slurry was supplied in a spray dryer for granulation. Thereby, a granulation product having an average particle diameter of about 40 μm was obtained.

This granulation product was charged to a firing furnace and baked at 1,180° C. for 4 hours under a nitrogen atmosphere. An obtained baked product is cracked in a cracking machine, which was sieved for particle-size adjustment, and thereby spherical ferrite particles (Core Material 1) having a volume-average particle diameter of about 35 μm was obtained. A result of a componential analysis of Core Material 1 was: MnO: 40.0 mol %; MgO: 10.0 mol %; $Fe_2O_3$: 50 mol %; and SrO: 0.4 mol %. Also, an arithmetic mean surface roughness Ra2 was 0.63 μm.

Production Example 1-2

Production of Core Material 2

A granulation product having an average particle diameter of about 40 μm was obtained in the same manner as Production Example 1-1. The granulation product was charged to a firing furnace and baked at 1,120° C. for 4 hours under a nitrogen atmosphere. An obtained baked product is cracked in a cracking machine, which was sieved for particle-size adjustment, and thereby spherical ferrite particles (Core Material 2) having a volume-average particle diameter of about 35 μm was obtained.

Also, an arithmetic mean surface roughness Ra2 was 0.85 μm.

Production Example 1-3

Production of Core Material 3

A granulation product having an average particle diameter of about 40 μm was obtained in the same manner as Production Example 1-1. The granulation product was charged to a firing furnace and baked at 1,080° C. for 4 hours under a nitrogen atmosphere. An obtained baked product is cracked in a cracking machine, which was sieved for particle-size adjustment, and thereby spherical ferrite particles (Core Material 3) having a volume-average particle diameter of about 35 μm was obtained. An arithmetic mean surface roughness Ra2 at this time was 1.03 μm Production Example 1-4

Production of Core Material 4

A mixed powder was obtained by weighing and mixing powders of $MnCO_3$, $Mg(OH)_2$, $Fe_2O_3$ and $CaCO_3$.

The mixed powder was calcined at 850° C. for 1 hour in an air atmosphere by a furnace, and an obtained calcined product was cooled and crashed. Thereby, powder having an average particle diameter of 3 μm or less was obtained.

A dispersant (1% by mass) and water were added to the powder to form a slurry, and this slurry was supplied in a spray dryer for granulation. Thereby, a granulation product having an average particle diameter of about 40 μm was obtained.

The granulation product was charged to a firing furnace and baked at 1,200° C. for 5 hours under a nitrogen atmosphere.

An obtained baked product is cracked in a cracking machine, which was sieved for particle-size adjustment, and thereby spherical ferrite particles (Core Material 4) having a volume-average particle diameter of about 35 μm was obtained.

A result of a compositional analysis of Core Material 4 was: MnO: 44.3 mol %, MgO: 0.7 mol %, $Fe_2O_3$: 53 mol %, CaO: 2.0 mol %. Also, an arithmetic mean surface roughness Ra2 was 0.68 μm.

Production Example 1-5

Production of Core Material 5

A mixed powder was obtained by weighing and mixing $MnCO_3$, $Mg(OH)_2$ and $Fe_2O_3$.

The mixed powder was calcined at 900° C. for 3 hours in an air atmosphere by a furnace, and an obtained calcined product was cooled and crashed. Thereby, powder having an average particle diameter of 1 μm was obtained.

A dispersant (1% by mass) and water were added to the powder to form a slurry, and this slurry was supplied in a spray dryer for granulation. Thereby, a granulation product having an average particle diameter of about 40 μm was obtained.

The granulation product was charged to a firing furnace and baked at 1,250° C. for 5 hours under a nitrogen atmosphere.

An obtained baked product is cracked in a cracking machine, which was sieved for particle-size adjustment, and thereby spherical ferrite particles (Core Material 5) having a volume-average particle diameter of about 35 μm was obtained.

A result of a compositional analysis of Core Material 5 was: MnO: 46.2 mol %; MgO: 0.7 mol %; $Fe_2O_3$: 53 mol %. Also, an arithmetic mean surface roughness Ra2 was 0.45 μm Production Example 2-1

Production of Electrically Conductive Particles 1

A suspension was prepared by dispersing 100 g of aluminum oxide (AKP-30, manufactured by Sumitomo Chemical Co., Ltd.) in 1 liter of water, and this solution was heated to 70° C. To the suspension, a solution in which 100 g of stannic chloride and 3 g of phosphorus pentoxide were dissolved in 1 liter of 2-N hydrochloric acid and 12-% by mass aqueous ammonia were added dropwise over 2 hours such that a pH of the suspension was 7 to 8. After the dropwise addition, the suspension was filtered and washed, and an obtained cake was dried at 110° C. Next, this dried powder was treated in a stream of nitrogen at 500° C. for 1 hour, and thereby Electrically Conductive Particles 1 was obtained.

Obtained Electrically Conductive Particles 1 had a volume resistivity of 8 Ω·cm.

Production Example 2-2

Production of Electrically Conductive Particles 2

A suspension was prepared by dispersing 100 g of aluminum oxide (AKP-30, manufactured by Sumitomo Chemical Co., Ltd.) in 1 liter of water, and this liquid was heated to 70° C. To the suspension, a solution in which 10 g of stannic chloride and 0.30 g of phosphorus pentoxide were dissolved in 100 mL of 2-N hydrochloric acid and 12-% by mass aqueous ammonia were added dropwise over 12 minutes such that a pH of the suspension was 7 to 8. After the dropwise addition, the suspension was filtered and washed, and an obtained cake was dried at 110° C. Next, this dried powder was treated in a stream of nitrogen at 500° C. for 1 hour, and thereby Electrically Conductive Particles 2 was obtained.

Obtained Electrically Conductive Particles 2 had a volume-average particle diameter of 300 nm and a volume resistivity of 1,200 Ω·cm.

Production Example 2-3

Production of Electrically Conductive Particles 3

A suspension was prepared by dispersing 100 g of aluminum oxide (AKP-30, manufactured by Sumitomo Chemical Co., Ltd.) in 1 liter of water, and this solution was heated to 70° C. To the suspension, a solution in which 150 g of stannic chloride and 4.5 g of phosphorus pentoxide were dissolved in 1.5 liter of 2-N hydrochloric acid and 12-% by mass aqueous ammonia were added dropwise over 3 hours such that a pH of the suspension was 7 to 8. After the dropwise addition, the suspension was filtered and washed, and an obtained cake was dried at 110° C. Next, this dried powder was treated in a stream of nitrogen at 500° C. for 1 hour, and thereby Electrically Conductive Particles 3 was obtained.

Obtained Electrically Conductive Particles 3 had a volume-average particle diameter of 300 nm and a volume resistivity of 3 Ω·cm.

Production Example 2-4

Production of Electrically Conductive Particles 4

Tin oxide fine powder (primary particle diameter 50 nm) having a BET surface area of 50 $m^2/g$ was heated in a nitrogen atmosphere while contacting an acetone gas and maintained at a temperature of 300° C. for 2 hours for surface modification treatment, and thereby Electrically Conductive Particles 4 was obtained.

<Electrically Conductive Particles 5>

Black Pearls-2000 (manufactured by Cabot; specific surface area: 1,500 $mm^2/g$; aspect ratio: 3) was used as Electrically Conductive Particles 5.

Production Example 3-1

Synthesis of Resin 1

First, 300 g of toluene was placed in a flask with a stirrer and heated to 90° C. under a stream of nitrogen gas. Next, to this, a mixture was added dropwise over 1 hour, the mixture including: 84.4 g of 3-methacryloxypropyltris(trimethylsiloxy)silane represented by the following structural formula:

$$CH_2{=}CMe\text{-}COO{-}C_3H_6{-}Si(OSiMe_3)_3$$

(in the above structural formula, Me denotes a methyl group) (200 mmol, SILAPLANE TM-0701T, manufactured by Chisso Corporation); 39 g (150 mmol) of 3-methacryloxypropylmethykliethoxysilane; 65.0 g (650 mmol) of methyl methacrylate; and 0.58 g (3 mmol) of 2,2'-azobis-2-methylbutyronitrile. After the dropwise addition, a solution in which 0.06 g (0.3 mmol) of 2,2'-azobis-2-methylbutyronitrile was dissolved in 15 g of toluene was added (a total amount of 2,2'-azobis-2-methylbutyronitrile of 0.64 g, 3.3 mmol), and it was mixed at 90° C. to 100° C. for 3 hours for radical copolymerization. Thereby, a methacrylic copolymer (Resin 1) was obtained.

Obtained Resin 1 had a weight-average molecular weight of 33,000. Next, this was diluted with toluene so that a non-volatile content of Resin 1 was 25% by mass. A solution of Resin 1 obtained thereby had a viscosity of 8.8 $mm^2/s$ and a specific gravity of 0.91.

Production Example 3-2

Synthesis of Resin 2

A methacrylic copolymer (Resin 2) was obtained by radical copolymerization in the same manner as Production Example 3-1 except that 39 g (150 mmol) of 3-methacryloxypropylmethyldiethoxysilane in Production Example 3-1 was replaced by 37.2 g (150 mmol) of 3-methacryloxypropyltrimethoxysilane.

The obtained methacrylic copolymer had a weight-average molecular weight of 34,000. Next, this methacrylic copolymer was diluted with toluene so that a non-volatile content of the solution was 25% by mass. The copolymer solution obtained thereby had a viscosity of 8.7 $mm^2/s$ and a specific gravity of 0.91.

<Resin 3>

A silicone resin solution (SR2410, manufactured by Dow Corning Toray Co., Ltd.) was used as Resin 3.

Production Example 3-3

Preparation of Resin 4

A coating layer coating solution (coating solution of Resin 4) was obtained by mixing: 118.69 parts by mass of a 50-% by mass acrylic resin solution (HITALOID 3001, manufactured by Hitachi Chemical Co., Ltd.); 37.18 parts by mass of a 70-% by mass guanamine solution (MY COAT 106, manufactured by Mitsui Cytec Co., Ltd.); and 0.68 parts by mass of a 40-% by mass acidic catalyst (CATALYST 4040, manufactured by Mitsui Cytec Co., Ltd.).

Production Example 4-1

Preparation of Toner Base Particles A

<<Preparation of Solution or Dispersion of Toner Material>>

—Synthesis of Non-Modified Polyester Resin (Low-Molecular-Weight Polyester Resin)—

A reactor equipped with a cooling tube, a stirrer and a nitrogen inlet tube was charged with: 67 parts by mass of ethylene oxide 2-mole adduct of bisphenol A; 84 parts by mass of propylene oxide 3-mole adduct of bisphenol A; 274 parts by mass of terephthalic acid; and 2 parts by mass of dibutyltin oxide, which was subjected to a reaction at a normal pressure and at 230° C. for 8 hours. Next, an obtained reaction solution was subjected to a reaction at a reduced pressure of 10 mmHg to 15 mmHg for 5 hours, and thereby a non-modified polyester resin was synthesized.

The obtained non-modified polyester resin had a number average molecular weight (Mn) of 2,100, a weight-average molecular weight (Mw) of 5,600, and a glass transition temperature (Tg) of 55° C.

—Preparation of Masterbatch (MB)—

Using a HENSCHEL mixer (manufactured by Mitsui Mining Co., Ltd.), 1,000 parts by mass of water, 540 parts by mass of carbon black ("PRINTEX35", manufactured by Evonik Degussa; oil absorption DBP=42 mL/100 g, pH=9.5), and 1,200 parts by mass of the non-modified polyester resin were mixed. The mixture was kneaded with a twin roll at 150° C. for 30 minutes, cooled by rolling and then pulverized with a pulverizer (manufactured by Hosokawa Micron Corporation), and thereby a masterbatch was obtained.

—Preparation of Toner Material Phase—

In a beaker, 100 parts by mass of the non-modified polyester resin and 130 parts by mass of ethyl acetate were stirred and dissolved. Next, it was charged with 10 parts by mass of carnauba wax (molecular weight=1,800, acid value=2.5, penetration=1.5 mm (40° C.)) and 10 parts by mass of the masterbatch. Then, a raw material solution was prepared by running three (3) passes using a bead mill ("ULTRA VISCO MILL", manufactured by Aimex Co., Ltd.) under the following conditions: a liquid feed rate was 1 kg/hr; a peripheral speed of a disc was 6 m/s; and zirconia beads having a diameter of 0.5 mm were packed by 80% by volume. Thereby, a solution or dispersion of the toner material (toner material phase) was prepared.

<<Preparation of Resin Fine Particles 1>>

A reactor equipped with a stirring rod and a thermometer was charged with: 683 parts by mass of water; 16 parts by mass of a sodium salt of sulfuric acid ester of methacrylic acid ethylene oxide adduct (ELEMINOL RS-30, manufactured by Sanyo Chemical Industries, Ltd.); 83 parts by mass of styrene; 83 parts by mass methacrylic acid; 110 parts by mass of butyl acrylate; and 1 part by mass of ammonium persulfate, which was stirred at 400 rpm for 15 minutes, and a white emulsion was obtained. The emulsion was heated so that the system has a temperature of 75° C. and was subjected to a reaction for 5 hours. Further, 30 parts by mass of a 1-% by mass aqueous solution of ammonium persulfate were added, which was aged at 75° C. for 5 hours, and an aqueous dispersion solution of a vinyl resin (a copolymer of styrene-methacrylic acid-butyl acrylate-sodium salt of sulfate ester of methacrylic acid ethylene oxide adduct) [Resin Fine Particles Dispersion 1] was obtained. A volume-average particle diameter of [Resin Fine Particles Dispersion 1] was measured by LA-920 (manufactured by Horiba Ltd.), and it was found to be 9 nm.

<<Preparation of Toner Base Particles A>>

—Preparation of Aqueous Medium Phase—

A milky liquid (Aqueous Medium Phase 1) was obtained by mixing and stirring: 660 parts by mass of water; 25 parts by mass of [Resin Fine Particles Dispersion 1]; 25 parts by mass of a 48.5-% aqueous solution of disodium dodecyl diphenyl ether disulfonate (ELEMINOL MON-7, manufactured by Sanyo Chemical Industries, Ltd.); and 60 parts by mass of ethyl acetate.

—Preparation of Emulsion or Dispersion—

A container was charged with 150 parts by mass of Aqueous Medium Phase 1, which was stirred at a rotational speed of 12,000 rpm using a TK HOMOMIXER (manufactured by Primix Corporation). This was mixed with 100 parts by mass of the solution or dispersion of the toner material for 10 minutes, and thereby an emulsion or dispersion (Emulsified Slurry A) was obtained.

—Removal of Organic Solvent—

A flask equipped with a degassing pipe, a stirrer and a thermometer was charged with 100 parts by mass of Emulsified Slurry A, which was subjected to desolvation with stirring at a stirring peripheral speed of 20 m/min at 30° C. for 12 hours under a reduced pressure. Thereby, Desolvation Slurry A was obtained.

—Washing—

Obtained Desolvation Slurry A was fully subjected to vacuum filtration an obtained filter cake was added with 300 parts by mass of ion-exchanged water, mixed and redispersed using a TK HOMOMIXER (at a rotational speed of 12,000 rpm for 10 minutes) and filtered. This operation was repeated three (3) times, and thereby Wash Slurry A was obtained.

—Heating Treatment—

Obtained Wash Slurry A was aged at 45° C. for 10 hours, followed by filtration. Thereby, a heat-treated cake was obtained.

—Drying—

The heat-treated cake was dried in a wind dryer at 45° C. for 48 hours and then sieved with a mesh having openings of 75 μm. Thereby, Toner Base Particles A were obtained.

Production Example 4-2

Preparation of Toner Base Particles B

<<Synthesis of Crystalline Polyester Resin>>

A 5-liter four-necked flask equipped with a nitrogen inlet tube, a dehydration tube, a stirrer and a thermocouple was charged with: 2,300 g of 1,6-hexanediol; 2,530 g of fumaric acid; 291 g of trimellitic anhydride; and 4.9 g of hydroquinone, which was subjected to a reaction at 160° C. for 5 hours. It was heated to 200° C. and reacted for 1 hour and further reacted at 8.3 kPa for 1 hour. Thereby, Crystalline Polyester Resin 1 was obtained.

<<Synthesis of Non-Crystalline Polyester Resin (Low-Molecular-Weight Polyester Resin)>>

A 5-liter four-necked flask equipped with a nitrogen inlet tube, a dehydration tube, a stirrer and a thermocouple was charged with: 229 parts by mass of ethylene oxide 2-mole adduct of bisphenol A; 529 parts by mass of propylene oxide 3-mole adduct of bisphenol A; 208 parts by mass of terephthalic acid; 46 parts by mass of adipic acid; and 2 parts by mass of dibutyltin oxide, which was subjected to a reaction at a normal temperature and at 230° C. for 7 hours. Then, it was reacted at a reduced pressure of 10 mmHg to 15 mmHg for 4 hours and then further reacted at 180° C. and at a normal pressure for 2 hours with an addition of 44 parts by mass of trimellitic anhydride in the reactor. Thereby, a non-crystalline polyester resin was obtained.

<<Synthesis of Polyester Prepolymer (Prepolymer)>>

A reactor equipped with a cooling tube, a stirrer and a nitrogen inlet tube was charged with: 682 parts by mass of ethylene oxide 2-mole adduct of bisphenol A; 81 parts by mass of propylene oxide 2-mole adduct of bisphenol A; 283 parts by mass of terephthalic acid; 22 parts by mass of trimellitic anhydride; and 2 parts by mass of dibutyltin oxide, which was subjected to a reaction at a normal temperature and at 230° C. for 8 hours. It was further reacted at a reduced pressure of 10 mmHg to 15 mmHg for 5 hours, and thereby [Intermediate Polyester] was obtained. [Intermediate Polyester] had a number average molecular weight of 2,100, a weight-average molecular weight of 9,500, a Tg of 55° C., an acid value of 0.5 mgKOH/g, and a hydroxyl value of 51 mgKOH/g.

Next, a reactor equipped with a cooling tube, a stirrer and a nitrogen inlet tube was charged with: 410 parts by mass of [Intermediate Polyester]; 89 parts by mass of isophorone diisocyanate; and 500 parts by mass of ethyl acetate, which was subjected to a reaction at 100° C. for 5 hours. Thereby, [Prepolymer] was obtained. [Prepolymer] had a free isocyanate in % by mass of 1.53%.

<<Synthesis of Ketimine Compound>>

A reactor equipped with a stirring rod and a thermometer was charged with 170 parts by mass of isophorone diamine and 75 parts by mass of methyl ethyl ketone, which was reacted at 50° C. for 5 hours. Thereby, [Ketimine Compound] was obtained. [Ketimine Compound] had an amine value of 418.

<<Synthesis of Masterbatch (MB)>>

Using a HENSCHEL mixer (manufactured by Mitsui Mining Co., Ltd.), 1,200 parts by mass of water, 540 parts by mass of carbon black ("PRINTEX35", manufactured by Evonik Degussa; oil absorption DBP=42 mL/100 g, pH=9.5), and 1,200 parts by mass of the non-crystalline polyester resin as synthesized above were mixed. The mixture was kneaded with a twin roll at 150° C. for 30 minutes, cooled by rolling and then pulverized with a pulverizer, and thereby [Masterbatch] was obtained.

<<Preparation of Pigment-Wax Dispersion>>

A container equipped with a stirring rod and a thermometer was charged with: 378 parts by mass of [Non-Crystalline Polyester Resin]; 110 parts by mass of carnauba wax; 22 parts by mass of CCA (salicylic acid metal complex E-84, manufactured by Orient Chemical Industries Co., Ltd.); and 947 parts by mass of ethyl acetate, which was heated to 80° C. with stirring, maintained at 80° C. for 5 hours and then cooled to 30° C. over 1 hour. Next, the container was charged with 500 parts by mass of [Masterbatch] and 500 parts by mass of ethyl acetate, which was mixed for 1 hour. Thereby, [Raw-Material Solution] was obtained.

Then, 1,324 parts by mass of [Raw-Material Solution] is transferred to a container, and using a bead mill (ULTRA VISCO MILL, manufactured by Aimex Co., Ltd.) packed by 80% by volume with 0.5-mm zirconia beads, the carbon black and the wax were dispersed by running three (3) passes under the conditions of a liquid feed rate of 1 kg/hour and a peripheral speed of a disk of 6 m/second. Next, 1,042.3 parts by mass of a 65-% by mass ethyl acetate solution of [Non-Crystalline Polyester Resin] was added, and by running one (1) pass under the above conditions. Thereby, [Pigment-Wax Dispersion] was obtained. A solid concentration of [Pigment-Wax Dispersion] (130° C., 30 minutes) was 50% by mass.

<<Preparation of Crystalline Polyester Dispersion>>

A 2-L container made of metal was charged with 100 g of [Crystalline Polyester Resin 1] and 400 g of ethyl acetate. It was heated and dissolved at 75° C., and then quenched in an ice-water bath at a rate of 27° C./min. To this, 500 mL of glass beads (diameter: 3 mm) was added, and it was subjected to pulverization for 10 hours in a batch-type sand mill apparatus (manufactured by Kanpe Hapio Co., Ltd.). Thereby, [Crystalline Polyester Dispersion] was obtained.

<<Synthesis of Organic Fine-Particle Emulsion>>

A reactor equipped with a stirring rod and a thermometer was charged with: 683 parts by mass of water; 11 parts by mass of a sodium salt of sulfate ester of methacrylic acid ethylene oxide adduct (ELEMINOL RS-30, manufactured by Sanyo Chemical Industries, Ltd.); 138 parts by mass of styrene; 138 parts by mass of methacrylic acid; and 1 part by mass of ammonium persulfate, which was stirred at 400 rpm for 15 minutes, and a white emulsion was obtained. The emulsion was heated so that the system has a temperature of 75° C. and was subjected to a reaction for 5 hours. Further, 30 parts by mass of a 1-% by mass aqueous solution of ammonium persulfate were added, which was aged at 75° C. for 5 hours, and an aqueous dispersion solution of a vinyl resin (a copolymer of styrene-methacrylic acid-butyl acrylate-sodium salt of sulfate ester of methacrylic acid ethylene oxide adduct) [Resin Fine Particles Dispersion 2] was obtained. A volume-average particle diameter of [Resin Fine Particles Dispersion 2] measured by LA-920 was 0.14 μm.

<<Preparation of Aqueous Medium Phase 2>>

A milky liquid (Aqueous Medium Phase 2) was obtained by mixing and stirring 990 parts by mass of water, 83 parts by mass of [Resin Fine Particles Dispersion 2], 37 parts by mass of a 48.5-% by mass aqueous solution of disodium dodecyl diphenyl ether disulfonate ("ELEMINOL MON-7", manufactured by Sanyo Chemical Industries, Ltd.) and 90 parts by mass of ethyl acetate.

<<Emuisification-Desolvation>>

First, 664 parts by mass of [Pigment-Wax Dispersion 2], 109.4 parts by mass of [Prepolymer], 73.9 parts by mass of [Crystalline Polyester Dispersion] and 4.6 parts by mass of [Ketimine Compound] were placed in a container and mixed by a TK HOMOMIXER (manufactured by Primix Corporation) at 5,000 rpm for 1 minute. Then, 1,200 parts by mass of [Aqueous Medium Phase 2] was added to the container, which was mixed by a TK HOMOMIXER at a rotational speed of 13,000 rpm for 20 minutes. Thereby, [Emulsified Slurry 2] was obtained.

A container equipped with a stirrer and a thermometer was charged with [Emulsified Slurry 2] for desolvation at 30° C. for 8 hours followed by aging at 45° C. for 4 hours. Thereby, [Dispersion Slurry 2] was obtained.

<<Washing-Drying>>

After vacuum filtration of 100 parts of [Dispersion Slurry 2], the following operations were carried out twice, and [Filter Cake 2] was obtained.

(1): To a filter cake, 100 parts of ion-exchanged water was added, which was mixed with a TK HOMOMIXER (at a rotational speed of 12,000 rpm for 10 minutes), followed by filtration.

(2): To the filter cake of (1), 100 parts of a 10-% aqueous solution of sodium hydroxide was added, which was mixed with a TK HOMOMIXER (at a rotational speed of 12,000 rpm for 30 minutes), followed by vacuum filtration.

(3): To the filter cake of (2), 100 parts of 10-% hydrochloric acid was added, which was mixed with a TK HOMOMIXER (at a rotational speed of 12,000 rpm for 10 minutes), followed by filtration.

(4): To the filter cake of (3), 300 parts of ion-exchanged water was added, which was mixed with a TK HOMOMIXER (at a rotational speed of 12,000 rpm for 10 minutes), followed by filtration.

Thereafter, [Filter Cake 2] was dried in a wind dryer at 45° C. for 48 hours and sieved with a mesh having openings of 75 μm, and [Toner Base Particles B] was obtained.

Production Example 5

Preparation of External Additive

—Preparation of Coalescent Particles (Silane-Treated Silica) (Silicas 1 to 3 and Silicas 6 to 8)—

In preparation of coalescent particles, primary silica particles having various average particle diameters were respectively subjected to secondary agglomeration using various treatment agents, and thereby coalesced silicas were manufactured. A degree of coalescence was adjusted by an average particle diameter of the primary silica particles, the treatment agent, a mixing ratio of the primary silica particles and the treatment agent, and treatment conditions (firing temperature, firing time). The primary silica particles and the treatment agent were mixed using a spray dryer. The coalescent particles (silica) prepared in this production example is shown in Table 1.

—Preparation of Coalescent Particles (Non-Spherical Dry Silica) (Silicas 4 and 5)—

Coalescent particles were produced by a dry method using an apparatus illustrated in FIG. 17.

An amount of silicon tetrachloride gas as a raw material, an amount of a hydrogen gas, an amount of an oxygen gas, a silica concentration in a flame and a residence time used in producing Silicas 4 and 5 are shown in Table 2. The prepared silicas are shown in Table 1.

TABLE 1

| No. | Treatment method | Shape | Degree of coalescence | Average particle diameter (Da) of primary particles (nm) | Average particle diameter (Db) of secondary particles (nm) |
|---|---|---|---|---|---|
| Silica 1 | Silane Treatment | Non-spherical | 2.8 | 60 | 168 |
| Silica 2 | Silane Treatment | Non-spherical | 1.9 | 58 | 110 |
| Silica 3 | Silane Treatment | Non-spherical | 3.4 | 50 | 170 |
| Silica 4 | Dry Treatment | Non-spherical | 3.9 | 31 | 120 |
| Silica 5 | Dry Treatment | Non-spherical | 3.9 | 38 | 150 |
| Silica 6 | Silane Treatment | Spherical | 1.4 | 50 | 70 |
| Silica 7 | Silane Treatment | Spherical | 1.3 | 130 | 169 |
| Silica 8 | Silane Treatment | Spherical | 5.2 | 36 | 187 |
| Silica 9 | Rx50 | Spherical | 1.1 | 40 | 44 |

In Table 1, RX50 is RX50 (silane-treated) manufactured by Nippon Aerosil Co., Ltd.

TABLE 2

| Silica No. | Silicon tetrachloride (kg/hr) | Hydrogen gas ($Nm^3$/hr) | Oxygen gas ($Nm^3$/hr) | Silica concentration (kg/$Nm^3$) | Residence time (sec) |
|---|---|---|---|---|---|
| Silica 4 | 80 | 40 | 20 | 0.51 | 0.35 |
| Silica 5 | 100 | 50 | 30 | 0.52 | 0.38 |

Production Example 6-1

Preparation of Toner A

First, 2.0 parts by mass of a coalesced silica (Silica 1) in Table 1, 2.0 parts by mass of a silica having an average particle diameter of 10 nm to 20 nm and 0.6 parts by mass of titanium oxide having an average particle diameter of 20 nm were mixed with 100 parts by mass of the toner base particles A in a HENSCHEL mixer. Then, it is passed through a sieve of 500-mesh sieve opening, and Toner A was obtained.

Production Example 6-2

Preparation of Toners B to E, G to J

Toners B to E and G to J were obtained in the same manner as Production Example 6-1 except that Silica 1 in Production Example 6-1 is replaced by silica shown in Table 3.

Production Example 6-3

Preparation of Toner F

Toner F was obtained in the same manner as Production Example 6-1 except that Toner Base Particles A and Silica 1 in Production Example 6-1 were replaced by Toner Base Particles B and Silica 4, respectively.

TABLE 3

| Toner | | | | |
|---|---|---|---|---|
| | | Silica | | |
| Toner type | Toner base particles | Silica type | Shape | Degree of coalescence |
| A | A | 1 | Non-spherical | 2.8 |
| B | A | 2 | Non-spherical | 1.9 |

TABLE 3-continued

| Toner | | | | |
|---|---|---|---|---|
| | | Silica | | |
| Toner type | Toner base particles | Silica type | Shape | Degree of coalescence |
| C | A | 3 | Non-spherical | 3.4 |
| D | A | 4 | Non-spherical (beaded) | 3.9 |
| E | A | 5 | Non-spherical | 3.9 |
| F | B | 4 | Non-spherical (beaded) | 3.9 |
| G | A | 6 | Spherical | 1.4 |
| H | A | 7 | Spherical | 1.3 |
| I | A | 8 | Spherical | 5.2 |
| J | A | 9 | Spherical | 1.1 |

Example 1

Production of Carrier

For forming a coating layer of Carrier 1 for developing an electrostatic latent image, Coating Layer Forming Solution A having the following composition (solid content: 10% by mass) was prepared. This Coating Layer Forming Solution A was applied to 1,000 parts by mass of Core Material 1, followed by drying. Here, coating and drying were carried out using a fluidized-bed coating apparatus in which a temperature in a fluidized bed was controlled at 70° C. An obtained carrier was baked in an electric furnace at 180° C./2 hours, and thereby Carrier 1 was obtained. Properties of Carrier 1 are shown in Table 4-1-1 and Table 4-1-2.

—Composition of Coating Layer Forming Solution A—

Resin for coating layer (Resin 1, solid content of 75% by mass) . . . 30 parts by mass Electrically Conductive Particles 1 . . . 56 parts by mass Catalyst . . . 4 parts by mass (Diisopropoxytitanium bis(ethylacetoacetate))

(ORGATIX TC-750, manufactured by Matsumoto Fine Chemical Co., Ltd.)

Silane coupling agent . . . 0.6 parts by mass (SH6020, manufactured by Dow Corning Toray Co., Ltd.)

Toluene . . . balance

<Preparation of Developer>

The carrier obtained as above (930 parts by mass) and a toner for a commercially available digital full-color printer (RICOH PRO C901, manufactured by Ricoh Company, Ltd.) (70 parts by mass) were mixed, and it was stirred using a TURBULA mixer at 81 rpm for 5 minutes, and a developer for evaluation was prepared. Also, a replenishment developer was prepared using the carrier and the toner so as to have a premix rate in Table 4-1-2 (a ratio of the carrier included in the replenishment developer (% by mass)).

(Evaluation)

The carriers for developing an electrostatic latent image obtained in Examples and Comparative Examples were evaluated based on various evaluation items described below. Results are shown in Table 6-1-1 and Table 6-1-2.

<Evaluation of Ghost Image>

Figure 22A:
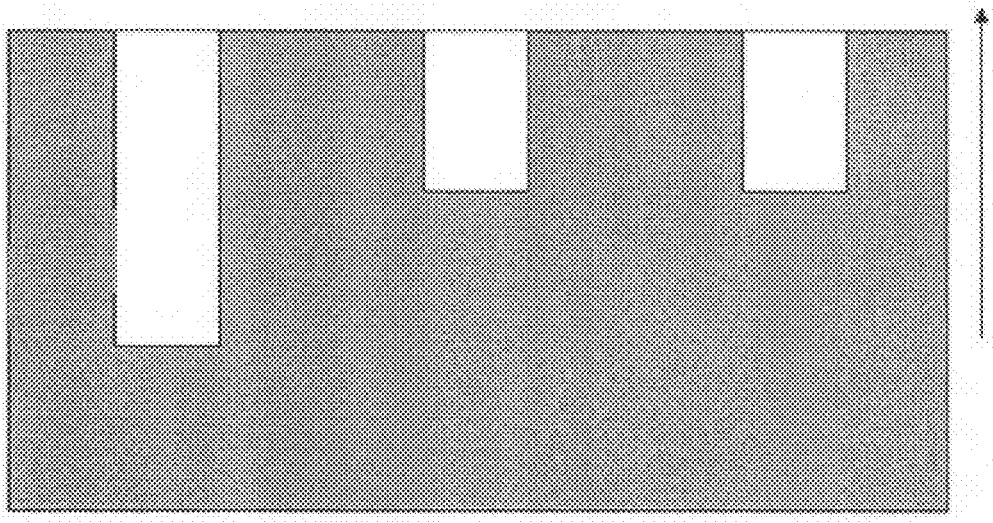
FIG. 22A is a diagram illustrating an example of a normal image in a vertical band chart (printed image), where the arrow indicates paper-feeding direction, and the gray area and the white area indicate an image area and a non-image area, respectively.
Figure 22B:
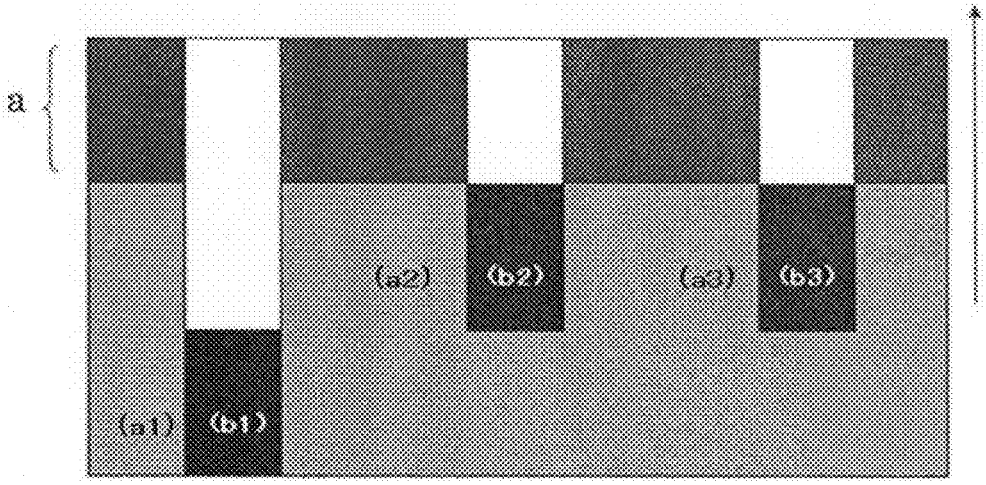
FIG. 22B is a diagram illustrating an example of an abnormal image in a vertical band chart (actual abnormal image), where the arrow indicates paper-feeding direction and "a" denotes an area corresponding to one round of a sleeve.

The developers and the replenishment developers prepared as above were respectively set in a commercially available digital full-color printer (RICOH PRO C901, manufactured by Ricoh Company, Ltd.), and 100,000 sheets of a character chart having an image area of 8% (size of 1 character: about 2 mm×2 mm) were printed out. Thereafter, a vertical band chart illustrated in FIG. 22A was printed, and by measuring a density difference between one round of a sleeve (a) and after one round (b), an effect by a previous image history is evaluated. A color measurement device (X-Rite 938, manufactured by X-Rite, Inc.) was used for the measurement. Measurements were taken at 3 locations, center, rear and front, of the sleeve, and an average density difference thereof was defined as ΔID. Here, evaluation criteria were as follows.

<<Evaluation Criteria>>

A: ΔID was 0.01 or less.

B: ΔID was greater than 0.01 and 0.03 or less.

C: ΔID was greater than 0.03 and 0.06 or less.

D: ΔID was greater than 0.06.

Here, A, B, C and D were: A: extremely favorable; B: favorable; C: fair; and D: practically unusable, respectively. A, B and C were regarded as acceptable, and D was regarded as unacceptable.

<Evaluation of Initial Carrier Adhesion>

The developers were respectively set in a remodeled apparatus of a commercially available digital full-color printer (RICOH PRO C901, manufactured by Ricoh Company, Ltd.), and a non-image chart was developed with a background potential fixed at 150V.

A number of carrier particles adhered on a photoconductor surface was counted under a loupe observation in 5 fields, and a carrier adhered amount was defined as an average number of adhered carrier particles per 100 $cm^2$.

<<Evaluation Criteria>>

A: 20 or less

B: 21 to 60

C: 61 to 80

D: 81 or greater

A, B and C were regarded as acceptable, and D was regarded as unacceptable.

<Evaluation of Edge Effect>

The developers were respectively set in a remodeled apparatus of a commercially available digital full-color printer (RICOH PRO C901, manufactured by Ricoh Company, Ltd.), and a test pattern having an image with a large area was printed out. In the obtained image pattern, a difference between an image density at a center and an image density at an end was visually evaluated based on the following evaluation criteria.

<<Evaluation Criteria>>

A: There was no difference.

B: There was a slight difference.

C: There was a difference, but it was acceptable.

D: There was a difference of an unacceptable level.

A, B and C were regarded as acceptable, and D was regarded as unacceptable.

<Evaluation of Image Resolution>

The developers were respectively set in a remodeled apparatus of a commercially available digital full-color printer (RICOH PRO C901, manufactured by Ricoh Company, Ltd.). A character chart having an image area of 5% (size of 1 character: around 2 mm×2 mm) was printed out, and a character-image portion thereof was evaluated for its reproducibility and ranked as follows.

<<Evaluation Criteria>>

A: Extremely favorable

B: Favorable

C: Fair

D: Practically unusable

A, B and C were regarded as acceptable, and D was regarded as unacceptable.

<Evaluation of Toner Dusts>

An image was formed under the same image forming conditions as the evaluation of image resolution, and toner dusts to an area other than characters (white part) were visually observed and evaluated based on the following evaluation criteria.

<<Evaluation Criteria>>

A: A favorable condition with no toner contamination observed

B: A favorable condition with slight toner contamination observed.

C: A fair condition with slight contamination observed.

D: Severe contamination beyond an acceptable range.

A, B and C were regarded as acceptable, and D was regarded as unacceptable.

<Evaluation of Color Mixing>

Color contamination (color mixing) was evaluated as follows. The developers were respectively set in a commercially available digital full-color printer (RICOH PRO C901, manufactured by Ricoh Company, Ltd.) and stirred in the developing unit alone for 1 hour. The developers obtained thereby were respectively developed and fixed, and L*1, a*1, b*1 of the CIE color system were obtained at a location with an image density of 1.5. Meanwhile, in order to obtain an image with no color contamination, an image formed only with a toner (including fixing) without contacting a carrier was prepared, and L*0, a*0, b*0 values of the CIE color system were similarly obtained at a location with an image density of 1.5. A color difference ΔE of the two (2) images thus obtained was obtained by the following formula. The ΔE of 3.0 or less was regarded as acceptable (B) since there was no problem in practical use, and the ΔE exceeding 3.0 was regarded as unacceptable since there was a problem in practical use (D).

$$\Delta E=\sqrt{[(L^*0-L^*1)^2+(a^*0-a^*1)^2+(b^*0-b^*1)^2]}$$

<Evaluation of Durability>

The developers were respectively set in a remodeled apparatus of a commercially available digital full-color printer (RICOH PRO C901, manufactured by Ricoh Company, Ltd.), and a running evaluation of 100,000 sheets of a single color was carried out. After completing this running, carrier adhesion, charge decrease and resistance decrease of the carriers were evaluated. Here, the carrier adhesion was evaluated by the same method and under the same evaluation criteria as the evaluation of the initial carrier adhesion described above.

<<Evaluation of Resistance Decrease>>

Figure 23:
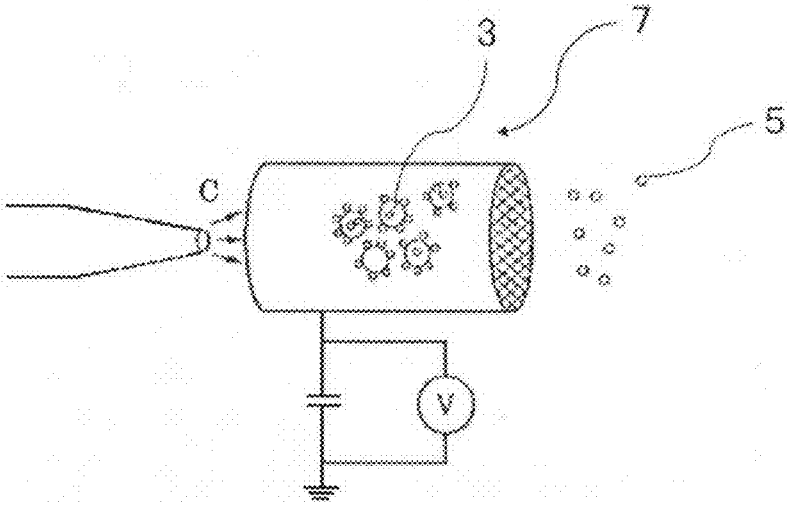
FIG. 23 is an explanatory diagram of a measurement method for measuring a charge of a developer of the present invention (blow-off method).

A carrier before running was placed between electrodes of resistance measurement parallel electrodes (gap: 2 mm) A resistance value 30 seconds after application A DC of 1,000 V DC was measured using a high resistance meter (4329A+LJK 5HVLVWDQFH OHWHU, manufactured by Yokogawa-Hewlett-Packard), which was converted to a volume resistivity (R1). A carrier obtained by removing a toner in the developer after running by the blow-off apparatus (see FIG. 23) was subjected to the same measurement as the resistance measurement method (R2). A value obtained by subtracting R2 from R1 was regarded as the resistance decrease. In FIG. 23, a reference numeral 3 denotes a carrier, and a reference numeral 5 denotes a toner, a reference numeral 7 denotes a blow gauge, and a reference character "c" denotes compressed gas.

An absolute value of the resistance decrease within 3.0 Log(Ω·cm) was considered as a practically usable level.

Also, a resistance change is caused by chipping of the resin layer in the carrier, a spent toner component, departure of fine particles having a large carrier particle diameter in the coating film and so on, and occurrences thereof may be evaluated based on an amount of resistance change.

<<Evaluation of Charge Decrease>>

A frictional charge was applied to a mixture of 93% by mass of a carrier before running and 7% by mass of a toner to prepare a sample, and a charge amount (Q1) thereof was measured by a general blow-off method (TB-200, manufactured by Toshiba Chemical Corporation). Then, the carrier was obtained by removing the toner in the developer after running by the blow-off apparatus, and a charge amount (Q2) thereof was measured by the same method as above. A value obtained by subtracting Q2 from Q1 was regarded as the charge decrease.

The charge decrease of within 10.0 μC/g is a level of no problem in practical use. Also, since the decrease in charge amount is caused by a toner spent on a carrier surface, a spent toner may be evaluated based on the charge decrease.

Examples 2 to 21 and Comparative Examples 1 to 10

Carriers were prepared in the same manner as Example 1 except that the core material, the fine particles, the dispersion method, the forming method and so on in the production of the carrier in Example 1 were changed to those indicated in Table 4-1-1 and Table 4-1-2.

Developers were prepared and evaluated in the same manner as Example 1 except that the carriers indicated in Table 4-1-1 and Table 4-1-2 were used in place of the carrier in Example 1. Results are shown in Table 6-1-1 and Table 6-1-2.

Examples 22 to 50 and Comparative Examples 11 to 21

Toners in Table 5 were used in Examples 22 to 50 and Comparative Examples 11 to 21.

Carriers were prepared in the same manner as Example 1 except that the core material, the fine particles, the dispersion method, the forming method and so on in the production of the carrier in Example 1 were changed to those indicated in Table 4-2-1, Table 4-2-2 and Table 4-2-3.

Developers were prepared and evaluated in the same manner as Example 1 except that the toners indicated in Table 5 and the carriers indicated in Table 4-2-1, Table 4-2-2 and Table 4-2-3 were used in place of the toner and the carrier in Example 1. Results are shown in Table 6-2-1 and Table 6-2-2. Here, the following evaluations were also carried out in Examples 22 to 50 and Comparative Examples 11 to 21.

<Cleanability>

The prepared developers were respectively mounted on a remodeled machine of a commercially available digital full-color printer (RICOH PRO C901, manufactured by Ricoh Company, Ltd.). Initially, and after printing out 1,000 and 100,000 sheets, a residual toner on a photoconductor which has passed the cleaning step was transferred to blank paper using a scotch tape (manufactured by Sumitomo 3M Ltd.), which was measured with a Macbeth reflection densitometer RD514 type. A difference from the blank (ΔID) was evaluated based on the following evaluation criteria.

A: ΔID was 0.01 or less.

B: ΔID was greater than 0.01 and 0.02 or less.

C: ΔID was greater than 0.02 and 0.03 or less.

D: ΔID was greater than 0.03.

A, B and C were regarded as acceptable, and D was regarded as unacceptable.

<Transfer Property>

The prepared developers were respectively mounted on a remodeled machine of a commercially available digital full-color printer (RICOH PRO C901, manufactured by Ricoh Company, Ltd.). A chart with an image area ratio of 20% was transferred from a photoconductor to paper. Then, a transfer residual toner on a photoconductor right before cleaning was transferred to blank paper with a scotch tape (manufactured by Sumitomo 3M Ltd.), which was measured with a Macbeth reflection densitometer RD514 type and evaluated based on the following criteria.

[Evaluation Criteria]

A: A difference from the blank was less than 0.005.

B: A difference from the blank was 0.005 to 0.010.

C: A difference from the blank was 0.011 to 0.02.

D: A difference from the blank exceeded 0.02.

A, B and C were regarded as acceptable, and D was regarded as unacceptable.

TABLE 4-1-1

| | Core material type | Surface roughness Ra1 (μm) | Average layer-thickness difference (μm) | D/h | Content of fine particles (%) | Electrically conductive particles |
|---|---|---|---|---|---|---|
| Ex. 1 | 1 | 0.55 | 0.3 | 0.9 | 67.7 | 1 |
| Ex. 2 | 1 | 0.55 | 0.3 | 0.9 | 67.7 | 1 |
| Ex. 3 | 1 | 0.5 | 0.2 | 0.8 | 67.7 | 1 |
| Ex. 4 | 4 | 0.5 | 0.2 | 0.8 | 67.7 | 1 |

TABLE 4-1-1-continued

| | Core material type | Surface roughness Ra1 (μm) | Average layer-thickness difference (μm) | D/h | Content of fine particles (%) | Electrically conductive particles |
|---|---|---|---|---|---|---|
| Ex. 5 | 2 | 0.7 | 0.3 | 0.9 | 67.7 | 1 |
| Ex. 6 | 2 | 0.81 | 0.2 | 0.8 | 67.7 | 1 |
| Ex. 7 | 2 | 0.75 | 0.3 | 0.9 | 67.7 | 1 |
| Ex. 8 | 2 | 0.75 | 0.15 | 0.8 | 67.7 | 1 |
| Ex. 9 | 2 | 0.75 | 0.1 | 0.6 | 67.7 | 1 |
| Ex. 10 | 2 | 0.75 | 0.08 | 0.15 | 67.7 | 2 |
| Ex. 11 | 2 | 0.75 | 0.04 | 0.04 | 67.7 | 2 |
| Ex. 12 | 2 | 0.85 | 0.3 | 0.9 | 67.7 | 1 |
| Ex. 13 | 2 | 0.8 | 0.3 | 0.9 | 66.7 | 1 |
| Ex. 14 | 2 | 0.65 | 0.3 | 0.9 | 79.2 | 1 |
| Ex. 15 | 2 | 0.75 | 0.3 | 0.9 | 61.5 | 1 |
| Ex. 16 | 2 | 0.8 | 0.3 | 0.9 | 50 | 1 |
| Ex. 17 | 2 | 0.83 | 0.3 | 0.9 | 33.3 | 1 |

TABLE 4-1-1-continued

| | Core material type | Surface roughness Ra1 (μm) | Average layer-thickness difference (μm) | D/h | Content of fine particles (%) | Electrically conductive particles |
|---|---|---|---|---|---|---|
| Comp. Ex. 4 | 2 | 0.45 | 0.3 | 0.6 | 60 | 1 |
| Comp. Ex. 5 | 3 | 1 | 0.3 | 0.9 | 23.1 | 1 |
| Comp. Ex. 6 | 1 | 0.58 | 0.01 | 0.133 | 9.1 | 2 |
| Comp. Ex. 7 | 2 | 0.84 | 0.01 | 0.09 | 6.5 | 3 |
| Comp. Ex. 8 | 1 | 0.63 | 0.01 | 0.067 | 9.1 | 3 |
| Comp. Ex. 9 | 1 | 0.63 | 0.01 | 0.067 | 9.1 | 3 |
| Comp. Ex. 10 | 1 | 0.63 | 0.01 | 0.008 | 8.3 | 3 |

TABLE 4-1-2

| | Dispersion means | Dispersion particle diameter (μm) | Ra1/Ra2 | Resin type | Method for forming resin coating layer | Premix rate (%) |
|---|---|---|---|---|---|---|
| Ex. 1 | Homomixer 10 minutes | 0.9 | 0.87 | 1 | spray | 0 |
| Ex. 2 | Homomixer 10 minutes | 0.9 | 0.87 | 2 | spray | 0 |
| Ex. 3 | Homomixer 30 minutes | 0.85 | 0.79 | 2 | spray | 0 |
| Ex. 4 | Homomixer 30 minutes | 0.85 | 0.74 | 2 | spray | 0 |
| Ex. 5 | Homomixer 10 minutes | 0.9 | 0.82 | 2 | spray | 0 |
| Ex. 6 | Homomixer 30 minutes | 0.85 | 0.95 | 2 | spray | 0 |
| Ex. 7 | Homomixer 10 minutes | 0.9 | 0.88 | 2 | spray | 0 |
| Ex. 8 | Medium dispersion 10 minutes | 0.8 | 0.88 | 2 | spray | 0 |
| Ex. 9 | Medium dispersion 1 hour | 0.6 | 0.88 | 2 | spray | 0 |
| Ex. 10 | Medium dispersion 1 hour | 0.15 | 0.88 | 2 | spray | 0 |
| Ex. 11 | Medium dispersion 2 hours | 0.04 | 0.88 | 2 | spray | 0 |
| Ex. 12 | Homomixer 10 minutes | 0.9 | 0.83 | 2 | spray | 0 |
| Ex. 13 | Homomixer 10 minutes | 0.9 | 0.94 | 2 | dipping | 0 |
| Ex. 14 | Homomixer 10 minutes | 0.9 | 0.76 | 2 | spray | 0 |
| Ex. 15 | Homomixer 10 minutes | 0.9 | 0.88 | 2 | spray | 0 |
| Ex. 16 | Homomixer 10 minutes | 0.9 | 0.94 | 2 | spray | 0 |
| Ex. 17 | Homomixer 10 minutes | 0.9 | 0.98 | 2 | spray | 0 |
| Ex. 18 | Homomixer 10 minutes | 0.9 | 0.59 | 2 | spray | 0 |
| Ex. 19 | Homomixer 10 minutes | 0.9 | 0.94 | 2 | spray | 0 |
| Ex. 20 | Homomixer 30 minutes | 0.85 | 0.95 | 2 | spray | 5 |
| Ex. 21 | Homomixer 30 minutes | 0.85 | 0.95 | 2 | spray | 10 |
| Comp. Ex. 1 | Homomixer 10 minutes | 0.9 | 0.37 | 2 | spray | 0 |
| Comp. Ex. 2 | Homomixer 10 minutes | 0.9 | 0.51 | 2 | spray | 0 |
| Comp. Ex. 3 | Homomixer 10 minutes | 0.9 | 0.65 | 2 | spray | 0 |
| Comp. Ex. 4 | Homomixer 10 minutes | 0.9 | 0.53 | 2 | spray | 0 |
| Comp. Ex. 5 | Homomixer 10 minutes | 0.9 | 0.97 | 2 | spray | 0 |
| Comp. Ex. 6 | Medium dispersion 2 hours | 0.04 | 0.92 | 2 | spray | 0 |
| Comp. Ex. 7 | Medium dispersion 1 hour | 0.03 | 0.99 | 2 | spray | 0 |
| Comp. Ex. 8 | Medium dispersion 1 hour | 0.02 | 1 | 2 | spray | 0 |
| Comp. Ex. 9 | Medium dispersion 1 hour | 0.02 | 1 | 3 | spray | 0 |
| Comp. Ex. 10 | Medium dispersion 1 hour | 0.02 | 1 | 2 | spray | 0 |

TABLE 4-1-1-continued

| | Core material type | Surface roughness Ra1 (μm) | Average layer-thickness difference (μm) | D/h | Content of fine particles (%) | Electrically conductive particles |
|---|---|---|---|---|---|---|
| Ex. 18 | 2 | 0.5 | 0.3 | 0.45 | 67.7 | 1 |
| Ex. 19 | 2 | 0.8 | 0.3 | 1.1 | 67.7 | 1 |
| Ex. 20 | 2 | 0.81 | 0.2 | 0.8 | 67.7 | 1 |
| Ex. 21 | 2 | 0.81 | 0.2 | 0.8 | 67.7 | 1 |
| Comp. Ex. 1 | 5 | 0.25 | 0.3 | 0.8 | 61.2 | 1 |
| Comp. Ex. 2 | 5 | 0.35 | 0.3 | 0.9 | 58.3 | 1 |
| Comp. Ex. 3 | 5 | 0.44 | 0.3 | 6 | 67.7 | 1 |

TABLE 4-2-1

| | Type | Ra2 (μm) | Ra1 (μm) | Ra1/Ra2 | Film thickness (μm) | Actual film thickness (μm) | Electrically conductive particles |
|---|---|---|---|---|---|---|---|
| Ex. 22 | 1 | 0.63 | 0.55 | 0.87 | 0.30 | 1.00 | 1 |
| Ex. 23 | 1 | 0.63 | 0.55 | 0.87 | 0.30 | 1.00 | 1 |
| Ex. 24 | 1 | 0.63 | 0.50 | 0.79 | 0.40 | 1.10 | 1 |
| Ex. 25 | 4 | 0.68 | 0.50 | 0.74 | 0.40 | 1.10 | 1 |
| Ex. 26 | 2 | 0.85 | 0.70 | 0.82 | 0.30 | 1.00 | 1 |
| Ex. 27 | 2 | 0.85 | 0.81 | 0.95 | 0.40 | 1.10 | 1 |
| Ex. 28 | 2 | 0.85 | 0.75 | 0.88 | 0.30 | 1.00 | 1 |
| Ex. 29 | 2 | 0.85 | 0.75 | 0.88 | 0.30 | 1.00 | 1 |
| Ex. 30 | 2 | 0.85 | 0.75 | 0.88 | 0.30 | 1.00 | 1 |
| Ex. 31 | 2 | 0.85 | 0.75 | 0.88 | 0.30 | 1.00 | 4 |
| Ex. 32 | 2 | 0.85 | 0.75 | 0.88 | 0.30 | 1.00 | 4 |

TABLE 4-2-1-continued

| | Type | Ra2 (μm) | Ra1 (μm) | Ra1/Ra2 | Film thickness (μm) | Actual film thickness (μm) | Electrically conductive particles |
|---|---|---|---|---|---|---|---|
| Ex. 33 | 2 | 1.03 | 0.85 | 0.83 | 0.30 | 1.00 | 1 |
| Ex. 34 | 2 | 0.85 | 0.80 | 0.94 | 0.30 | 1.00 | 1 |
| Ex. 35 | 2 | 0.85 | 0.65 | 0.76 | 0.30 | 1.00 | 1 |
| Ex. 36 | 2 | 0.85 | 0.75 | 0.88 | 0.30 | 1.00 | 1 |
| Ex. 37 | 2 | 0.85 | 0.80 | 0.94 | 0.30 | 1.00 | 1 |
| Ex. 38 | 2 | 0.85 | 0.83 | 0.98 | 0.30 | 1.00 | 1 |
| Ex. 39 | 2 | 0.85 | 0.50 | 0.59 | 0.60 | 2.00 | 1 |
| Ex. 40 | 2 | 0.85 | 0.80 | 0.94 | 0.20 | 0.80 | 1 |
| Ex. 41 | 2 | 0.85 | 0.81 | 0.95 | 0.40 | 1.10 | 1 |
| Ex. 42 | 2 | 0.85 | 0.81 | 0.95 | 0.40 | 1.10 | 1 |
| Ex. 43 | 1 | 0.63 | 0.50 | 0.79 | 0.40 | 1.10 | 1 |
| Ex. 44 | 1 | 0.63 | 0.50 | 0.79 | 0.40 | 1.10 | 1 |
| Ex. 45 | 1 | 0.63 | 0.50 | 0.79 | 0.40 | 1.10 | 1 |
| Ex. 46 | 3 | 1.03 | 0.85 | 0.83 | 0.30 | 1.00 | 1 |
| Ex. 47 | 3 | 1.03 | 0.85 | 0.83 | 0.30 | 1.00 | 1 |
| Ex. 48 | 3 | 1.03 | 0.85 | 0.83 | 0.30 | 1.00 | 1 |
| Ex. 49 | 3 | 1.03 | 0.85 | 0.83 | 0.30 | 1.00 | 1 |
| Ex. 50 | 3 | 1.03 | 0.85 | 0.83 | 0.30 | 1.00 | 1 |
| Comp. Ex. 11 | 5 | 0.45 | 0.25 | 0.56 | 0.40 | 1.10 | 1 |
| Comp. Ex. 12 | 5 | 0.45 | 0.35 | 0.78 | 0.30 | 1.00 | 1 |
| Comp. Ex. 13 | 5 | 0.45 | 0.44 | 0.98 | 0.10 | 0.15 | 1 |
| Comp. Ex. 14 | 2 | 0.85 | 0.45 | 0.53 | 0.70 | 1.50 | 1 |
| Comp. Ex. 15 | 3 | 1.03 | 1.00 | 0.97 | 0.30 | 1.00 | 1 |
| Comp. Ex. 16 | 1 | 0.63 | 0.58 | 0.92 | 0.30 | 0.30 | 4 |
| Comp. Ex. 17 | 2 | 0.85 | 0.84 | 0.99 | 0.30 | 0.32 | 5 |
| Comp. Ex. 18 | 1 | 0.63 | 0.63 | 1.00 | 0.30 | 0.30 | 5 |
| Comp. Ex. 19 | 1 | 0.63 | 0.63 | 1.00 | 0.30 | 0.30 | 5 |
| Comp. Ex. 20 | 1 | 0.63 | 0.63 | 1.00 | 1.00 | 2.50 | 5 |
| Comp. Ex. 21 | 5 | 0.45 | 0.44 | 0.98 | 0.10 | 0.15 | 5 |

TABLE 4-2-2

| | Filler diameter (μm) | Dispersion particle diameter (μm) | Dispersion means | Average layer-thickness difference (μm) |
|---|---|---|---|---|
| Ex. 22 | 0.35 | 0.9 | Homomixer 10 minutes | 0.30 |
| Ex. 23 | 0.35 | 0.9 | Homomixer 10 minutes | 0.30 |
| Ex. 24 | 0.35 | 0.85 | Homomixer 30 minutes | 0.20 |
| Ex. 25 | 0.35 | 0.85 | Homomixer 30 minutes | 0.20 |
| Ex. 26 | 0.35 | 0.9 | Homomixer 10 minutes | 0.30 |
| Ex. 27 | 0.35 | 0.85 | Homomixer 30 minutes | 0.20 |
| Ex. 28 | 0.35 | 0.9 | Homomixer 10 minutes | 0.30 |
| Ex. 29 | 0.35 | 0.8 | Medium dispersion 10 minutes | 0.15 |
| Ex. 30 | 0.35 | 0.6 | Medium dispersion 1 hour | 0.10 |
| Ex. 31 | 0.03 | 0.15 | Medium dispersion 1 hour | 0.08 |
| Ex. 32 | 0.03 | 0.04 | Medium dispersion 2 hours | 0.04 |
| Ex. 33 | 0.35 | 0.9 | Homomixer 10 minutes | 0.30 |
| Ex. 34 | 0.35 | 0.9 | Homomixer 10 minutes | 0.30 |
| Ex. 35 | 0.35 | 0.9 | Homomixer 10 minutes | 0.30 |
| Ex. 36 | 0.35 | 0.9 | Homomixer 10 minutes | 0.30 |
| Ex. 37 | 0.35 | 0.9 | Homomixer 10 minutes | 0.30 |
| Ex. 38 | 0.35 | 0.9 | Homomixer 10 minutes | 0.30 |
| Ex. 39 | 0.35 | 0.9 | Homomixer 10 minutes | 0.30 |
| Ex. 40 | 0.35 | 0.9 | Homomixer 10 minutes | 0.30 |

TABLE 4-2-2-continued

| | Filler diameter (μm) | Dispersion particle diameter (μm) | Dispersion means | Average layer-thickness difference (μm) |
|---|---|---|---|---|
| Ex. 41 | 0.35 | 0.85 | Homomixer 30 minutes | 0.20 |
| Ex. 42 | 0.35 | 0.85 | Homomixer 30 minutes | 0.20 |
| Ex. 43 | 0.35 | 0.85 | Homomixer 30 minutes | 0.20 |
| Ex. 44 | 0.35 | 0.85 | Homomixer 30 minutes | 0.20 |
| Ex. 45 | 0.35 | 0.85 | Homomixer 30 minutes | 0.20 |
| Ex. 46 | 0.35 | 0.9 | Homomixer 10 minutes | 0.30 |
| Ex. 47 | 0.35 | 0.9 | Homomixer 10 minutes | 0.30 |
| Ex. 48 | 0.35 | 0.9 | Homomixer 10 minutes | 0.30 |
| Ex. 49 | 0.35 | 0.9 | Homomixer 10 minutes | 0.30 |
| Ex. 50 | 0.35 | 0.9 | Homomixer 10 minutes | 0.30 |
| Comp. Ex. 11 | 0.35 | 0.9 | Homomixer 10 minutes | 0.30 |
| Comp. Ex. 12 | 0.35 | 0.9 | Homomixer 10 minutes | 0.30 |
| Comp. Ex. 13 | 0.35 | 0.9 | Homomixer 10 minutes | 0.30 |
| Comp. Ex. 14 | 0.35 | 0.9 | Homomixer 10 minutes | 0.30 |
| Comp. Ex. 15 | 0.35 | 0.9 | Homomixer 10 minutes | 0.30 |
| Comp. Ex. 16 | 0.03 | 0.04 | Medium dispersion 2 hours | 0.01 |
| Comp. Ex. 17 | 0.01 | 0.03 | Medium dispersion 1 hour | 0.01 |
| Comp. Ex. 18 | 0.01 | 0.02 | Medium dispersion 1 hour | 0.01 |
| Comp. Ex. 19 | 0.01 | 0.02 | Medium dispersion 1 hour | 0.01 |
| Comp. Ex. 20 | 0.01 | 0.02 | Medium dispersion 1 hour | 0.01 |
| Comp. Ex. 21 | 0.01 | 0.03 | Medium dispersion 1 hour | 0.01 |

TABLE 4-2-3

| | D/h | Resin type | Content of fine particles (%) | Resin coating layer forming method | Premix rate (%) |
|---|---|---|---|---|---|
| Ex. 22 | 0.90 | 3 | 67.7 | spray | 0 |
| Ex. 23 | 0.90 | 1 | 67.7 | spray | 0 |
| Ex. 24 | 0.77 | 1 | 67.7 | spray | 0 |
| Ex. 25 | 0.77 | 1 | 67.7 | spray | 0 |
| Ex. 26 | 0.90 | 1 | 67.7 | spray | 0 |
| Ex. 27 | 0.77 | 1 | 67.7 | spray | 0 |
| Ex. 28 | 0.90 | 1 | 67.7 | spray | 0 |
| Ex. 29 | 0.77 | 1 | 67.7 | spray | 0 |
| Ex. 30 | 0.60 | 1 | 67.7 | spray | 0 |
| Ex. 31 | 0.15 | 1 | 67.7 | spray | 0 |
| Ex. 32 | 0.04 | 1 | 67.7 | spray | 0 |
| Ex. 33 | 0.90 | 1 | 67.7 | spray | 0 |
| Ex. 34 | 0.90 | 1 | 66.7 | dipping | 0 |
| Ex. 35 | 0.90 | 1 | 79.2 | spray | 0 |
| Ex. 36 | 0.90 | 1 | 61.5 | spray | 0 |
| Ex. 37 | 0.90 | 1 | 50.0 | spray | 0 |
| Ex. 38 | 0.90 | 1 | 33.3 | spray | 0 |
| Ex. 39 | 0.45 | 1 | 67.7 | spray | 0 |
| Ex. 40 | 1.13 | 1 | 67.7 | spray | 0 |
| Ex. 41 | 0.77 | 1 | 67.7 | spray | 0 |
| Ex. 42 | 0.77 | 1 | 67.7 | spray | 5 |
| Ex. 43 | 0.77 | 1 | 67.7 | spray | 10 |
| Ex. 44 | 0.77 | 1 | 67.7 | spray | 0 |
| Ex. 45 | 0.77 | 1 | 67.7 | spray | 0 |
| Ex. 46 | 0.90 | 1 | 67.7 | spray | 0 |
| Ex. 47 | 0.90 | 1 | 67.7 | spray | 0 |
| Ex. 48 | 0.90 | 1 | 67.7 | spray | 0 |
| Ex. 49 | 0.90 | 1 | 67.7 | spray | 0 |
| Ex. 50 | 0.90 | 1 | 67.7 | spray | 0 |
| Comp. Ex. 11 | 0.82 | 1 | 61.2 | spray | 0 |
| Comp. Ex. 12 | 0.90 | 1 | 58.3 | spray | 0 |
| Comp. Ex. 13 | 6.00 | 1 | 67.7 | spray | 0 |

TABLE 4-2-3-continued

| | D/h | Resin type | Content of fine particles (%) | Resin coating layer forming method | Premix rate (%) |
|---|---|---|---|---|---|
| Comp. Ex. 14 | 0.60 | 1 | 60.0 | spray | 0 |
| Comp. Ex. 15 | 0.90 | 1 | 23.1 | spray | 0 |
| Comp. Ex. 16 | 0.13 | 1 | 9.1 | spray | 0 |
| Comp. Ex. 17 | 0.90 | 1 | 6.5 | spray | 0 |
| Comp. Ex. 18 | 0.07 | 1 | 9.1 | spray | 0 |
| Comp. Ex. 19 | 0.07 | 4 | 9.1 | spray | 0 |
| Comp. Ex. 20 | 0.01 | 1 | 8.3 | spray | 0 |
| Comp. Ex. 21 | 0.20 | 1 | 8.3 | spray | 0 |

In Table 4-1-2 and Table 4-2-2, a dispersion means represents a dispersion means for dispersing electrically conductive particles in a coating layer forming solution.

TABLE 5

| | Toner | | | | |
|---|---|---|---|---|---|
| | | | Silica | | |
| | Toner type | Base particles | Silica type | Shape | Degree of coalescence |
| Ex. 22 | A | A | 1 | Non-spherical | 2.8 |
| Ex. 23 | A | A | 1 | Non-spherical | 2.8 |
| Ex. 24 | A | A | 1 | Non-spherical | 2.8 |
| Ex. 25 | A | A | 1 | Non-spherical | 2.8 |
| Ex. 26 | A | A | 1 | Non-spherical | 2.8 |
| Ex. 27 | A | A | 1 | Non-spherical | 2.8 |
| Ex. 28 | A | A | 1 | Non-spherical | 2.8 |
| Ex. 29 | A | A | 1 | Non-spherical | 2.8 |
| Ex. 30 | A | A | 1 | Non-spherical | 2.8 |
| Ex. 31 | A | A | 1 | Non-spherical | 2.8 |
| Ex. 32 | A | A | 1 | Non-spherical | 2.8 |
| Ex. 33 | A | A | 1 | Non-spherical | 2.8 |
| Ex. 34 | A | A | 1 | Non-spherical | 2.8 |
| Ex. 35 | A | A | 1 | Non-spherical | 2.8 |
| Ex. 36 | A | A | 1 | Non-spherical | 2.8 |
| Ex. 37 | A | A | 1 | Non-spherical | 2.8 |
| Ex. 38 | A | A | 1 | Non-spherical | 2.8 |
| Ex. 39 | A | A | 1 | Non-spherical | 2.8 |
| Ex. 40 | A | A | 1 | Non-spherical | 2.8 |
| Ex. 41 | A | A | 1 | Non-spherical | 2.8 |
| Ex. 42 | A | A | 1 | Non-spherical | 2.8 |
| Ex. 43 | B | A | 2 | Non-spherical | 1.9 |
| Ex. 44 | C | A | 3 | Non-spherical | 3.4 |
| Ex. 45 | D | A | 4 | Non-spherical (beaded) | 3.9 |
| Ex. 46 | B | A | 2 | Non-spherical | 1.9 |
| Ex. 47 | C | A | 3 | Non-spherical | 3.4 |
| Ex. 48 | D | A | 4 | Non-spherical (beaded) | 3.9 |
| Ex. 49 | E | A | 5 | Non-spherical | 3.9 |
| Ex. 50 | F | B | 4 | Non-spherical (beaded) | 3.9 |
| Comp. Ex. 11 | A | A | 1 | Non-spherical | 2.8 |
| Comp. Ex. 12 | A | A | 1 | Non-spherical | 2.8 |
| Comp. Ex. 13 | G | A | 6 | Spherical | 1.4 |
| Comp. Ex. 14 | G | A | 6 | Spherical | 1.4 |
| Comp. Ex. 15 | A | A | 1 | Non-spherical | 2.8 |
| Comp. Ex. 16 | A | A | 1 | Non-spherical | 2.8 |
| Comp. Ex. 17 | A | A | 1 | Non-spherical | 2.8 |
| Comp. Ex. 18 | H | A | 7 | Spherical | 1.3 |
| Comp. Ex. 19 | I | A | 8 | Spherical | 5.2 |
| Comp. Ex. 20 | J | A | 9 | Spherical | 1.1 |
| Comp. Ex. 21 | J | A | 9 | Spherical | 1.1 |

TABLE 6-1-1

| | Ghost image | | Initial | | | | |
|---|---|---|---|---|---|---|---|
| | Bank evaluation | ΔID | carrier adhesion | Edge effect | Definition | Toner dusts | Color mixing |
| Ex. 1 | C | 0.06 | B | B | B | C | B |
| Ex. 2 | C | 0.04 | B | B | B | B | B |
| Ex. 3 | C | 0.06 | B | B | B | B | B |
| Ex. 4 | C | 0.05 | B | B | B | B | B |
| Ex. 5 | B | 0.02 | B | B | B | B | B |
| Ex. 6 | B | 0.03 | B | B | B | B | B |
| Ex. 7 | A | 0.01 | B | A | A | B | B |
| Ex. 8 | B | 0.02 | B | A | A | B | B |
| Ex. 9 | B | 0.03 | B | A | A | B | B |
| Ex. 10 | C | 0.04 | B | A | A | B | B |
| Ex. 11 | C | 0.05 | B | A | A | B | B |
| Ex. 12 | A | 0 | B | A | A | B | B |
| Ex. 13 | A | 0.01 | C | A | A | C | B |
| Ex. 14 | A | 0.01 | C | A | A | B | B |
| Ex. 15 | B | 0.03 | B | A | A | B | B |
| Ex. 16 | C | 0.04 | A | B | B | B | B |
| Ex. 17 | C | 0.05 | A | C | C | C | B |
| Ex. 18 | C | 0.04 | B | A | A | B | B |
| Ex. 19 | A | 0.01 | B | A | A | B | B |
| Ex. 20 | B | 0.02 | B | A | A | A | B |
| Ex. 21 | A | 0.01 | B | A | A | A | B |
| Comp. Ex. 1 | D | 0.08 | B | C | C | B | B |
| Comp. Ex. 2 | D | 0.1 | A | D | D | B | B |
| Comp. Ex. 3 | B | 0.04 | D | A | A | D | B |
| Comp. Ex. 4 | D | 0.08 | B | C | C | C | B |
| Comp. Ex. 5 | D | 0.08 | B | C | C | C | B |
| Comp. Ex. 6 | D | 0.11 | A | C | C | C | D |
| Comp. Ex. 7 | D | 0.08 | B | A | A | D | D |
| Comp. Ex. 8 | A | 0.01 | B | A | A | B | D |
| Comp. Ex. 9 | A | 0.01 | B | A | A | B | D |
| Comp. Ex. 10 | A | 0.01 | B | B | B | B | D |

TABLE 6-1-2

| | | Durability | | | |
|---|---|---|---|---|---|
| | Initial volume resistivity R1 [Log (Ω · m)] | Initial volume resistivity after running R2 [Log (Ω · m)] | Carrier adhesion after running | Resistance decrease [Log (Ω · m)] | Charge decrease (μC/g) |
| Ex. 1 | 10.5 | 8.5 | C | 2 | 9 |
| Ex. 2 | 10.5 | 9.5 | B | 1 | 6 |
| Ex. 3 | 10 | 9.3 | B | 0.7 | 7 |
| Ex. 4 | 9.8 | 9.3 | B | 0.5 | 7 |
| Ex. 5 | 10.5 | 9.6 | B | 0.9 | 4 |
| Ex. 6 | 10 | 9.3 | B | 0.7 | 5 |
| Ex. 7 | 9 | 9 | B | 0 | 3 |
| Ex. 8 | 9.3 | 9 | B | 0.3 | 5 |
| Ex. 9 | 9.6 | 9.3 | B | 0.3 | 6 |
| Ex. 10 | 10 | 10.1 | B | −0.1 | 7 |
| Ex. 11 | 10.5 | 10.6 | B | −0.1 | 9 |
| Ex. 12 | 9.5 | 9.5 | B | 0 | 3 |
| Ex. 13 | 8.8 | 9 | B | −0.2 | 4 |
| Ex. 14 | 8.5 | 8.6 | C | −0.1 | 2 |
| Ex. 15 | 10.9 | 9.6 | B | 1.3 | 5 |
| Ex. 16 | 12 | 10.5 | B | 1.5 | 7 |
| Ex. 17 | 13 | 10.3 | B | 2.7 | 9 |
| Ex. 18 | 11 | 9.6 | B | 1.4 | 6 |
| Ex. 19 | 10.1 | 8.3 | C | 1.8 | 3 |

TABLE 6-1-2-continued

| | Initial volume resistivity R1 [Log (Ω · m)] | Durability: Initial volume resistivity after running R2 [Log (Ω · m)] | Carrier adhesion after running | Resistance decrease [Log (Ω · m)] | Charge decrease (μC/g) |
|---|---|---|---|---|---|
| Ex. 20 | 10 | 9.5 | B | 0.5 | 2 |
| Ex. 21 | 10 | 9.8 | B | 0.2 | 0 |
| Comp. Ex. 1 | 9 | 10 | B | −1 | 11 |
| Comp. Ex. 2 | 13 | 14 | B | −1 | 12 |
| Comp. Ex. 3 | 7.9 | 6.5 | D | 1.4 | 14 |
| Comp. Ex. 4 | 12 | 11.5 | B | 0.5 | 11 |
| Comp. Ex. 5 | 13 | 8 | D | 5 | 8 |
| Comp. Ex. 6 | 14 | 7 | D | 7 | 13 |
| Comp. Ex. 7 | 9 | 6.5 | D | 2.5 | 5 |
| Comp. Ex. 8 | 9.5 | 6.4 | D | 3.1 | 3 |
| Comp. Ex. 9 | 9.5 | 8.5 | C | 1 | 15 |
| Comp. Ex. 10 | 9.5 | 8 | C | 1.5 | 11 |

TABLE 6-2-1

| | SR | Ghost image: Rank evaluation | Ghost image: ΔID | Initial carrier adhesion | Edge effect | Definition | Toner dusts | Color mixing |
|---|---|---|---|---|---|---|---|---|
| Ex. 22 | 10.5 | C | 0.06 | B | B | B | C | B |
| Ex. 23 | 10.5 | C | 0.05 | B | B | B | B | B |
| Ex. 24 | 10.0 | C | 0.06 | B | B | B | B | B |
| Ex. 25 | 9.8 | C | 0.05 | B | B | B | B | B |
| Ex. 26 | 10.5 | B | 0.02 | B | B | B | B | B |
| Ex. 27 | 10.0 | B | 0.03 | B | B | B | B | B |
| Ex. 28 | 9.0 | B | 0.02 | B | A | A | B | B |
| Ex. 29 | 9.3 | B | 0.03 | B | A | A | B | B |
| Ex. 30 | 9.6 | C | 0.04 | B | A | A | B | B |
| Ex. 31 | 10.0 | C | 0.05 | B | A | A | B | B |
| Ex. 32 | 10.5 | C | 0.06 | B | A | A | B | B |
| Ex. 33 | 9.5 | B | 0.02 | B | A | A | B | B |
| Ex. 34 | 8.8 | B | 0.03 | C | A | A | C | B |
| Ex. 35 | 8.5 | B | 0.03 | C | A | A | B | B |
| Ex. 36 | 10.9 | C | 0.04 | B | A | A | B | B |
| Ex. 37 | 12.0 | C | 0.05 | A | B | B | B | B |
| Ex. 38 | 13.0 | C | 0.06 | A | C | C | C | B |
| Ex. 39 | 11.0 | C | 0.05 | B | A | A | B | B |
| Ex. 40 | 10.1 | B | 0.02 | B | A | A | B | B |
| Ex. 41 | 10.0 | B | 0.03 | B | A | A | A | B |
| Ex. 42 | 10.0 | B | 0.02 | B | A | A | A | B |
| Ex. 43 | 10.0 | C | 0.04 | B | B | B | B | B |
| Ex. 44 | 10.0 | B | 0.03 | B | B | A | A | B |
| Ex. 45 | 10.0 | B | 0.02 | B | B | A | A | B |
| Ex. 46 | 9.5 | A | 0.01 | B | A | B | B | B |
| Ex. 47 | 9.5 | A | 0.01 | B | A | A | A | B |
| Ex. 48 | 9.5 | A | 0.00 | B | A | A | A | B |
| Ex. 49 | 9.5 | A | 0.00 | B | A | A | A | B |
| Ex. 50 | 9.5 | A | 0.00 | A | A | A | A | B |
| Comp. Ex. 11 | 9.0 | D | 0.11 | B | C | C | B | B |
| Comp. Ex. 12 | 13.0 | D | 0.90 | A | D | D | B | B |
| Comp. Ex. 13 | 7.9 | D | 0.14 | D | A | A | D | B |
| Comp. Ex. 14 | 12.0 | D | 0.15 | B | C | C | C | B |

TABLE 6-2-1-continued

| | SR | Ghost image: Rank evaluation | Ghost image: ΔID | Initial carrier adhesion | Edge effect | Definition | Toner dusts | Color mixing |
|---|---|---|---|---|---|---|---|---|
| Comp. Ex. 15 | 13.0 | D | 0.16 | B | C | D | C | B |
| Comp. Ex. 16 | 14.0 | D | 0.14 | A | C | C | C | B |
| Comp. Ex. 17 | 9.0 | D | 0.09 | B | A | A | D | D |
| Comp. Ex. 18 | 9.5 | D | 0.13 | B | A | A | B | D |
| Comp. Ex. 19 | 9.5 | D | 0.11 | B | A | A | B | D |
| Comp. Ex. 20 | 9.5 | D | 0.13 | B | B | B | B | D |
| Comp. Ex. 21 | 7.9 | D | 0.18 | D | A | A | D | B |

TABLE 6-2-2

| | Cleanability | Transfer property | Durability: Initial volume resistivity after running R2 [Log (Ω · m)] | Carrier adhesion after running | Resistance decrease [Log (Ω · m)] | Charge decrease (μC/g) |
|---|---|---|---|---|---|---|
| Ex. 22 | C | C | 8.5 | C | 2.0 | 9 |
| Ex. 23 | C | C | 9.5 | B | 1.0 | 6 |
| Ex. 24 | C | C | 9.3 | B | 0.7 | 7 |
| Ex. 25 | C | C | 9.3 | B | 0.5 | 7 |
| Ex. 26 | C | C | 9.6 | B | 0.9 | 4 |
| Ex. 27 | C | C | 9.3 | B | 0.7 | 5 |
| Ex. 28 | C | C | 9.0 | B | 0.0 | 3 |
| Ex. 29 | C | C | 9.0 | B | 0.3 | 5 |
| Ex. 30 | C | C | 9.3 | B | 0.3 | 6 |
| Ex. 31 | C | C | 10.1 | B | −0.1 | 7 |
| Ex. 32 | C | C | 10.6 | B | −0.1 | 9 |
| Ex. 33 | C | C | 9.4 | B | 0.1 | 3 |
| Ex. 34 | C | C | 9.0 | B | −0.2 | 4 |
| Ex. 35 | C | C | 8.6 | C | −0.1 | 2 |
| Ex. 36 | C | C | 9.6 | B | 1.3 | 5 |
| Ex. 37 | C | C | 10.5 | B | 1.5 | 7 |
| Ex. 38 | C | C | 10.3 | B | 2.7 | 9 |
| Ex. 39 | C | C | 9.6 | B | 1.4 | 6 |
| Ex. 40 | C | C | 8.3 | C | 1.8 | 3 |
| Ex. 41 | C | C | 9.5 | B | 0.5 | 2 |
| Ex. 42 | C | C | 9.8 | B | 0.2 | 0 |
| Ex. 43 | B | B | 9.3 | B | 0.7 | 7 |
| Ex. 44 | A | B | 9.3 | B | 0.7 | 4 |
| Ex. 45 | A | A | 9.3 | B | 0.7 | 1 |
| Ex. 46 | B | B | 9.4 | B | 0.1 | 3 |
| Ex. 47 | A | B | 9.4 | B | 0.1 | 2 |
| Ex. 48 | A | A | 9.4 | B | 0.1 | 1 |
| Ex. 49 | A | A | 9.4 | B | 0.1 | 0 |
| Ex. 50 | A | A | 9.5 | B | 0.0 | 0 |
| Comp. Ex. 11 | B | B | 10.0 | B | −1.0 | 11 |
| Comp. Ex. 12 | B | B | 14.0 | B | −1.0 | 12 |
| Comp. Ex. 13 | D | D | 6.3 | D | 1.6 | 14 |
| Comp. Ex. 14 | D | D | 11.0 | B | 1.0 | 11 |
| Comp. Ex. 15 | D | D | 8.0 | D | 5.0 | 8 |
| Comp. Ex. 16 | B | B | 7.0 | D | 7.0 | 13 |
| Comp. Ex. 17 | B | B | 6.5 | D | 2.5 | 6 |

TABLE 6-2-2-continued

| | | | Durability | | | |
|---|---|---|---|---|---|---|
| | Clean-ability | Transfer property | Initial volume resistivity after running R2 [Log (Ω · m)] | Carrier adhe-sion after running | Resis-tance decrease [Log (Ω · m)] | Charge decrease (μC/g) |
| Comp. Ex. 18 | D | D | 6.3 | D | 3.2 | 6 |
| Comp. Ex. 19 | D | D | 8.3 | C | 1.2 | 16 |
| Comp. Ex. 20 | D | D | 7.8 | D | 1.7 | 13 |
| Comp. Ex. 21 | D | D | 6.3 | D | 1.4 | 14 |

In Examples 47 to 50, the carriers have an Ra1 of 0.60 μm to 0.85 μm, and the coalescent particles in the toner have a degree of coalescence of 3.0 to 4.0. There were almost no occurrences of a ghost image, and other evaluations results were also extremely favorable. Thus, extremely superior results were obtained.

Aspects of the present invention are as follows.

<1> A carrier for developing an electrostatic latent image, including:

a core material; and a coating layer which coats the core material, wherein the coating layer includes a resin and fine particles, wherein the coating layer has an average layer-thickness difference of 0.02 μm to 3.0 μm, and wherein the carrier for developing an electrostatic latent image has an arithmetic mean surface roughness Ra1 of 0.50 μm to 0.90 μm.

<2> The carrier for developing an electrostatic latent image according to <1>, wherein the arithmetic mean surface roughness Ra1 of the carrier for developing an electrostatic latent image is 0.60 μm to 0.85 μm.

<3> The carrier for developing an electrostatic latent image according to any one of <1> to <2>, wherein a ratio D/h of a volume-average particle diameter D of the fine particles to an average thickness h of the coating layer is 0.01 to 1.00.

<4> The carrier for developing an electrostatic latent image according to any one of <1> to <3>, wherein a content of the fine particles in the coating layer is 40% by mass to 85% by mass.

<5> The carrier for developing an electrostatic latent image according to any one of <1> to <4>, wherein a powder resistivity of the fine particles is −3 Log(Ω·cm) to 3 Log(Ω·cm).

<6> The carrier for developing an electrostatic latent image according to any one of <1> to <5>, wherein the fine particles include alumina, silica, titanium, barium, tin or carbon, or any combination thereof.

<7> The carrier for developing an electrostatic latent image according to any one of <1> to <6>, wherein a ratio Ra1/Ra2 of an arithmetic mean surface roughness of the carrier for developing an electrostatic latent image Ra1 to an arithmetic mean surface roughness of the core material Rat is 0.70 to 0.90.

<8> The carrier for developing an electrostatic latent image according to any one of <1> to <7>, wherein the resin includes a silicone resin.

<9> The carrier for developing an electrostatic latent image according to any one of <1> to <8>, wherein the resin includes a cured product of a mixture including a silane coupling agent and a silicone resin.

<10> The carrier for developing an electrostatic latent image according to any one of <1> to <9>, wherein the resin includes a crosslinked product obtained by hydrolyzing a copolymer including a portion A represented by General Formula (A) below and a portion B represented by General Formula (B) below and by condensing a generated silanol group:

General Formula (A)

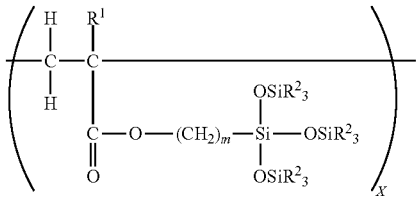

where, in General Formula (A), $R^1$ represents a hydrogen atom or a methyl group; $R^2$ represents an alkyl group having 1 to 4 carbon atoms; m represents an integer of 1 to 8; X represents a molar ratio in the copolymer, which is 10% by mole to 90% by mole, General Formula (B)

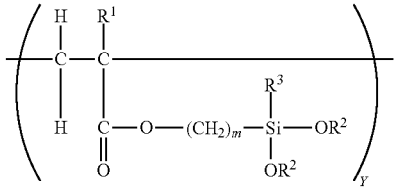

where, in General Formula (B), $R^1$ represents a hydrogen atom or a methyl group; $R^2$ represents an alkyl group having 1 to 4 carbon atoms; $R^3$ represents an alkyl group having 1 to 8 carbon atoms or an alkoxy group having 1 to 4 carbon atoms; m represents an integer of 1 to 8; Y represents a molar ratio in the copolymer, which is 10% by mole to 90% by mole.

<11> The carrier for developing an electrostatic latent image according to any one of <1> to <10>, wherein the coating layer is coated on a surface of the core material by a fluidized-bed coating apparatus.

<12> A developer, including:

the carrier for developing an electrostatic latent image according to any one of <1> to <11>; and a toner.

<13> The developer according to <12>, wherein the toner includes toner base particles and an external additive, and wherein the external additive includes a non-spherical external additive.

<14> The developer according to <13>, wherein the non-spherical external additive is non-spherical coalescent particles of coalescent primary particles.

<15> The developer according to <14>, wherein a degree of coalescence of the coalescent particles (average particle diameter of secondary particles/average particle diameter of primary particles) is 1.5 to 4.0.

<16> The developer according to any one of <14> to <15>, wherein the degree of coalescence of the coalescent particles (average particle diameter of secondary particles/average particle diameter of primary particles) is 3.0 to 4.0.

<17> The developer according to any one of <12> to <16>, wherein the toner base particles includes a modified polyester resin, a non-modified polyester resin and a colorant, and wherein the toner base particles are obtained by:

adding a polymer having a portion reactive with a compound having an active hydrogen group as a precursor of the modified polyester resin, a compound having an active hydrogen group, the non-modified polyester resin and the colorant in an organic solvent for emulsification or dispersion to obtain an emulsion or a dispersion; and subjecting the compound having an active hydrogen group and the polymer having a portion reactive with a compound having an active hydrogen group to an elongation or crosslinking reaction in the emulsion or dispersion.

<18> An image forming apparatus, including:

an electrostatic latent image forming unit, which forms an electrostatic latent image on an electrostatic latent image bearing member;

a developing unit which develops the electrostatic latent image formed on the electrostatic latent image bearing member with a developer to form a toner image and which contains the developer;

a transfer unit which transfers the toner image formed on the electrostatic latent image bearing member to a recording medium; and a fixing unit which fixes the toner image transferred on the recording medium, wherein development is carried out while the developer is supplied to the developing unit as well as the developer in excess in the developing unit is discharged, and wherein the developer is the developer according to any one of <12> to <17>.

This application claims priority to Japanese application No. 2012-200393, filed on Sep. 12, 2012 and incorporated herein by reference.

What is claimed is:

1. A carrier for developing an electrostatic latent image, comprising:

a core material; and a coating layer which coats the core material, wherein the coating layer comprises a resin and fine particles, wherein the coating layer has an average layer thickness difference of 0.02 μm to 3.0 μm, and wherein the carrier for developing an electrostatic latent image has an arithmetic mean surface roughness Ra1 of 0.50 μm to 0.90 μm, and an arithmetic mean surface roughness Ra2 of the core material is 0.50 μm to 1.50 μm.

2. The carrier for developing an electrostatic latent image according to claim 1, wherein the arithmetic mean surface roughness Ra1 of the carrier for developing an electrostatic latent image is 0.60 μm to 0.85 μm.

3. The carrier for developing an electrostatic latent image according to claim 1, wherein a ratio D/h of a volume-average particle diameter of the fine particles D to an average thickness of the coating layer h is 0.01 to 1.00.

4. The carrier for developing an electrostatic latent image according to claim 1, wherein a content of the fine particles in the coating layer is 40% by mass to 85% by mass.

5. The carrier for developing an electrostatic latent image according to claim 1, wherein a powder resistivity of the fine particles is −3 Log (Ω·cm) to 3 Log (Ω·cm).

6. The carrier for developing an electrostatic latent image according to claim 1, wherein the fine particles comprise alumina, silica, titanium, barium, tin or carbon, or any combination thereof.

7. The carrier for developing an electrostatic latent image according to claim 1, wherein a ratio Ra1/Ra2 of an arithmetic mean surface roughness of the carrier for developing an electrostatic latent image Ra1 to an arithmetic mean surface roughness of the core material Ra2 is 0.70 to 0.90.

8. The carrier for developing an electrostatic latent image according to claim 1, wherein the resin comprises a silicone resin.

9. The carrier for developing an electrostatic latent image according to claim 1, wherein the resin comprises a cured product of a mixture comprising a silane coupling agent and a silicone resin.

10. The carrier for developing an electrostatic latent image according to claim 1, wherein the resin comprises a crosslinked product obtained by hydrolyzing a copolymer including a portion A represented by General Formula (A) below and a portion B represented by General Formula (B) below and by condensing a generated silanol group:

General Formula (A)

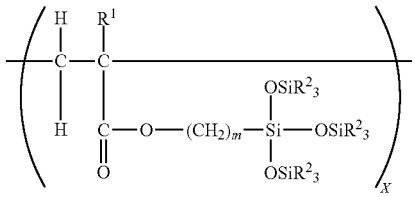

where, in General Formula (A), $R^1$ represents a hydrogen atom or a methyl group; $R^2$ represents an alkyl group having 1 to 4 carbon atoms; m represents an integer of 1 to 8; X represents a molar ratio in the copolymer, which is 10% by mole to 90% by mole, General Formula (B)

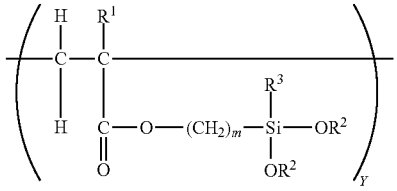

where, in General Formula (B), $R^1$ represents a hydrogen atom or a methyl group; $R^2$ represents an alkyl group having 1 to 4 carbon atoms; $R^3$ represents an alkyl group having 1 1 to 8 carbon atoms or an alkoxy group having 1 to 4 carbon atoms; m represents an integer of 1 to 8; Y represents a molar ratio in the copolymer, which is 10% by mole to 90% by mole.

11. The carrier for developing an electrostatic latent image according to claim 1, wherein the coating layer is coated on a surface of the core material by a fluidized-bed coating apparatus.

12. A developer, comprising:

a carrier for developing an electrostatic latent image; and a toner, wherein the carrier for developing an electrostatic latent image comprises:

a core material; and a coating layer which coats the core material, wherein the coating layer comprises a resin and fine particles, wherein the coating layer has an average layer thickness difference of 0.02 μm to 3.0 μm, and wherein the carrier for developing an electrostatic latent image has an arithmetic mean surface roughness Ra1 of 0.50 μm to 0.90 μm, and an arithmetic mean surface roughness Ra2 of the core material is 0.50 μm to 1.50 μm.

13. The developer according to claim 12, wherein the toner comprises toner base particles and an external additive, and wherein the external additive comprises a non-spherical external additive.

14. The developer according to claim 13, wherein the non-spherical external additive is non-spherical coalescent particles formed of coalescent primary particles.

15. The developer according to claim 14, wherein a degree of coalescence of the coalescent particles (average particle diameter of secondary particles/average particle diameter of primary particles) is 1.5 to 4.0.

16. The developer according to claim 14, wherein a degree of coalescence of the coalescent particles (average particle diameter of secondary particles/average particle diameter of primary particles) is 3.0 to 4.0.

17. The developer according to claim 12, wherein the toner base particles comprise a modified polyester resin, a non-modified polyester resin and a colorant, and wherein the toner base particles are obtained by:

adding a polymer having a portion reactive with a compound having an active hydrogen group as a precursor of the modified polyester resin, a compound having an active hydrogen group, the non-modified polyester resin and the colorant in an organic solvent for emulsification or dispersion to obtain an emulsion or a dispersion; and subjecting the compound having an active hydrogen group and the polymer having a portion reactive with a compound having an active hydrogen group to an elongation or crosslinking reaction in the emulsion or dispersion.

18. The developer according to claim 12, wherein the core material comprises a Mn—Mg—Sr ferrite.

19. The carrier for developing an electrostatic latent image according to claim 1, wherein the core material comprises a Mn—Mg—Sr ferrite.

* * * * *